US007815422B2

(12) United States Patent
Ogawa

(10) Patent No.: US 7,815,422 B2
(45) Date of Patent: Oct. 19, 2010

(54) LIQUID DISCHARGING DEVICE

(75) Inventor: Kenji Ogawa, Musashino (JP)

(73) Assignee: Neuberg Company Limited, Tokyo (JP)

( * ) Notice: Subject to any disclaimer, the term of this patent is extended or adjusted under 35 U.S.C. 154(b) by 740 days.

(21) Appl. No.: 11/814,392

(22) PCT Filed: Jan. 23, 2006

(86) PCT No.: PCT/JP2006/300974

§ 371 (c)(1),
(2), (4) Date: Jul. 20, 2007

(87) PCT Pub. No.: WO2006/078018

PCT Pub. Date: Jul. 27, 2006

(65) Prior Publication Data

US 2009/0053079 A1 Feb. 26, 2009

(30) Foreign Application Priority Data

Jan. 24, 2005 (JP) ..... 2005-015691
Jun. 24, 2005 (JP) ..... 2005-185716

(51) Int. Cl.
*F04B 17/03* (2006.01)

(52) U.S. Cl. ..... 417/410.1; 417/410.2; 417/415

(58) Field of Classification Search ..... 417/410.2, 417/415
See application file for complete search history.

(56) References Cited

U.S. PATENT DOCUMENTS 4,983,103 A * 1/1991 Ogawa ..... 417/400
5,462,199 A * 10/1995 Lenhardt ..... 222/54
5,467,899 A * 11/1995 Miller ..... 222/309
6,467,655 B1 * 10/2002 Ogawa ..... 222/309
6,685,444 B2 * 2/2004 Ogawa ..... 417/413.1
7,004,358 B2 * 2/2006 Ogawa ..... 222/386
7,432,637 B2 * 10/2008 Ogawa ..... 310/328
2008/0050256 A1 * 2/2008 Ogawa ..... 417/560

FOREIGN PATENT DOCUMENTS

| | | |
|---|---|---|
| JP | 07-189891 | 7/1995 |
| JP | 2521332 | 5/1996 |
| JP | 10-077960 | 3/1998 |
| JP | 2001-263260 | 9/2001 |
| JP | 2002-021715 | 1/2002 |

* cited by examiner

*Primary Examiner*—Devon C Kramer
*Assistant Examiner*—Bryan Lettman
(74) *Attorney, Agent, or Firm*—Rankin, Hill & Clark LLP

(57) ABSTRACT

The liquid discharging device includes a driving mechanism that drives a needle, a measurement plunger member and an inlet valve member that are concentrically-arranged inside a container. The driving mechanism includes: a piezoelectric-element support plate to which piezoelectric elements are attached; a spring for biasing the piezoelectric-element support plate toward a discharge outlet; and a control device adapted to control the piezoelectric elements separately. The piezoelectric-element support plate includes: a base end to which first end sides of the piezoelectric elements are fixed; a drive unit to which second end sides of the piezoelectric elements are fixed; and a displacement expanding portion expanding and outputting a displacement of the drive unit, the drive unit being displaced in conjunction with a expansion and contraction driving of the piezoelectric elements. Since the three members can be driven by the two piezoelectric elements, a driving at high speed can be realized and the liquid discharging device can be easily downsized.

13 Claims, 52 Drawing Sheets

LIQUID DISCHARGING DEVICE

TECHNICAL FIELD

The present invention relates to a liquid discharging device (dispenser) that discharges liquid, particularly to a liquid discharging device that can discharge liquid in infinitesimal quantity with high accuracy at high speed.

BACKGROUND ART

As a liquid discharging device, several variations have been known. Particularly, as a discharging device that can discharge liquid having a high viscosity such as silver paste in infinitesimal quantity with high accuracy at high speed, a device which drives concentrically-arranged three members has been known (see, Patent Document 1).

The liquid discharging device according to Patent Document 1 includes; a suction-path opening/closing member that opens and closes a suction-path that suctions liquid; a discharge-outlet opening/closing member that opens and closes a discharge outlet that discharges the liquid; and a discharging member that discharges the liquid. In the liquid discharging device, the discharge-outlet opening/closing member, the discharging member and the suction-path opening/closing member are concentrically arranged in this order from inside toward outside. The liquid discharging device further includes a driving mechanism that drives each of the discharge-outlet opening/closing member, the discharging member and the suction-path opening/closing member to perform a predetermined operation.

A suctioning operation in the pump is performed in the following manner: opening the suction-path opening/closing member to move the discharging member in a direction away from the discharge outlet; and suctioning the liquid into a space formed between the discharge outlet and the discharging member. On the other hand, a discharging operation is performed in the following manner: closing the suction-path opening/closing member after the liquid is suctioned; measuring the liquid to be discharged; opening the discharge-outlet opening/closing member to move the discharging member toward the discharge outlet side; discharging the liquid using the discharging member; and lastly closing the discharge-outlet opening/closing member to complete the discharging operation.

The liquid discharging device drives the members such as the discharging member using an air cylinder. By forcefully driving each of the members, the liquid discharging device can volume metric-measure the liquid confined in the space between the members. With this arrangement, the liquid discharging device can discharge the liquid even in infinitesimal quantity with high accuracy. By reducing weight of the device, the device can be attached on a robot in a production line and the device can be rapidly delivered to a point on which the liquid is to be discharged. Further, the device can ejaculate the liquid per certain amount by closing the discharge-outlet opening/closing member. The above-described advantages have led to a wide use of the device.

[Patent Document 1] Japanese Patent No. 2521332

DISCLOSURE OF THE INVENTION

Problems to be Solved by the Invention

However, the driving by the air cylinder takes long time before the members such as the discharging member starts being driven by supplied air (i.e., the rise time is long), and the driving is generally conducted at a driving speed of one operation per half a second. Accordingly, the liquid discharging device has not been able to meat demands for a driving at high speed such as ten operations per second.

For driving at high speed, ejaculating the liquid is more advantageous. However, an air-cylinder driven device cannot stably ejaculate the liquid in infinitesimal quantity; for example, water of 0.1 microliter or less. Specifically, when a nozzle provided at the discharge outlet of the liquid discharging device is made thin for discharging the liquid in infinitesimal quantity, resistance is increased, which prevents the liquid from being ejaculated. On the other hand, when a thick nozzle is used in the liquid discharging device, the device cannot discharge the liquid at high speed, which also prevents the liquid from being ejaculated.

The discharge quantity is adjusted by adjusting stroke amount of the members driven by the air cylinder. However, generally using a micrometer, the stroke adjusting mechanism rarely allows the stroke amount to be automatically set although the mechanism may allow the stroke amount to be manually set. Although an attempt was made to automatically adjust the stroke amount by driving the micrometer by a servomotor, since the arrangement adjusts the stroke amount at low speed and increases the dispenser weight, the liquid discharging device employing such an arrangement cannot be mounted on a robot arm unless the robot is relatively large. Thus, the use of the arrangement is limited.

Although the applicant has attempted to use solenoid driving and cam driving in place of the air-cylinder driving, either of the driving is problematic and not practically usable.

Specifically, although the solenoid driving could achieve a slight improvement in performance (for example, liquid-ejaculating performance) as compared with the air-cylinder driving, it is difficult to obtain the stroke using the solenoid driving. In addition, the structure is complicated. Further, since a copper coil and electromagnetic soft iron used in the solenoid driving are heavy, the solenoid driving is difficult to use and hardly a practicable dispenser in either field. The solenoid driving is not advantageous either in that it is difficult to automatically adjust the discharge quantity using the solenoid driving.

As to the cam driving, the dispenser becomes large because of difficulty in configuring the cam to be compact. Although the cam can drive at high speed and ejaculate the liquid at a desirable level because of the mechanical driving capability, it is difficult to automatically adjust the discharge quantity using the cam driving.

An object of the present invention is to provide a liquid discharging device that can: discharge liquid in infinitesimal quantity at high speed; automatically adjust discharging liquid quantity; be simply configured to reduce manufacturing cost; and be easily down-sized.

Means for Solving the Problems

A liquid discharging device according to an aspect of the present invention is a liquid discharging device that includes: a body having a liquid containing space and a discharge outlet, the liquid containing space that contains liquid to be discharge therein, the discharge outlet communicating with the liquid containing space; a discharge-outlet opening/closing member that opens and closes the discharge outlet, the discharge-outlet opening/closing member being provided inside the liquid containing space of the body; a discharging member that discharges the liquid, the discharging member being provided inside the liquid containing space of the body and concentrically arranged outside the discharge-outlet opening/closing member; a supplier opening/closing member that opens and closes a liquid supplier communicating with the liquid containing space and the discharge outlet, the supplier opening/closing member being provided inside the liquid containing space of the body and concentrically arranged outside the discharging member; and a driving mechanism that drives the discharge-outlet opening/closing member, the discharging member and the supplier opening/closing member to perform predetermined operations, a displacement amount of the driving mechanism being settable, in which the driving mechanism includes: a supplier opening/closing driver that advances and retracts the supplier opening/closing member in a first direction directed toward the discharge outlet and in a second direction directed away from the discharge outlet; a discharging driver that advances and retracts the discharging member in the first direction and the second direction; and a biasing unit that biases the discharge-outlet opening/closing member in the first direction, the supplier opening/closing member abuts on the body and closes the liquid supplier when moved in the first direction by the supplier opening/closing driver, while the supplier opening/closing member is away from the body and opens the liquid supplier when moved in the second direction by the supplier opening/closing driver to be away from the discharge outlet, the discharging member discharges the liquid from the discharge outlet when moved in the first direction by the discharging driver to approach the discharge outlet, while the discharging member suctions the liquid from the liquid supplier when moved in the second direction by the discharging driver, and the discharge-outlet opening/closing member is biased toward the discharge outlet by the biasing unit to abut on and close the discharge outlet when the liquid supplier is opened with the supplier opening/closing member being away from the body, while the discharge-outlet opening/closing member is moved against a biasing fore of the biasing unit in a direction to be away from the discharge outlet to open the discharge outlet when the supplier opening/closing member is further moved in the first direction by the supplier opening/closing driver after being moved in the first direction by the supplier opening/closing driver to abut on the body.

The driver whose displacement amount is settable herein means a driver whose displacement amount is controllable using a driving voltage value such as a piezoelectric element or a driver whose displacement is controllable using a driving pulse number such as a servomotor and step motor.

According to the present invention, since the discharge-outlet opening/closing member, the discharging member and the supplier opening/closing member are driven by the driver whose displacement amount is settable such as the piezoelectric element, servomotor and step motor, the device can be made as small and lightweight as a device using an air-cylinder. Thus, the liquid discharging device can be easily downsized as compared to a device using a driving mechanism such as a solenoid and a cam. Accordingly, when the liquid discharging device according to the present invention is used for discharging adhesives or a variety of pastes in production lines for various products, the device can be mounted on an arm of a robot to be transferred at high speed and high acceleration. Therefore, shortening takt time in the production lines can be realized, thereby contributing to productivity improvement.

Additionally, since the piezoelectric elements, the servomotor and the like are adapted to be driven at high speed, the liquid discharging device can perform the discharging operation, for example, ten times and more per second, thereby realizing a liquid discharging operation at higher speed than an air-cylinder-driven device.

Further, the piezoelectric elements, the servomotors and the like generate greater force than an air-cylinder. Thus, even when the nozzle is made thinner and resistance is increased, the liquid discharging device can ejaculate and discharge the liquid. The liquid discharging device can finely ejaculate even water of, for example, 0.01 microliter, whereby a stable operation is realized.

Since the driver such as the piezoelectric element, the servomotor and the step motor used in the liquid discharging device can be set to have a desired displacement amount, the displacement amount of the driver can be easily and accurately adjusted by controlling the driving voltage and the driving pulse number. Thus, a stroke amount of the discharging member can be easily adjusted, and the discharge quantity per one time can be automatically adjusted even during a driving operation. Accordingly, in a process to mount a plurality of electronic components on a substrate, in order to apply a different amount of an adhesive per mounting position of the electric components, the amount of the adhesive to be discharged on the substrate is required to be changed. Taking another example, in a production line where a plurality of products are conveyed in a mixed state, an amount of liquid may be required to be changed per product. Even in the above examples, the liquid discharging device can easily change the discharge quantity, thereby enhancing the usability.

Incidentally, as the biasing unit, for example, a coil spring and the like can be utilized.

A liquid discharging device according to another aspect of the present invention is a liquid discharging device that includes: a body having a liquid containing space and a discharge outlet, the liquid containing space that contains liquid to be discharge therein, the discharge outlet communicating with the liquid containing space; a discharge-outlet opening/closing member that opens and closes the discharge outlet, the discharge-outlet opening/closing member being provided inside the liquid containing space of the body; a discharging member that discharges the liquid, the discharging member being provided inside the liquid containing space of the body and concentrically arranged outside the discharge-outlet opening/closing member; a supplier opening/closing member that opens and closes a liquid supplier communicating with the liquid containing space and the discharge outlet, the supplier opening/closing member being provided inside the liquid containing space of the body and concentrically arranged outside the discharging member; and a driving mechanism that drives the discharge-outlet opening/closing member, the discharging member and the supplier opening/closing member to perform predetermined operations, in which the driving mechanism includes: a first piezoelectric element and a second piezoelectric element; a piezoelectric-element support mounted with the piezoelectric elements; a biasing unit that biases the piezoelectric-element support toward a discharge outlet relative to the body; and a drive controller adapted to drive each of the piezoelectric elements separately, the piezoelectric-element support includes: a first base end and a second base end to which first ends of the piezoelectric elements are respectively fixed; a first drive unit and a second drive unit to which second ends of the piezoelectric elements are respectively fixed; and a first displacement expanding portion and a second displacement expanding portion expanding and outputting displacement of the drive units when the drive units are displaced in conjunction with expansion and contraction of the piezoelectric elements, the supplier opening/closing member abuts on the body and closes the liquid supplier when moved in a direction to approach the discharge outlet via the first drive unit and the first displacement expanding portion in accordance with the expansion of the first piezoelectric element, while the supplier opening/closing member is moved away from the body to open the liquid supplier when moved in a direction to be away from the discharge outlet via the first drive unit and the first displacement expanding portion in accordance with the contraction of the first piezoelectric element, the discharging member discharges the liquid from the discharge outlet when moved in a direction to approach the discharge outlet via the second drive unit and the second displacement expanding portion in accordance with the expansion of the second piezoelectric element, while the discharging member suctions the liquid from the liquid supplier when moved in a direction to be away from the discharge outlet via the second drive unit and the second displacement expanding portion in accordance with the contraction of the second piezoelectric element, and the discharge-outlet opening/closing member is moved in a direction to approach the discharge outlet via the piezoelectric-element support biased toward the discharge outlet by the biasing unit and abuts on the discharge outlet to close the discharge outlet when the first piezoelectric element is contracted, while the discharge-outlet opening/closing member is moved away from the discharge outlet to open the discharge outlet when the first piezoelectric element is further expanded after being expanded to make the supplier opening/closing member abut on the body such that the piezoelectric-element support is moved against a biasing force of the biasing unit in a direction to be away from the discharge outlet.

According to the present invention, since the discharge-outlet opening/closing member, the discharging member and the supplier opening/closing member are driven by the piezoelectric element, the liquid discharging device can be made as small and lightweight as a device using an air-cylinder. Thus, the liquid discharging device can be easily downsized as compared to a device using a driving mechanism such as a servomotor, a solenoid and a cam. Accordingly, when the liquid discharging device according to the present invention is used for discharging adhesives or a variety of pastes in production lines for various products, the device can be mounted on an arm of a robot to be transferred at high speed and high acceleration. Therefore, shortening takt time in the production lines can be realized, thereby contributing to productivity improvement.

Since the piezoelectric element is adapted to be driven at high speed, the liquid discharging device can perform the discharging operation, for example, ten times and more per second, thereby realizing a liquid discharging operation at higher speed than an air-cylinder-driven device.

Further, the piezoelectric element generates greater force than an air-cylinder. Thus, even when the nozzle is made thinner and resistance is increased, the liquid discharging device can ejaculate and discharge the liquid. The liquid discharging device can finely ejaculate even water of, for example, 0.01 microliter, whereby a stable operation is realized.

Since the displacement amount of the piezoelectric element is easily adjustable with the voltage applied to the piezoelectric element, the discharge quantity per one time can be automatically adjusted even during a driving operation by adjusting the stroke amount of the discharging member with the voltage value. Accordingly, in a process to mount a plurality of electronic components on a substrate, in order to apply a different amount of an adhesive per mounting position of the electric components, the amount of the adhesive to be discharged on the substrate is required to be changed. Taking another example, in a production line where a plurality of products are conveyed in a mixed state, an amount of liquid may be required to be changed per product. Even in the above examples, the liquid discharging device can easily change the discharge quantity, thereby enhancing the usability.

While the driving of the discharging member and the supplier opening/closing member is controlled by operating the two piezoelectric elements, the driving of the discharge-outlet opening/closing member is controlled with an arrangement in which the piezoelectric element support supporting the piezoelectric element is biased toward the discharge outlet side by the biasing unit such that the supplier opening/closing member abuts on the body and the piezoelectric element is expanded in this state so as to move the piezoelectric support against the biasing force of the biasing unit in the direction to be away from the discharge outlet. With this arrangement, by merely controlling the driving of the two piezoelectric elements, the driving of the three members can be controlled. Accordingly, a configuration of the driving mechanism can be made rather simple and a manufacturing cost for the liquid discharging device can be reduced.

According to the aspect of the present invention, it is preferable that, in the liquid discharging device, the piezoelectric-element support includes: an integrally-formed piezoelectric-element support plate; and a driving arm member mounted on the piezoelectric-element support plate, the piezoelectric-element support plate includes: a base provided between the piezoelectric elements; the first base end and the second base end continuously formed from a first end of the base; the first drive unit and the second drive unit continuously formed from a second end of the base via first hinges; and a first displacement transmitter and a second displacement transmitter continuously formed from second hinges deformable relative to the base ends and third hinges deformable relative to the drive units, when the piezoelectric elements are expanded from an initial state, the first hinges are deformed such that the drive units are inclined with third hinge sides of the drive units being moved in a direction in which the piezoelectric elements are expanded, when the third hinge sides of the driving units are moved in the direction in which the piezoelectric elements are expanded in accordance with the inclination of the drive units, the second hinges are deformed such that the displacement expanding portions are inclined, the driving arm member includes: a fixing portion fixed to each of the displacement transmitters; and a driving arm extending from the fixing portion, the driving arm member being arranged such that, when the displacement transmitters are inclined, a movement amount of a tip end of the driving arm is larger than an expanding amount of the piezoelectric elements, and the displacement expanding portions are provided by the driving arm member and the displacement transmitters.

According to this aspect of the present invention, the piezoelectric-element support plate is integrally formed, so that the displacement amount of the drive unit corresponding to the expanded and contracted amount of the piezoelectric element can be accurately set.

Specifically, since the expanded amount of the piezoelectric element is extremely small, when a pin or cam is disposed in a displacement transmission path, backlash of a part where the pin or cam is placed may absorb the displacement. In contrast, in the present invention, the piezoelectric-element support plate is integrally formed in a wire-cut method, so that the device can reliably displace the displacement expanding plate by a predetermined amount in correspondence with the expansion of the piezoelectric element, while preventing the displacement from being absorbed.

According to the aspect of the present invention, it is preferable that, in the liquid discharging device, a strain gauge is mounted to at least one of the hinges.

With the strain gauges attached to one of the first to third hinges, the strain amount (deformation amount) of the hinges can be measured when the hinges are deformed in accordance with the expansion and contraction of the piezoelectric element. The strain amount is substantially proportional to the inclination amount of the displacement transmitter, i.e., the movement amount of a tip end of the driving arm. Since the discharging member is moved in accordance with the tip end of the driving arm and the liquid discharge quantity is adjusted in accordance with the movement amount of the discharging member, the discharge quantity can be indirectly measured by measuring the strain amount of the hinges with the strain gauges.

Accordingly, for example, when the liquid of a predetermined quantity is discharged, it is possible to set the strain amount corresponding to the discharge quantity as a control target in accordance with a relationship between the strain amount measured with the strain gauges and the liquid discharge quantity that has been obtained in advance. Subsequently, a feedback control may be performed so as to control the driving voltage of the piezoelectric element such that a difference between an actual strain amount measured with the strain gauge and the target strain amount is canceled. With this arrangement, the liquid discharging device can perform a liquid discharging operation of higher accuracy.

Further, the strain gauges, which are small and thin, can be easily incorporated into a small liquid discharging device driven by the piezoelectric element.

According to the aspect of the present invention, it is preferable that, in the liquid discharging device, the strain gauge is provided by four strain gauges, two of the strain gauges being attached to first surfaces of the second hinges while the other two of the strain gauges being attached to second surfaces of the second hinges, and the four strain gauges are connected to form a bridge.

With the strain gauges arranged as described above, a temperature compensating can be realized. Thus, not only a temperature influence of a lead wire but also a compression (tensile) strain can be avoided, whereby the bending strain of the second hinge can be detected with high accuracy.

Incidentally, when attached to the second hinge that is deformed in accordance with the movement of the discharging member, the strain gauge can detect the movement amount of the driving arm member with accuracy of, for example, 0.1 micron and less. Accordingly, the movement amount of the discharging member moved by the driving arm member (i.e., discharge quantity) can be detected with high accuracy.

In addition, when attached to the second hinge that is deformed in accordance with the movement of the supplier opening/closing member, the strain gauge can reliably detect an opening or closing state of the liquid supplier.

According to the present invention, although the strain gauge may be attached only to either of the second hinges, it is preferable that total eight of the strain gauges are used with the four gauges being attached to the two second hinges respectively because the strain gauges can reliably detect the operations of the liquid discharging device and the detected information can be used to perform an appropriate control.

It is preferable to provide between the base end and the displacement expanding portion a dimension adjuster for adjusting the length dimension from the base end to the displacement expanding portion.

With the dimension adjuster, the position of the displacement expanding portion can be micro-adjusted so as to be accurately located relative to the discharge-outlet opening/closing member, the supplier opening/closing member and the discharging member, thereby preventing an operational error.

Preferably, the dimension adjuster includes: a folded portion provided between the base end and the drive unit; and a thread member penetrating the folded portion, and adjusts the length dimension of the folded portion by adjusting the fastening amount of the thread member.

With the dimension adjuster arranged as described above, the length dimension (thickness dimension) of the folded portion can be shortened by fastening the thread member so as to deform a thin portion (hinge) of the folded portion, whereby the position of the displacement expanding portion relative to the base end can be easily and micro-adjusted.

According to the aspect of the present invention, it is preferable that the liquid discharging device further includes: a second biasing unit provided between the body and the supplier opening/closing member, the second biasing unit biasing the supplier opening/closing member toward a piezoelectric-element support relative to the body; a third biasing unit provided between the supplier opening/closing member and the discharging member, the third biasing unit biasing the discharging member toward a piezoelectric-element support relative to the supplier opening/closing member; and a fourth biasing unit provided between the discharging member and the discharge-outlet opening/closing member, the fourth biasing unit biasing the discharge-outlet opening/closing member toward a piezoelectric-element support relative to the discharging member, in which a biasing force of the respective second to fourth biasing units is set to be gradually reduced in the order of the second to fourth, and the biasing force of the biasing unit biasing the piezoelectric-element support toward the discharge outlet relative to the body is set to be larger than the biasing force of the second biasing unit.

As the biasing units, for instance, a coil spring can be utilized.

With this arrangement, the supplier opening/closing member, the discharging member and the discharge-outlet opening/closing member are pressed toward the piezoelectric support side by the second to fourth biasing units, whereby the members can be driven in conjunction with the movement of the piezoelectric element support and the operation of the displacement expanding portion.

Since the supplier opening/closing member, the discharging member and the discharge-outlet opening/closing member merely abut on the piezoelectric element support side, the supplier opening/closing member, the discharging member and the discharge-outlet opening/closing member can be easily detached from the piezoelectric element support side. Thus, the supplier opening/closing member, the discharging member and the discharge-outlet opening/closing member can be easily detached and washed, whereby a maintenance operation can be easily and efficiently performed.

According to the aspect of the present invention, it is preferable that, in the liquid discharging device, the drive controller is adapted to change a value of voltage applied to the first piezoelectric element from a first preset value for the first piezoelectric element to a second preset value for the first piezoelectric element, while the drive controller is adapted to change a value of voltage applied to the second piezoelectric element from a first preset value for the second piezoelectric element to a second preset value for the second piezoelectric element, and the drive controlling unit performs steps of: providing an initial state in which the voltage of the first preset values is applied to the piezoelectric elements such that the discharge outlet is closed by the discharge-outlet opening/closing member biased toward the discharge outlet by the biasing unit; measuring the liquid contained in a measurement space defined by the body and the discharging member, the discharging member being moved to a predetermined position at a discharge outlet side by changing the value of the voltage applied to the second piezoelectric element from the first preset value for the second piezoelectric element to a third preset value for the second piezoelectric element so as to expand the second piezoelectric element by a predetermined amount while maintaining the value of the voltage applied to the first piezoelectric element at the first preset value for the first piezoelectric element, the third preset value for the second piezoelectric element being larger than the first preset value for the second piezoelectric element and being smaller than the second preset value for the second piezoelectric element; switching a valve such that the supplier opening/closing member abuts on the body to close the liquid supplier while the discharge-outlet opening/closing member is moved in a direction to be away from the discharge outlet to open the discharge outlet, the supplier opening/closing member abutting on the body by changing the value of the voltage applied to the first piezoelectric element from the first preset value for the first piezoelectric element to the second preset value for the second piezoelectric element so as to expand the first piezoelectric element by a predetermined amount while maintaining the value of the voltage applied to the second piezoelectric element at the third preset value for the second piezoelectric element, the discharge-outlet opening/closing member being moved in the direction to be away from the discharge outlet by moving the piezoelectric-element support against the biasing force of the biasing unit in a direction to be away from the discharge outlet via the supplier opening/closing member abutting on the body; discharging the liquid contained in the measurement space from the discharge outlet by reducing the measurement space between the discharge member and the body, the measurement space being reduced by changing the value of the voltage applied to the second piezoelectric element from the third preset value for the second piezoelectric element to the second preset value for the second piezoelectric element such that the second piezoelectric is further expanded by a predetermined amount while maintaining the value of the voltage applied to the first piezoelectric element at the second preset value for the first piezoelectric element to move the discharging member toward the discharge outlet; opening an inlet valve by opening the liquid supplier, the liquid supplier being opened by changing the value of the voltage applied to the first piezoelectric element from the second preset value for the first piezoelectric element to the first preset value for the first piezoelectric element such that the first piezoelectric element is contracted to the original length while maintaining the value of the voltage applied to the second piezoelectric element at the second preset value for the second piezoelectric element so as to move the supplier opening/closing member away from the body; and recovering an original point by moving the discharging member away from the body to recover the initial state, the discharging member being moved away from the body by changing the value of the voltage applied to the second piezoelectric element from the second preset value for the second piezoelectric element to the first preset value for the second piezoelectric element to contract the second piezoelectric element to the original length while maintaining the value of the voltage applied to the first piezoelectric element at the first preset value for the first piezoelectric element.

According to the present invention, the outlet valve, which is opened and closed by the discharge-outlet opening/closing member, is tightly closed in the suctioning process, the inlet valve, which is opened and closed by the supplier opening/closing member, is tightly closed in the discharging process. Accordingly, with either of the outlet valve or the inlet valve being necessarily closed, the liquid can be prevented from refluxing into the supply path from the discharge outlet in each of the processes. Thus, only operating the members can reliably prevent the liquid from refluxing and there is no need to provide a check valve.

Since the liquid discharge quantity can be set using only the movement amount of the discharging member, the liquid discharging device can measure and discharge the liquid even in infinitesimal quantity with high accuracy.

According to the aspect of the present invention, it is preferable that, in the liquid discharging device, the drive controller is adapted to control a driving speed of the discharge-outlet opening/closing member, the discharging member and the supplier opening/closing member by controlling the value of the voltage applied to the piezoelectric elements.

By controlling the driving speed of the members with a current value, a cycle time of the discharging operation can be controlled, whereby the liquid discharging device can be driven at such a high speed as to discharge the liquid substantially in a continuous manner.

According to the aspect of the present invention, it is preferable that, in the liquid discharging device, the body includes: a driving mechanism housing portion that houses the piezoelectric-element support; and a container detachably attached to the driving mechanism housing portion, and the discharge outlet is provided to the container.

The container included in the body can contain the liquid of certain quantity. The liquid discharging device can be operated with the liquid of, for example, daily-used quantity contained in the container. With this arrangement, a pipe for supplying the liquid to the liquid discharging device may not be provided, thereby enhancing usability of the liquid discharging device.

In addition, a container for supplying the liquid may be connected to the container via a tube, and there may be provided with a liquid-level gauge for detecting the liquid level inside the exterior container and a valve controlled in accordance with the liquid level detected by the liquid-level gauge. With this arrangement, the valve is controlled to be opened to supply the liquid into the container when the liquid level inside the container is lowered to a predetermined level, while the valve is controlled to be closed when the liquid is filled to a predetermined level. In this manner, the liquid can be constantly supplied into the container from the container via the tube. Accordingly, the liquid discharging device may be automatically operated consecutively for twenty four hours.

A liquid discharging device according to still further aspect of the present invention is a liquid discharging device that includes: a body having a liquid containing space and a discharge outlet, the liquid containing space that contains liquid to be discharge therein, the discharge outlet communicating with the liquid containing space; a discharge-outlet opening/closing member that opens and closes the discharge outlet, the discharge-outlet opening/closing member being provided inside the liquid containing space of the body; a discharging member that discharges the liquid, the discharging member being provided inside the liquid containing space of the body and concentrically arranged outside the discharge-outlet opening/closing member; a supplier opening/closing member that opens and closes a liquid supplier communicating with the liquid containing space and the discharge outlet, the supplier opening/closing member being provided inside the liquid containing space of the body and concentrically arranged outside the discharging member; and a driving mechanism that drives the discharge-outlet opening/closing member, the discharging member and the supplier opening/closing member to perform predetermined operations, in which the driving mechanism includes: a first motor and a second motor; a thread shaft rotated by the first motor; a first nut member and a second nut member screwed to the thread shaft; a transmitting gear rotated by the second motor to transmit a rotation of the second motor to the second nut member; a biasing unit that biases the thread shaft toward a discharge outlet side; and a drive controller adapted to control the motors separately, first end side of the thread shaft is connected to a rotating shaft of the first motor to be integrally rotatable with the rotating shaft of the first motor and slidable in an axis direction, while second end side of the thread shaft is connected to the discharge-outlet opening/closing member, the first nut member is connected to the supplier opening/closing member, the second nut member is connected to the discharging member, the supplier opening/closing member is moved in a direction to approach the discharge outlet to abut on the body to close the liquid supplier when the first nut member is moved in a direction to approach the discharge outlet in accordance with a rotation of the first motor, while the supplier opening/closing member is moved in a direction to be away from the discharge outlet to be away from the body to open the liquid supplier when the first nut member is moved in a direction to be away from the discharge outlet in accordance with a rotation of the first motor, the discharging member is moved in a direction to approach the discharge outlet to discharge the liquid from the discharge outlet when the second nut member is moved in a direction to approach the discharge outlet in accordance with a rotation of the second motor, while the discharging member suctions the liquid from the liquid supplier when the second nut member is moved in a direction to be away from the discharge outlet in accordance with a rotation of the second motor, and the discharge-outlet opening/closing member is biased toward a discharge outlet side via the biasing unit and the thread shaft to abut on and close the discharge outlet when the supplier opening/closing member is away from the body such that the liquid supplier is opened, while the discharge-outlet opening/closing member is moved away from the discharge outlet to open the discharge outlet when the first motor is further rotated after the supplier opening/closing member abuts on the body in accordance with the rotation of the first motor such that the thread shaft is moved against a biasing force of the biasing unit in a direction to be away from the discharge outlet.

According to the present invention, since the first motor and the second motor such as a servomotor and the like are used to drive the discharge-outlet opening/closing member, the discharging member and the supplier opening/closing member, the liquid discharging device can discharge the liquid at high speed as compared with an air-cylinder driven device.

Further, the motor generates greater force than an air-cylinder. Thus, even when the nozzle is made thinner and resistance is increased, the liquid discharging device can ejaculate and discharge the liquid. The liquid discharging device can finely ejaculate even water of, for example, 0.01 microliter, whereby a stable operation is realized.

In addition, since the driver such as a servomotor and a step motor can be set to have a desired displacement amount, the displacement amount (rotation amount) of the motor can be easily and accurately adjusted. Thus, a stroke amount of the discharging member can be easily adjusted with the driving pulse number and the like, and the discharge amount per one time can be automatically adjusted even during a driving operation. Accordingly, in a process to mount a plurality of electronic components on a substrate, in order to apply a different amount of an adhesive per mounting position of the electric components, the amount of the adhesive to be discharged on the substrate is required to be changed. Taking another example, in a production line where a plurality of products are conveyed in a mixed state, an amount of liquid may be required to be changed per product. Even in the above examples, the liquid discharging device can easily change the discharge amount, thereby enhancing the usability.

While the driving of the discharging member and the supplier opening/closing member is controlled by operating the two motors, the driving of the discharge-outlet opening/closing member is controlled with an arrangement in which the thread shaft of a ball screw rotated by the first motor is biased toward the discharge outlet side by the biasing unit such that the supplier opening/closing member abuts on the body, the thread shaft is further rotated in this state so as to move the second nut member toward the discharge outlet side, and the thread shaft is moved against the biasing force of the biasing unit in the direction to be away from the discharge outlet. With this arrangement, by merely controlling the driving of the two piezoelectric elements, the driving of the three members can be controlled. Accordingly, a configuration of the driving mechanism can be made rather simple and a manufacturing cost for the liquid discharging device can be reduced.

As the biasing unit, for example, a coil spring can be utilized. In this respect as well, the driving mechanism can be simply arranged at low cost.

As the first motor and the second motor, a motor that can be controlled to have a desired displacement amount with the driving pulse number and the like can be used, examples of which are a pulse motor and a step motor.

According to the aspect of the present invention, it is preferable that, in the liquid discharging device, a spline shaft is connected with a rotating shaft of the second motor, the spline shaft being coaxially rotated integrally with the rotating shaft, and the transmitting gear includes: a motor gear adapted to slide along the spline shaft and to be integrally rotated with the spline shaft; and a middle gear screwed to the motor gear and a gear provided on an outer circumference of the second nut member.

According to the present invention, the first motor and the second motor are rotated in the same direction, so that the second nut member can be rotated in the same direction as the rotating direction of the thread shaft, and the screwed position of the second nut member relative to the thread shaft can be maintained at a predetermined position. Accordingly, as compared with a device in which an additional middle gear is provided so that the above-described state is obtained when the motors are reverse-rotated, it is easy to control the movement of the nut members by controlling the rotation of the motors.

According to the aspect of the present invention, it is preferable that, in the liquid discharging device, the drive controller performs steps of: providing an initial state in which the supplier opening/closing member is arranged away from the body to open the liquid supplier, the discharging member being arranged at a stroke end position in a direction to approach a discharge outlet, the discharge-outlet opening/closing member being biased toward a discharge outlet by the biasing unit and arranged at a position where the discharge outlet is closed; suctioning the liquid into a space provided by a movement of the discharging member inside the supplier opening/closing member by driving the second motor to be rotated by a predetermined amount from the initial state to move the discharging member connected to the second nut member in a direction to be away from the discharge outlet by a predetermined distance; first-time switching a valve such that the supplier opening/closing member connected to the first nut member abuts the body to close the liquid supplier while moving the discharge-outlet opening/closing member in a direction to be away from the discharge outlet to open the discharge outlet, the supplier opening/closing member abutting on the body by driving the first motor to be rotated by a predetermined amount, the discharge-outlet opening/closing member being moved in the direction to be away from the discharge outlet by moving the thread shaft against the biasing force of the biasing unit in a direction to be away from the discharge outlet via the supplier opening/closing member abutting on the body; discharging the liquid contained in the space from the discharge outlet by driving the second motor to be driven by a predetermined amount to move the discharging member connected to the second nut member toward a discharge outlet such that the space inside the supplier opening/closing member is reduced; and second-time switching the valve such that the supplier opening/closing member connected to the first nut member is moved away from the body to open the liquid supplier while the discharging member closes the discharge outlet, the supplier opening/closing member being moved away from the body and the discharging member closing the discharge outlet by driving the first motor to be rotated by a predetermined amount.

According to the present invention, the outlet valve, which is opened and closed by the discharge-outlet opening/closing member, is tightly closed in the suctioning process, the inlet valve, which is opened and closed by the supplier opening/closing member, is tightly closed in the discharging process. Accordingly, with either of the outlet valve or the inlet valve being necessarily closed, the liquid can be prevented from refluxing into the supply path from the discharge outlet in each of the processes. Thus, only operating the members can reliably prevent the liquid from refluxing and there is no need to provide a check valve.

Since the liquid discharge quantity can be set using only the movement amount of the discharging member, the liquid discharging device can measure and discharge the liquid even in infinitesimal quantity with high accuracy.

According to the aspect of the present invention, it is preferable that, in the liquid discharging device, in the initial state, the discharge-outlet opening/closing member is pressed by the second nut member to be arranged at a position where the discharge outlet is closed, and when the discharging process is completed, the discharge-outlet opening/closing member is pressed by the second nut member to be arranged at the position where the discharge outlet is closed.

With this arrangement, since the discharging process is completed by closing the discharge outlet with the discharge-outlet opening/closing member, the liquid discharging device can spit the liquid quickly without dripping and finely ejaculate the liquid, thereby enhancing the accuracy of the discharging amount and realizing a stable discharging operation.

According to the aspect of the present invention, it is preferable that, in the liquid discharging device, the drive controller is adapted to control a driving speed of the discharge-outlet opening/closing member, the discharging member and the supplier opening/closing member by controlling a rotation speed of the motors.

By controlling the driving speed of the members, a cycle time of the discharging operation can be controlled, whereby the liquid discharging device can be driven at such a high speed as to discharge the liquid substantially in a continuous manner.

According to the aspect of the present invention, it is preferable that, in the liquid discharging device, the body includes: a driving mechanism housing portion that houses the driving mechanism; and a container detachably attached to the driving mechanism housing portion, and the discharge outlet is provided to the container.

The container included in the body can contain the liquid of certain quantity. The liquid discharging device can be operated with the liquid of, for example, daily-used quantity contained in the container. With this arrangement, a pipe for supplying the liquid to the liquid discharging device may not be provided, thereby enhancing usability of the liquid discharging device.

In addition, a container for supplying the liquid may be connected to the container via a tube, and there my be provided with a liquid-level gauge for detecting the liquid level inside the exterior container and a valve controlled in accordance with the liquid level detected by the liquid-level gauge. With this arrangement, the valve is controlled to be opened to supply the liquid into the container when the liquid level inside the container is lowered to a predetermined level, while the valve is controlled to be closed when the liquid is filled to a predetermined level. In this manner, the liquid can be constantly supplied into the container from the container via the tube. Accordingly, the liquid discharging device may be automatically operated consecutively for twenty four hours.

EXPLANATION OF CODES

Figure 1:
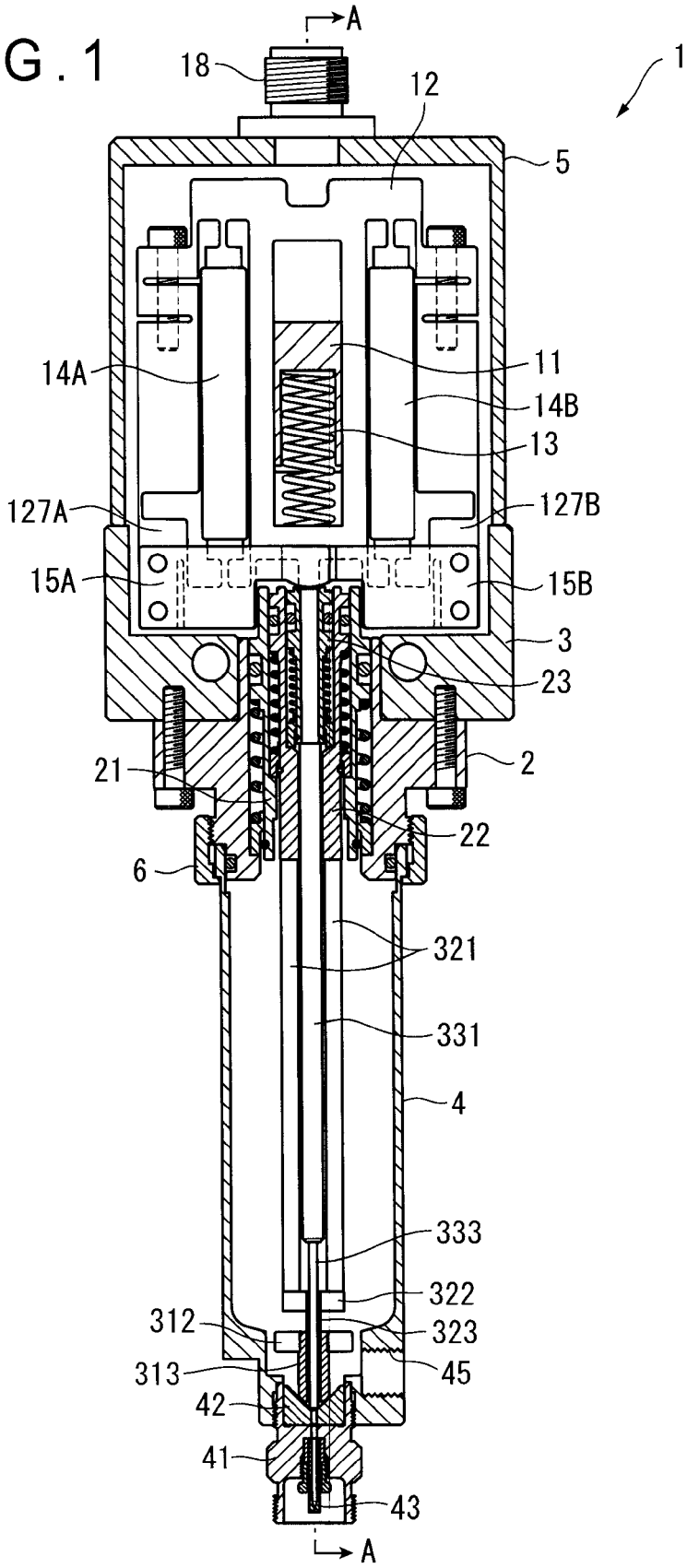
FIG. 1 is a cross-sectional view showing a liquid discharging device according to a first embodiment of the present invention.

1, 1A: liquid discharging device
2: pump holder
3: drive-unit base
4: container
11: guide member
12: piezoelectric-element support plate
13: pressing spring
14A: first piezoelectric element
14B: second piezoelectric element
15A: first driving arm member
15B: second driving arm member
21: inlet valve holder
22: measurement plunger holder
23: needle valve holder
42: valve sheet
43: nozzle

101A, 101B, 102A, 102B, 103A, 103B, 104A, 104B: strain gauge
105: bridge circuit
122A: first base end
122B: second base end
123, 125, 126, 128: hinge
124A: first drive unit
124B: second drive unit
127A: first displacement transmitter
127B: second displacement transmitter
130: guide hole
131: projection
152: driving arm
214: inlet return-spring
224: measurement return-spring
234: needle return-spring
313: inlet valve member
323: measurement plunger member
333: needle
422: discharge outlet
500: liquid discharging device
501: drive unit
510: case
515: joint
521: first motor
522: second motor
523: spline shaft
527: coil spring
529: thread shaft
530: inlet nut
531: inlet-nut receiving plate
532: inlet-nut retainer
535: sensor head
536: proximity sensor
540: measurement nut
542: measurement-nut receiving plate
543: measurement-nut retainer
544: middle gear
550: motor gear
561: needle pressing member
563: bush
564: return-spring receiving member
565: return spring
571: inlet rod
572: measurement rod
581: inlet pressing member
582: measurement pressing member
600: pump
601: container
601A: container body
610: inlet-spring receiving member
611: inlet valve return-spring
613: inlet rod
614: inlet valve member
620: measurement guide member
623: measurement plunger rod
624: measurement plunger member
630: needle rod
633: needle
640: valve sheet
641: taper hole
642: discharge outlet
643: nozzle

BEST MODE FOR CARRYING OUT THE INVENTION

First Embodiment

A first embodiment of the present invention will be described below with reference to the attached drawings.

Figure 2:
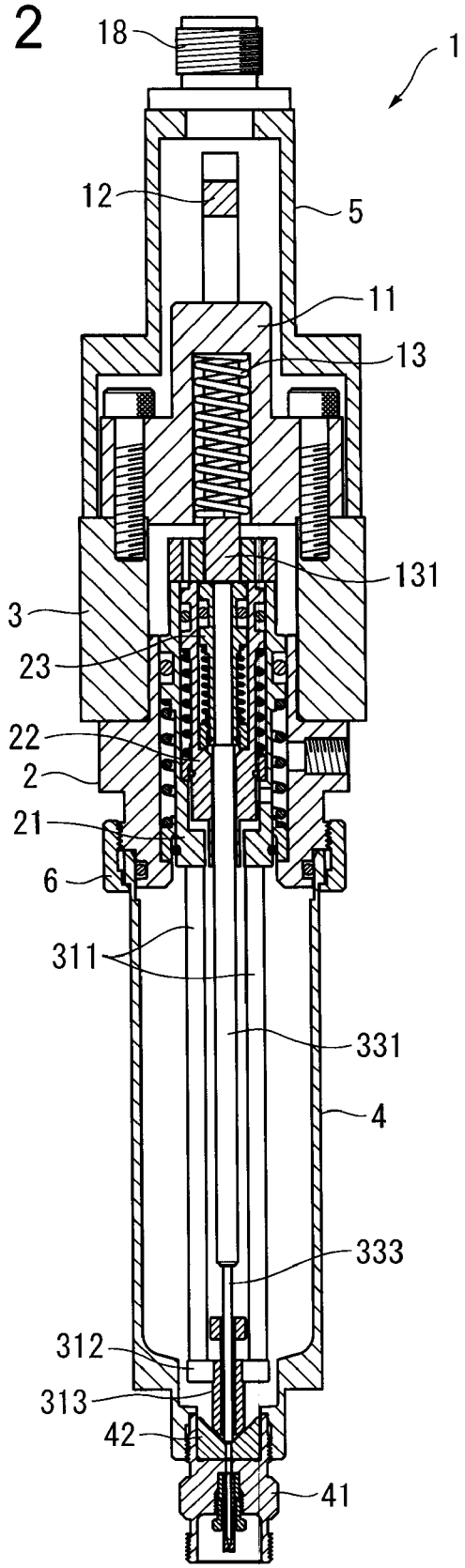
FIG. 2 is a cross-section taken along A-A line in FIG. 1.

FIGS. 1 and 2 show a liquid discharging device 1 according to the first embodiment.

The liquid discharging device 1 includes a pump holder 2, a drive-unit base 3, a container 4 and a cover 5. The pump holder 2 and the container 4 are arranged with the drive-unit base 3 interposed therebetween and are screw-attached to the drive-unit base 3. The container 4 is detachably attached to the pump holder 2 via a cap nut 6. The pump holder 2, the drive-unit base 3, the container 4 and the cover 5 form a body of the liquid discharging device 1.

[Arrangement of Driving Mechanism]

The cover 5 houses a driving mechanism of the liquid discharging device 1. The driving mechanism includes: a guide member 11 fixed to the drive-unit base 3; a piezoelectric-element support plate 12 adapted to slide relative to the guide member 11; a pressing spring 13 for biasing the piezoelectric-element support plate 12 toward the container 4 side in relation to the guide member 11; a first piezoelectric element 14A and a second piezoelectric element 14B fixed on the piezoelectric-element support plate 12; and a first driving arm member 15A and a second driving arm member 15B mounted on the piezoelectric-element support plate 12.

The cover 5 is provided with a connector 18 connected to an external control device (not shown) as a drive controller, and a driving signal output from the control device drives the piezoelectric elements 14A, 14B.

The control device applies to the first piezoelectric element 14A a voltage ranging from a first preset value for the first piezoelectric element to a second preset value for the first piezoelectric element, while the control device applies to the second piezoelectric element 14B a voltage ranging from a first preset value for the second piezoelectric element to a second preset value for the second piezoelectric element. In the present embodiment, each of the first preset values is set at "0", while the second preset values are determined in accordance with the types of the piezoelectric elements 14A, 14B or with a required displacement amount of the piezoelectric elements 14A, 14B.

Accordingly, longitudinal dimensions of the piezoelectric elements 14A, 14B are expanded to be longer when the voltage of the second preset value is applied than when the voltage of the first preset value is applied.

[Arrangement of Piezoelectric-Element Support Plate]

As shown in FIGS. 3, 4, 5A and 5B, the piezoelectric-element support plate 12 is formed of a metal material such as stainless, and manufactured by cutting one plate material by a method like wire-cutting into a predetermined shape as described below.

Figure 5A:
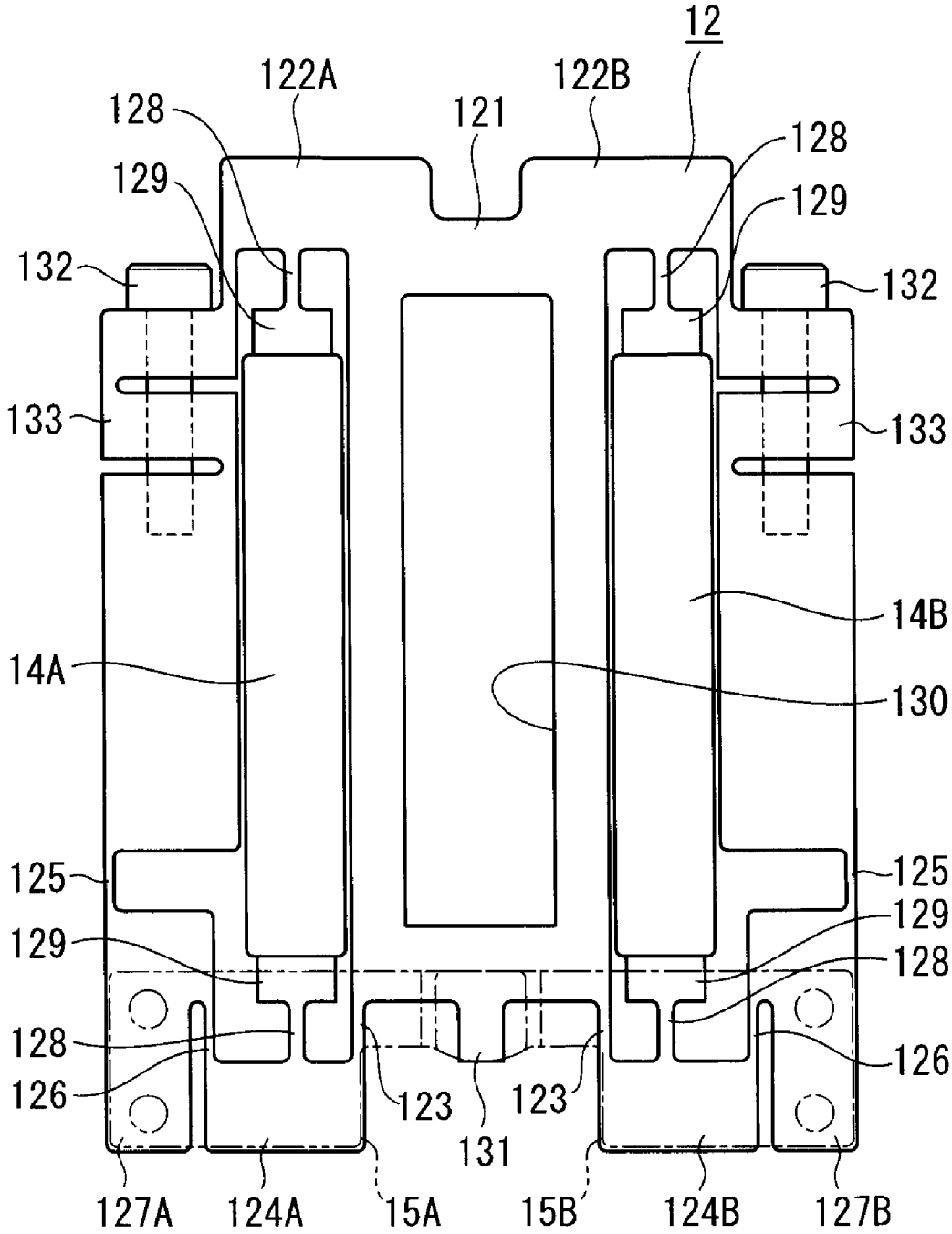
FIG. 5A is a front view showing a state where a piezoelectric element of a piezoelectric-element support plate is not expanded according to the first embodiment.

Specifically, as shown in FIG. 5A, the piezoelectric-element support plate 12 includes: a base 121 provided at a center axis of the plate; a first base end 122A and a second base end 122B formed continuously from one end side of the base 121; a first drive unit 124A and a second drive unit 124B formed continuously from the other end side of the base 121 via a first hinge 123; and a first displacement transmitter 127A and a second displacement transmitter 127B formed continuously from the base end 122A, 122B via a second hinge 125 and from the drive unit 124A, 124B via a third hinge 126.

Note that although a material to form the piezoelectric-element support plate 12 is not limited, a stainless material that is hard and less heat-expandable may be advantageous in that a temperature change effect can be alleviated.

The base ends 122A, 123B and the drive units 124A, 124B are provided with a piezoelectric-element fixing portion 129 via a fourth hinge 128, and the piezoelectric elements 14A, 14B, which connect the respective piezoelectric-element fixing portions 129, are fixed to the respective fixing portions 129. In addition, the piezoelectric elements 14A, 14B are a piezoelectric element whose thermal expansion coefficient is "0" or a negative value. A metal plate (not shown) whose thermal expansion coefficient is large is interposed and adhered between the piezoelectric-element fixing portions 129 and the piezoelectric element 14A, 14B, such that the temperature change effect can be alleviated.

The hinges 123, 125, 126, 128 are formed to have a width dimension smaller than the other parts, such that the hinges can be elastically deformed when applied with a force.

On the base 121, a rectangular guide hole 130 is formed, which extends in an axis direction of the liquid discharging device 1, i.e. of the body (in a direction connecting the container 4 and the cover 5). A projection 131 is formed on a container side of the base 121.

The base ends 122A, 122B respectively may extend from the ends of the base 121 (connector 18 side) in a right-and-left direction perpendicular to the axis direction and further extend toward the container 4 side along the piezoelectric elements 14A, 14B to be substantially L-shaped in front view, such that the base ends 122A, 122B are directly continued to the second hinge 125. In the present embodiment, however, a folded portion 133 is provided between the base end 122A, 122B and the displacement transmitter 127A, 127B.

The folded portion 133 is continuously formed from the base end 122A, 122B and from the displacement transmitter 127A, 127B via the second hinge 125.

In the folded portion 133, staggered insections are formed respectively toward a direction perpendicular to the axis direction, and the folded portion 133 is folded at the insection parts. A thread 132 is screwed into the folded portion, penetrating the folded portion. The thread 132 is fastened, such that gaps defined by the insections are narrowed. With this arrangement, a slight adjustment can be made to a longitudinal dimension of the folded portion 133 along the piezoelectric elements 14A, 14B (along the axial direction). Accordingly, by controlling a fastening amount of the thread 132, an axial position of the displacement transmitter 127A, 127B can be micro-adjusted in relation to the base end 122A, 122B.

Figure 3:
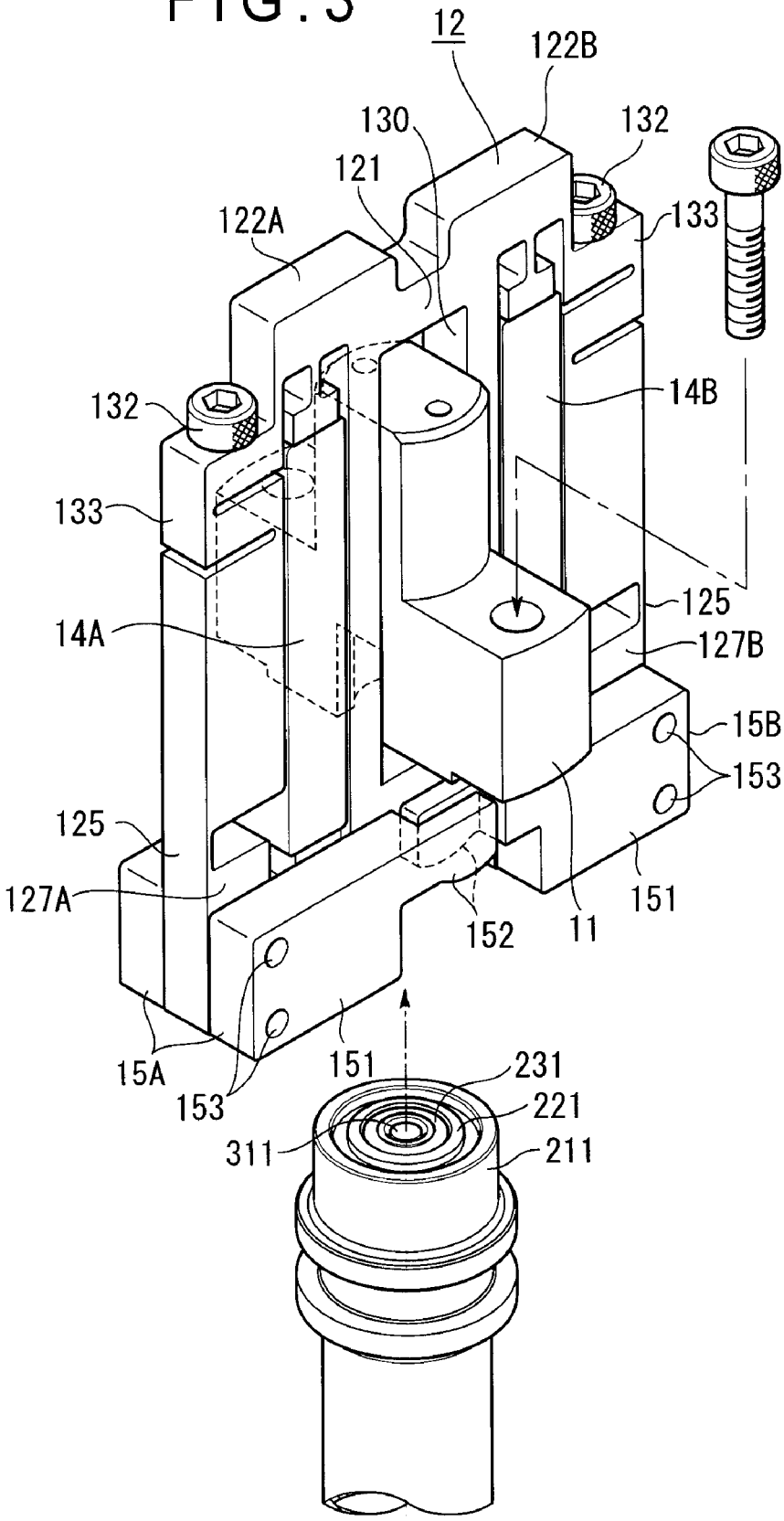
FIG. 3 is a perspective view showing a primary portion of a driving mechanism according to the first embodiment.
Figure 4:
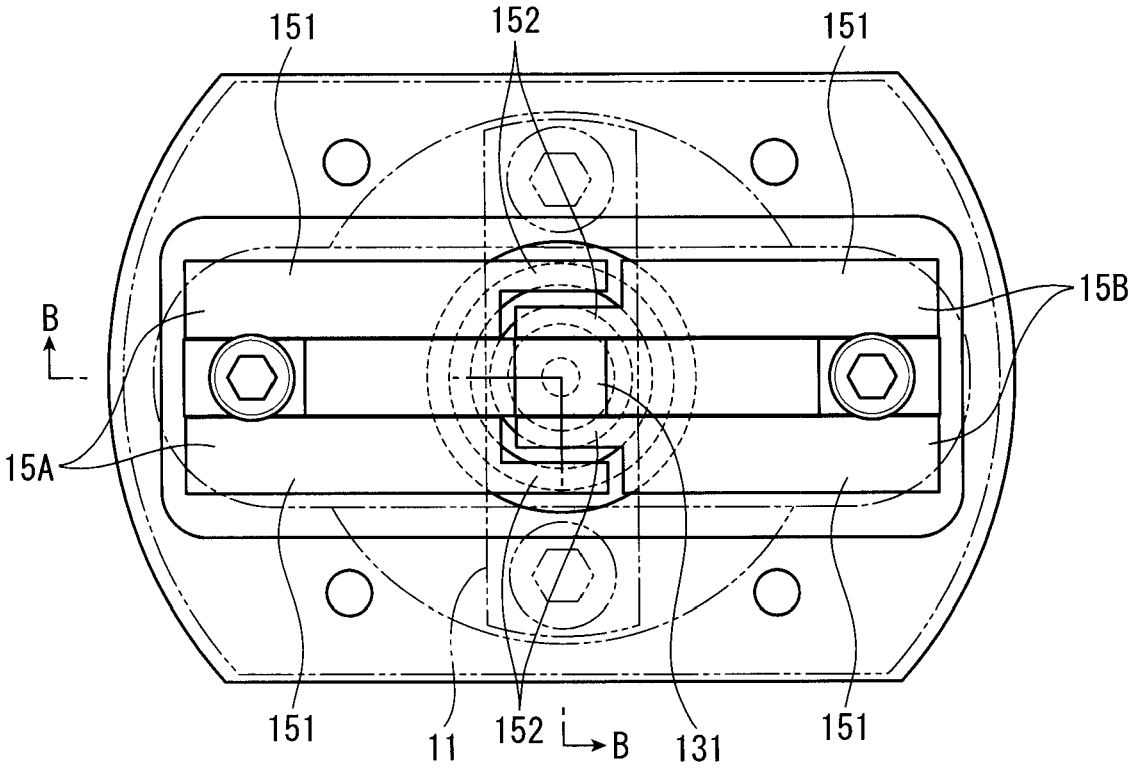
FIG. 4 is a plan view showing the driving mechanism according to the first embodiment.

As shown in FIGS. 3 and 4, the driving arm member 15A, 15B includes a fixing portion 151 and a driving arm 152 extending from the fixing portion 151. In the present embodiment, each of the driving arm members 15A, 15B is provided in pairs, and one first driving arm member 15A holds the first displacement transmitter 127A against the other first driving arm member 15A while one second driving arm member 15B holds the second displacement transmitter 127B against the other second driving arm member 15B. In this state, the driving arm member 15A, 15B is fixed to the displacement transmitter 127A, 127B. The driving arm member 15A, 15B can be appropriately fixed using, for example, an adhesive. In the present embodiment, a pin 153 penetrating the driving arm member 15A, 15B and the displacement transmitter 127A, 127B is press-fitted, such that the driving arm member 15A, 15B is fixed to the displacement transmitter 127A, 127B without rattling.

As shown in FIG. 4, in the present embodiment, the driving arm 152 of the second driving arm member 15B is arrayed such that the projection 131 is interposed between the pair of driving arms 152, while the driving arm 152 of the first driving arm member 15A is arrayed such the pair of driving arms 152 of the second driving arm member 15B are interposed between the pair of driving arms 152 of the first driving arm member 15A.

While arrayed inside the guide hole 130, the guide member 11 is screw-fixed to the drive-unit base 3. A pressing spring 13 formed of a coil spring is arranged inside the guide member 11. An end of the pressing spring 13 abuts on an end surface on the container 4 side of the guide hole 130. Accordingly, the piezoelectric-element support plate 12 is constantly biased by the pressing spring 13 toward the container 4 side in relation to the guide member 11.

In the driving mechanism arranged in the above-described manner, when the voltage of the first preset value is applied to the piezoelectric element 14A, 14B, i.e., when no driving signal is input (because in the present embodiment, the first preset value is set at "0"), the hinges 123, 125, 126, 128 are not deformed as shown in FIG. 5A. In this state, the container 4 side surface of the projection 131 and the container 4 side surface of the driving arm 152 of the driving arm member 15A, 15B are arranged at the same height, i.e., arranged on the same plane.

Figure 5B:
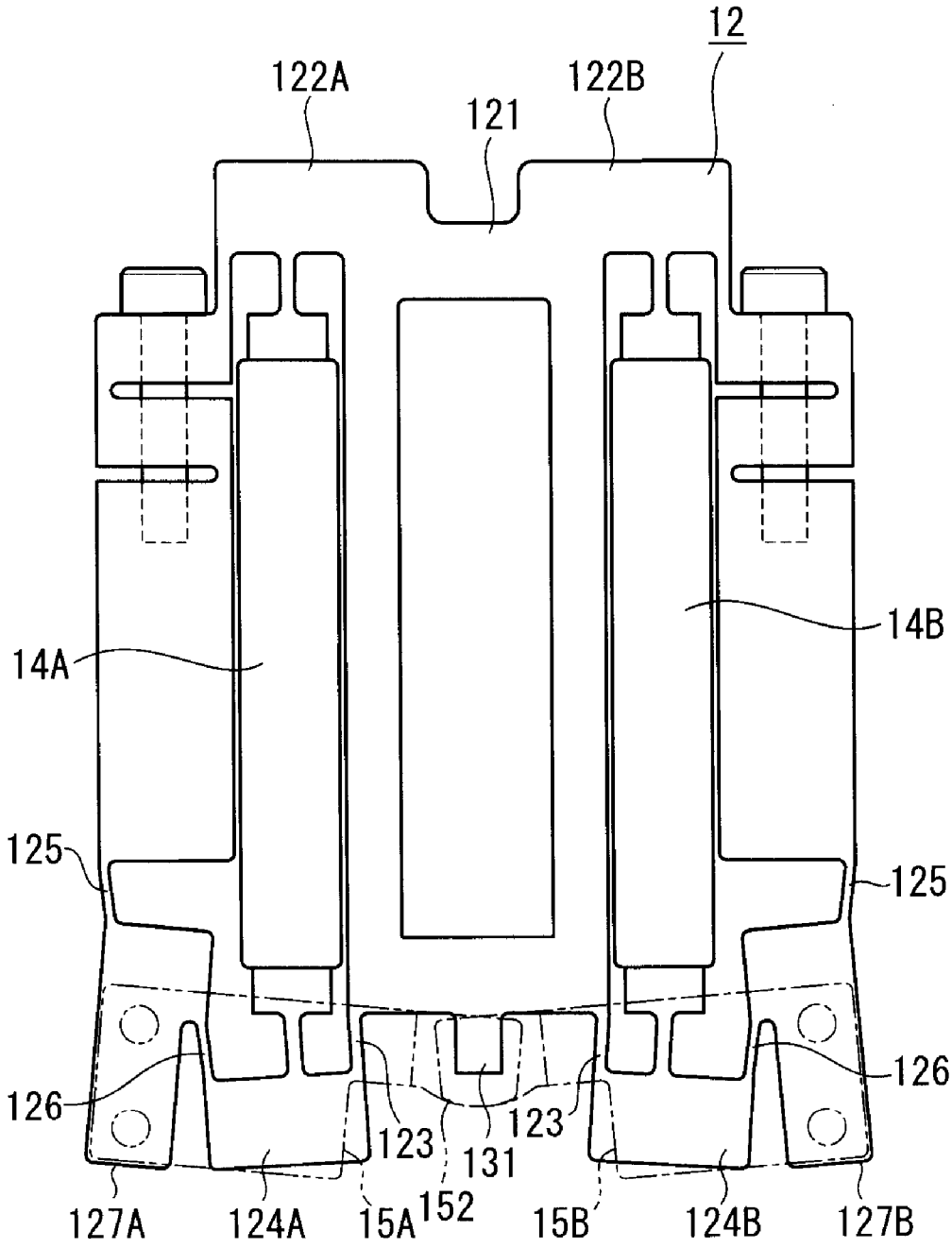
FIG. 5B is a front view showing a state where the piezoelectric element of the piezoelectric-element support plate is expanded according to the first embodiment.

On the other hand, when the voltage of the second preset value is applied to the piezoelectric elements 14A, 14B, the longitudinal dimension of the piezoelectric element 14A, 15B is expanded as shown in FIG. 5B. At that time, the base end 122A, 123B, which is integrated with the base 121, is hardly moved. On the other hand, the drive unit 124A, 124B, which is connected to the base 121 via the hinge 123, is moved toward the container 4 side when the hinge 123 is deformed due to the expansion of the longitudinal dimension of the piezoelectric element 14A, 14B.

The displacement transmitter 127A, 127B connected with the drive unit 124A, 124B via the third hinge 126 is also moved in conjunction with the movement of the drive unit 124A, 124B. Since the third hinge 126 is provided to the displacement transmitter 127A, 127B at a position in vicinity to the piezoelectric element 14A, 14B (inner side of the piezoelectric-element support plate 12) and the second hinge 125 is provided at a position exterior to the third hinge 126 (a position away from the piezoelectric element 14A, 14B), when the third hinge 126 is pulled toward the container 4 side due to the movement of the drive unit 124A, 124B, the displacement transmitter 127A, 127B is inclined such that the container side end faces outward.

The driving arm member 15A, 15B is also inclined in conjunction with the inclination of the displacement transmitter 127A, 127B, and an tip end of the driving arm 152 is moved toward the container side. Since the expansion of the piezoelectric element 14A, 14B is converted into the inclination of the driving arm member 15A, 15B, the movement amount of the tip end of the driving arm 152 can be enlarged up to several to several ten times (in the present embodiment, approximately ten times) of the expansion amount of the piezoelectric element 14A. Accordingly, in the present embodiment, a first displacement expanding portion is formed by the first displacement transmitter 127A and the first driving arm member 15A while a second displacement expanding portion is formed by the second displacement transmitter 127B and the second driving arm member 15B. In addition, the piezoelectric-element support plate 12 and the driving arm members 15A, 15B form a piezoelectric-element support member.

[Arrangement of Pump Mechanism]

Meanwhile, the pump holder 2 is provided with the pump mechanism driven by the driving mechanism. As shown FIG. 6A, a through hole is formed corresponding to a center axis of the pump holder 2, and a substantially cylindrical inlet valve holder 21 is arrayed inside the through hole. Inside the inlet valve holder 21, a substantially cylindrical measurement plunger holder 22 is arrayed, in which a substantially cylindrical needle valve holder 23 is arrayed. In short, in the pump holder 2, the needle valve holder 23, the measurement plunger holder 22 and inlet valve holder 21 are concentrically arranged in triplicate in this order from the center axis.

The inlet valve holder 21 includes: a large-diameter part 211 slidably contacting an inner surface of the through hole of the pump holder 2; and a small-diameter part 212 whose diameter is smaller than that of the large-diameter part 211. A concave portion is formed on a circumference of the large-diameter part 211, in which a seal member such as an O-ring is interposed, thereby preventing the liquid from leaking into the driving mechanism side from between the pump holder 2 and the inlet valve holder 21.

The small-diameter part 212 is guided movably in the axis direction by an inlet valve guide 213 provided inside the pump holder 2. An inlet return-spring 214 formed of a coil spring is provided between the inlet valve guide 213 and the large-diameter part 211, which biases the inlet valve holder 21 toward the driving mechanism side (the piezoelectric-element support plate 12 side) to abut on the driving arm 152 of the driving arm member 15A.

Further, a C-ring shaped inlet valve stopper 215 is mounted on the small-diameter part 212 of the inlet valve holder 21.

The measurement plunger holder 22 and the needle valve holder 23 are arranged in a similar manner with the inlet valve holder 21.

Specifically, the measurement plunger holder 22 includes: a large-diameter part 221 slidably contacting the inner surface of the through hole of the inlet valve holder 21; and a small-diameter part 222 whose diameter is smaller than that of the large-diameter part 221. A concave portion is formed on a circumference of the large-diameter part 221, in which a seal member such as an o-ring is interposed, thereby preventing the liquid from leaking into the driving mechanism side from between the inlet valve holder 21 and the measurement plunger holder 22.

The small-diameter part 222 is guided movably in the axis direction by a measurement plunger guide 223 provided inside the inlet valve holder 21. A measurement return-spring 224 formed of a coil spring is provided between the measurement plunger guide 223 and the large-diameter part 221, which biases the measurement plunger holder 22 toward the piezoelectric-element support plate 12 side to abut on the driving arm 152 of the driving arm member 15B.

Further, a C-ring shaped measurement plunger stopper 225 is mounted on the small-diameter part 222 of the measurement plunger holder 22.

The needle valve holder 23 includes: a large-diameter part 231 slidably contacting an inner surface of the through hole of the measurement plunger holder 22; and a small-diameter part 232 whose diameter is smaller than that of the large-diameter part 231. A concave portion is formed on an outer circumference of the large-diameter part 231, on which a seal member such as an o-ring is positioned, thereby preventing the liquid from leaking into the driving mechanism side from between the measurement plunger holder 22 and the needle valve holder 23.

Figure 6A:
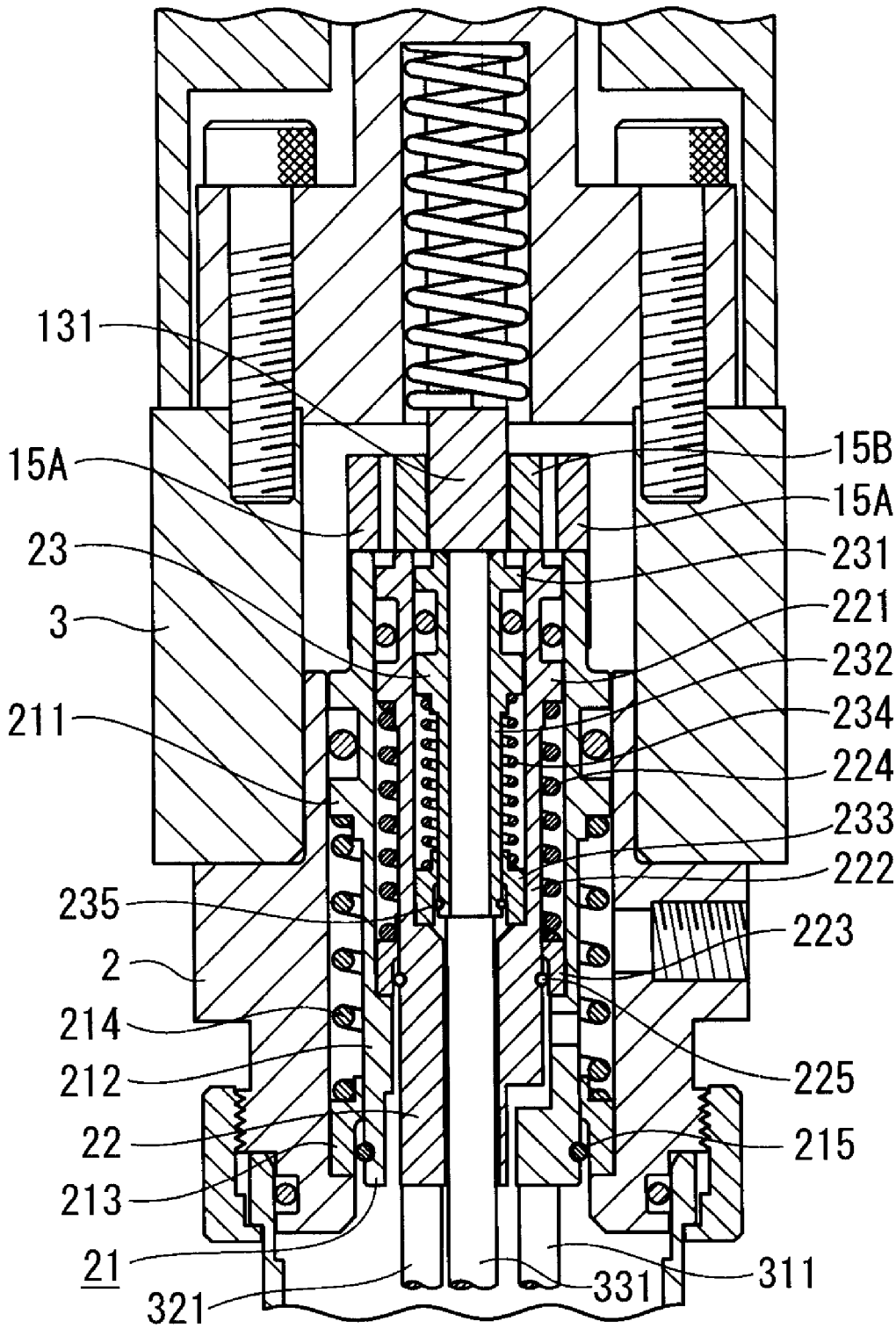
FIG. 6A is a cross-sectional view showing the driving mechanism in an original point state according to the first embodiment.

The small-diameter part 232 is guided movably in the axis direction by a needle valve guide 233 provided inside the measurement plunger holder 22. A needle return-spring 234 formed of a coil spring is provided between the needle valve guide 233 and the large-diameter part 231, which biases the needle valve holder 23 toward the piezoelectric-element support plate 12 side to abut on the projection 131 of the piezoelectric-element support plate 12. As shown in FIG. 6A, a step is provided on an end of the piezoelectric-element support plate 12 side of the needle valve holder 23. When moved toward a discharge outlet 422 side to a certain degree, the driving arm 152 of the second driving arm member 15B abuts on the measurement plunger holder 22 and the needle valve holder 23, such that a measurement plunger member 323 and a needle 333 can be simultaneously moved.

Further, a C-ring shaped needle valve stopper 235 is mounted on the small-diameter part 232 of the needle valve holder 23.

When the pump holder 2 is detached from the drive-unit base 3, the stopper 215, 225, 235 confines the return spring 214, 224, 234 to between the large-diameter part 211, 221, 231 and the guide 213, 223, 233 so as to prevent the return spring 214, 224, 234 from being extended more than a predetermined dimension. If the liquid discharging device 1 is assembled without the stopper 215, 225, 235, the return spring 214, 224, 234 is extended up to the extension limit, which makes it cumbersome to cram the return spring 214, 224, 234 using the holder 21, 22, 23. The arrangement impairs the assemblability. In the present embodiment, since the stopper 215, 225, 235 restricts the extension amount of the return spring 214, 224, 234, the liquid discharging device 1 can be easily assembled, which is advantageous in reassembling the device that has been disassembled for washing.

Figure 7A:
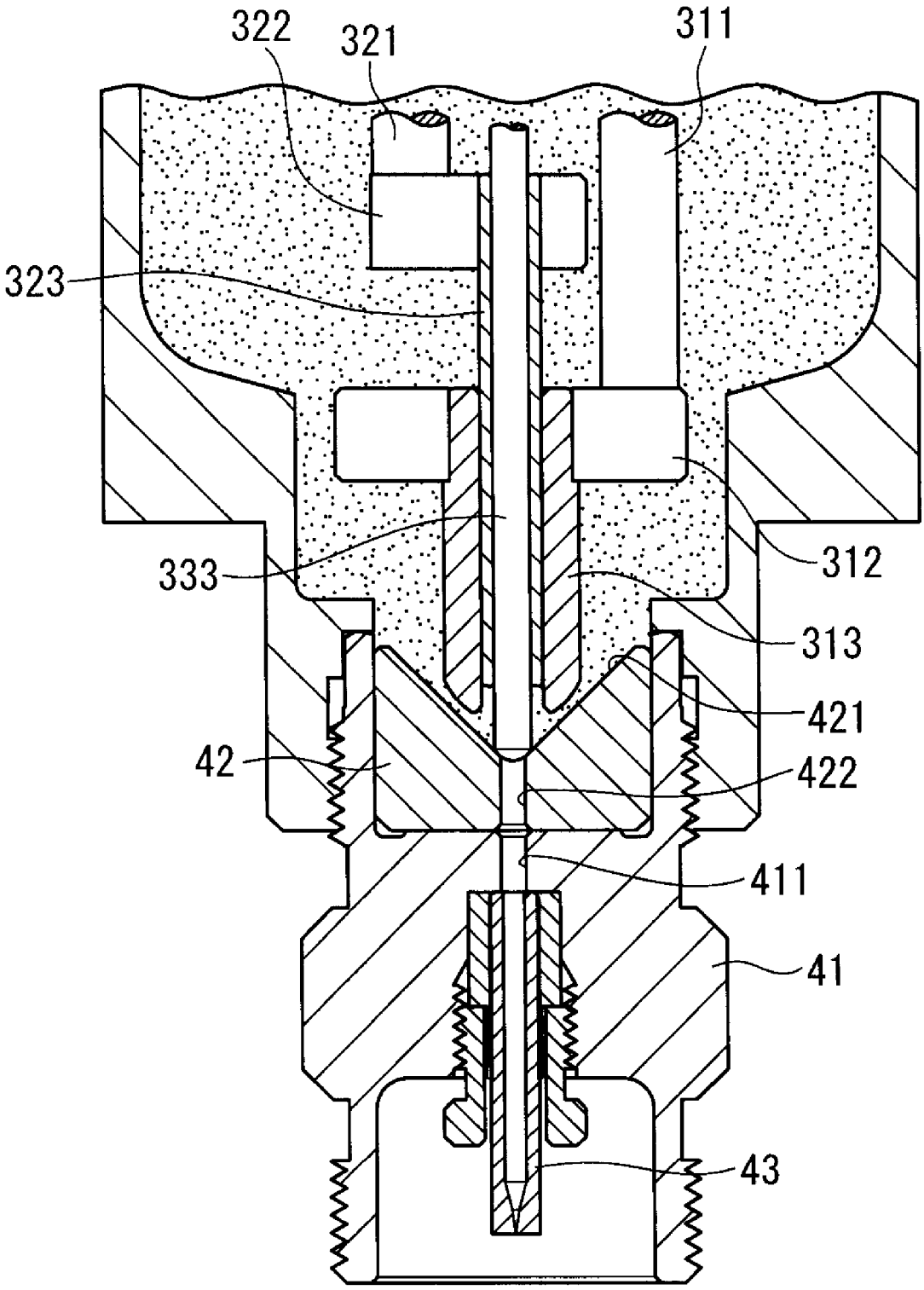
FIG. 7A is a cross-sectional view showing a pump mechanism in the original point state according to the first embodiment.

As shown in FIG. 2, a pair of inlet valve rods 311 are each attached to the inlet valve holder 21 at one end. As also shown in FIG. 7A, an inlet valve base 312 is fixed on the inlet valve rod 311, the inlet valve base 312 connecting the other ends of the inlet valve rod 311. The inlet valve base 312 is disc-shaped, at the center of which a through hole is formed to be attached with an inlet valve member 313.

The inlet valve member 313 is substantially cylindrical, one end of which is press-fitted to the inlet valve base 312 for fixture. The other end of the inlet valve member 313 is formed in a tapered shape so as to closely fit to a tapered inner surface of the below-described container 4.

As shown in FIG. 1, a pair of measurement plunger rods 321 are each attached to the measurement plunger holder 22 at one end. The measurement plunger rod 321 is arranged such that an arrangement orientation of the measurement plunger rods 321 is perpendicular to that of the inlet valve rods 311 in an axis-perpendicular direction of the liquid discharging device 1, whereby the rods 311, 321 avoid interfering with each other.

A measurement plunger base 322 is fixed on the measurement plunger rod 321, the measurement plunger base 322 connecting the other ends of the measurement plunger rod 321. The measurement plunger base 322 is rectangular-plate shaped so as not to interfere with the inlet valve rod 311, at the center of which a through hole is formed to be attached with the measurement plunger member 323.

The measurement plunger member 323 is substantially cylindrical, one end of which is press-fitted to the measurement plunger base 322 for fixture. The other end side of the measurement plunger member 323 is inserted into the through hole of the inlet valve member 313.

One end of a needle valve base 331 of a rod shape is press-fitted to the needle valve holder 23. One end of the needle 333 of a rod shape is fixed to the other end of the needle valve base 331.

The other end of the needle 333 is inserted into the through hole of the measurement plunger member 323. An end surface of the needle 333 is formed to be spherical, and the needle 331 is adapted to open/close the discharge outlet 422 provided to the below-described container 4.

The container 4 is attached to the pump holder 2 via the cap nut 6 at one end side while the container 4 is attached with a valve-sheet base 41 at the other end side. A valve sheet 42 is fixed on the container 4 inner surface side of the valve-sheet base 41. On one end surface side of the valve sheet 42 facing the inner surface of the container 4, a taper hole portion 421 is formed with a diameter gradually reduced. The discharge outlet 422 is provided between the taper hole portion 421 and the other end surface of the valve sheet 42, penetrating the taper hole portion 421 and the other end surface of the valve sheet 42.

A through hole 411 communicating with the discharge outlet 422 is formed in the valve-sheet base 41. The through hole 411 communicates with a nozzle 43 fixed on the valve-sheet base 41. The liquid inside the container 4 passes through the discharge outlet 422 of the valve sheet 42, through hole 411 of the valve-sheet base 41 and the nozzle 43 so as to be discharged to the outside of the liquid discharging device 1.

Although the liquid may be supplied into the container 4 after detaching the container 4 from the pump holder 2, as shown in FIG. 1, a port 45 communicating with the inside of the container 4 is provided in the present embodiment such that the liquid can be supplied without detaching the container 4. In short, the port 45 is connected with an exterior container (not shown) via a tube (not shown). The exterior container is provided with a liquid-level gauge (not shown) for detecting the liquid level inside the exterior container. The liquid is supplied into the exterior container from a tank by a valve that is controlled in accordance with the liquid level detected by the liquid-level detector.

With this arrangement, the valve is controlled to be opened to supply the liquid into the exterior container when the liquid level inside the exterior container is lowered to a predetermined level, while the valve is controlled to be closed when the liquid is filled to a predetermined level. In this manner, the liquid can be constantly supplied into the container 4 from the exterior container via the tube. Accordingly, the liquid discharging device 1 may be automatically operated consecutively for twenty four hours.

The needle 333 abuts on an opening of the discharge outlet 422 and is adapted to open and close the discharge outlet 422, thereby providing a discharge-outlet opening/closing member. The inlet valve member 313 abuts on the taper hole portion 421 and is adapted to open and close a liquid supplier communicating with the container inside and the discharge outlet 422, thereby providing a supplier opening/closing member.

As will be described below, when the inlet valve member 313 abuts on the taper hole portion 421 to close the supplier and the measurement plunger member 323 is moved toward the discharge outlet 422 side while the outlet 422 is opened, the liquid pooled inside the inlet valve member 313 is discharged from the discharge outlet 422. In this manner, the measurement plunger member 323 provides a discharging member.

Each of the inlet valve holder 21 and the pump holder 2 is provided with a drain port that can discharge to the outside of the liquid discharging device 1 the liquid infiltrated between the inlet valve holder 21 and the measurement plunger holder 22 and between the inlet valve holder 21 and the pump holder 2.

[Explanation of Discharging Operation]

Next, a liquid discharging operation in the liquid discharging device 1 according to the present invention will be explained also with reference to FIGS. 6A to 11B explaining the operation. Note that FIGS. 6A to 11B each is a cross-section taken along B-B line in FIG. 4, and illustrates both the inlet valve rod 311 and the measurement plunger rod 321.

[Original Point State]

Before the start of the operations, i.e., in a non-driven state where the liquid discharging device 1 is stopped (state of original point), the control device applies the voltage of the first preset value for the first piezoelectric element and the first preset value for the second piezoelectric element to the piezoelectric elements 14A, 14B. In the present embodiment, since each of the first preset value is set at "0", the liquid discharging device 1 is controlled such that no voltage is applied to the piezoelectric element 14A, 14B in the original point state.

As shown in FIGS. 5A and 6A, the longitudinal length dimension of the piezoelectric element 14A, 14B is shortest in this state (i.e., an initial state). Since the displacement transmitter 127A, 127B is not displaced, the discharge-outlet-422 side surface of the driving arm member 15A, 15B is flush with the discharge-outlet-422 side surface of the projection 131 of the piezoelectric-element support plate 12.

Although being biased in a direction away from the discharge outlet 422 by biasing force of the return springs 214, 224, 234, the piezoelectric-element support plate 12 and the driving arm member 15A, 15B are biased toward the discharge outlet 422 side by the pressing spring 13 that applies biasing force larger than the largest biasing force that one of the return springs 214, 224, 234 applies. With this arrangement, the needle valve holder 23, the needle valve base 331 and the needle 333 are biased toward the discharge outlet 422 side.

As shown in FIG. 7A, in the original point state, length dimensions of the needle valve base 331 and the needle 333 are set such that the needle 333 abuts on the opening of the discharge outlet 422 to close the discharge outlet 422. On the other hand, dimensions of the inlet valve rod 311 and the inlet valve member 313 are set such that a tip end of the inlet valve member 313 is away for a predetermined distance from the taper hole portion 421 of the valve sheet 42. On the other hand, dimensions of measurement plunger rod 321 and the measurement plunger member 323 are set such that a tip end of the measurement plunger member 323 is away for a predetermined distance from the taper hole portion 421 of the valve sheet 42.

[Measuring Process]

Next, while continuing to apply to the first piezoelectric element 14A the voltage of the first preset value for the first piezoelectric element, the control device applies to the second piezoelectric element 14B voltage of a third preset value for the second piezoelectric element. The third preset value is set within a range of the first preset value for the second piezoelectric element and more to less than the second preset value for the second piezoelectric element, and the third preset value is controlled in accordance with the liquid quantity to be discharged as described below.

Figure 6B:
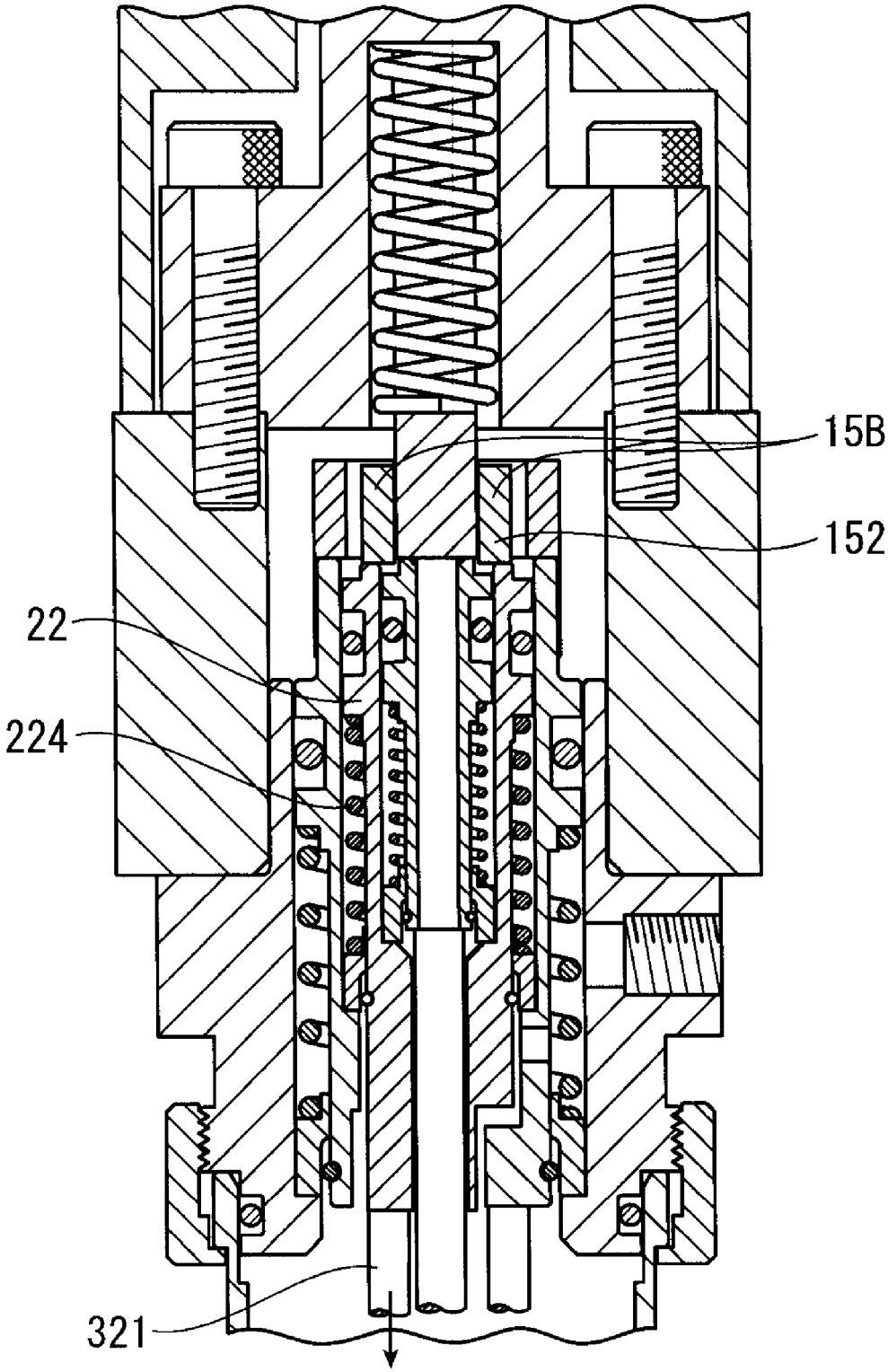
FIG. 6B is a cross-sectional view showing the driving mechanism when a measuring process is completed according to the first embodiment.

When the second piezoelectric element 14B is applied with the voltage of the third preset value for the second piezoelectric element, the second piezoelectric element 14B is expanded by a dimension in accordance with the applied voltage. Subsequently, the second drive unit 124B, the second displacement transmitter 127B and the second driving arm member 15B are inclined, such that a tip end side of the driving arm 152 is moved toward the discharge outlet 422 side as shown in FIG. 6B.

Figure 7B:
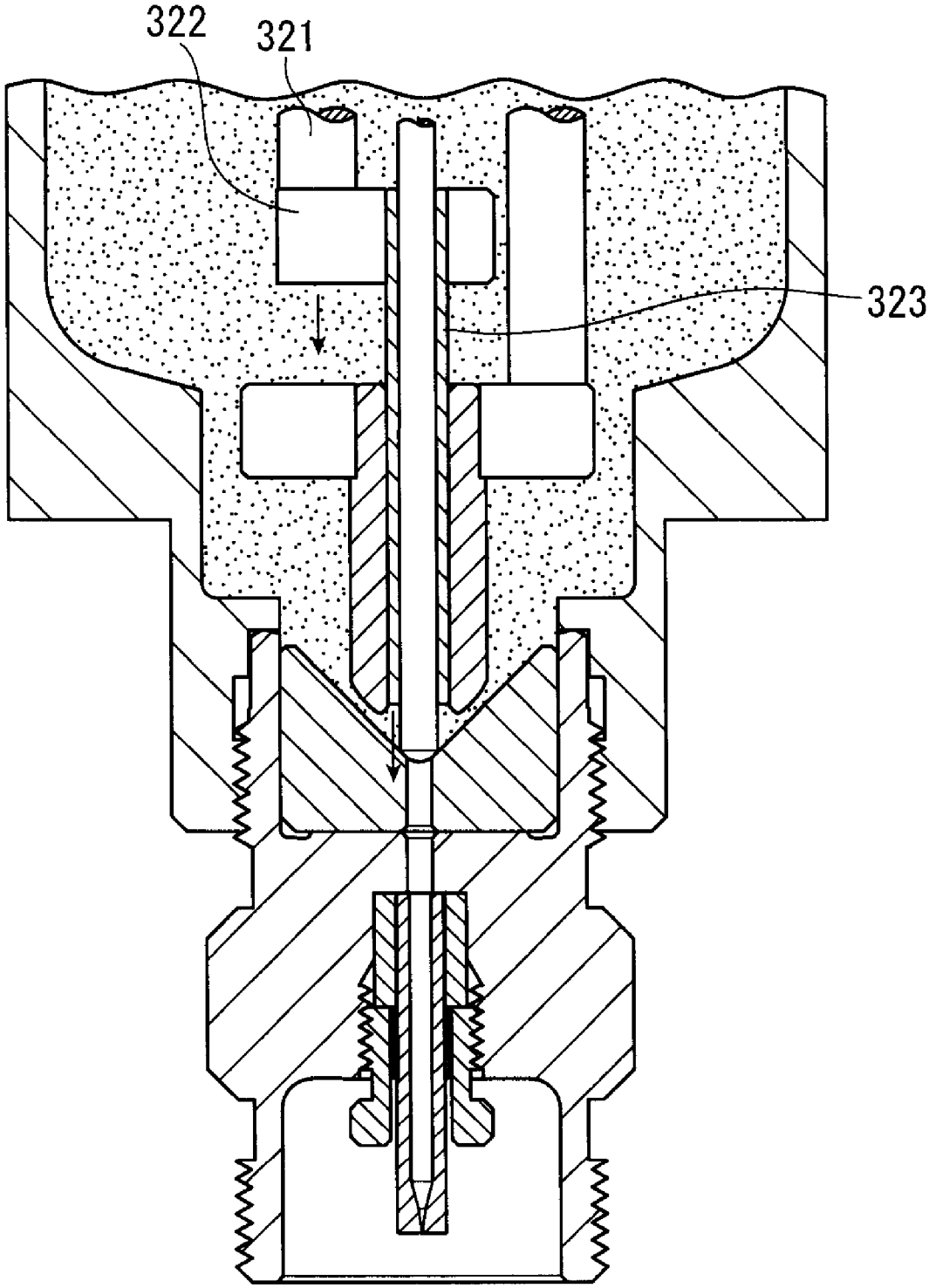
FIG. 7B is a cross-sectional view showing the pump mechanism when the measuring process is completed according to the first embodiment.

Following the movement of the driving arm 152, the measurement plunger holder 22 is moved against the biasing force of the measurement return-spring 224 toward the discharge outlet 422 side. Consequently, as shown in FIG. 7B, the measurement plunger rod 321, the measurement plunger base 322 and the measurement plunger member 323 are also moved toward the discharge outlet 422 side, such that the tip end of the measurement plunger member 323 is moved to an adjusting position in accordance with the applied voltage.

In the present embodiment, the discharge quantity is set by a movement amount of the measurement plunger member 323 as described below, and the movement amount is determined by a movement amount from the adjusting position shown in FIG. 7B to a movement position when the voltage of the second preset value for the second piezoelectric element is applied. In short, in the present embodiment, while a movement-completed position of the measurement plunger member 323 when the discharging process is completed is fixed, a movement-start position of the measurement plunger member 323 is adjusted by adjusting the applied voltage, whereby the movement amount of the measurement plunger member 323 during the discharging process (i.e., the discharging quantity) is adjusted.

Accordingly, the discharging quantity is freely adjustable by merely adjusting the voltage value applied to the second piezoelectric element 14B (the third preset value for the second piezoelectric element), and the discharging liquid quantity is measured.

[Valve-Switching Process]

Figure 8A:
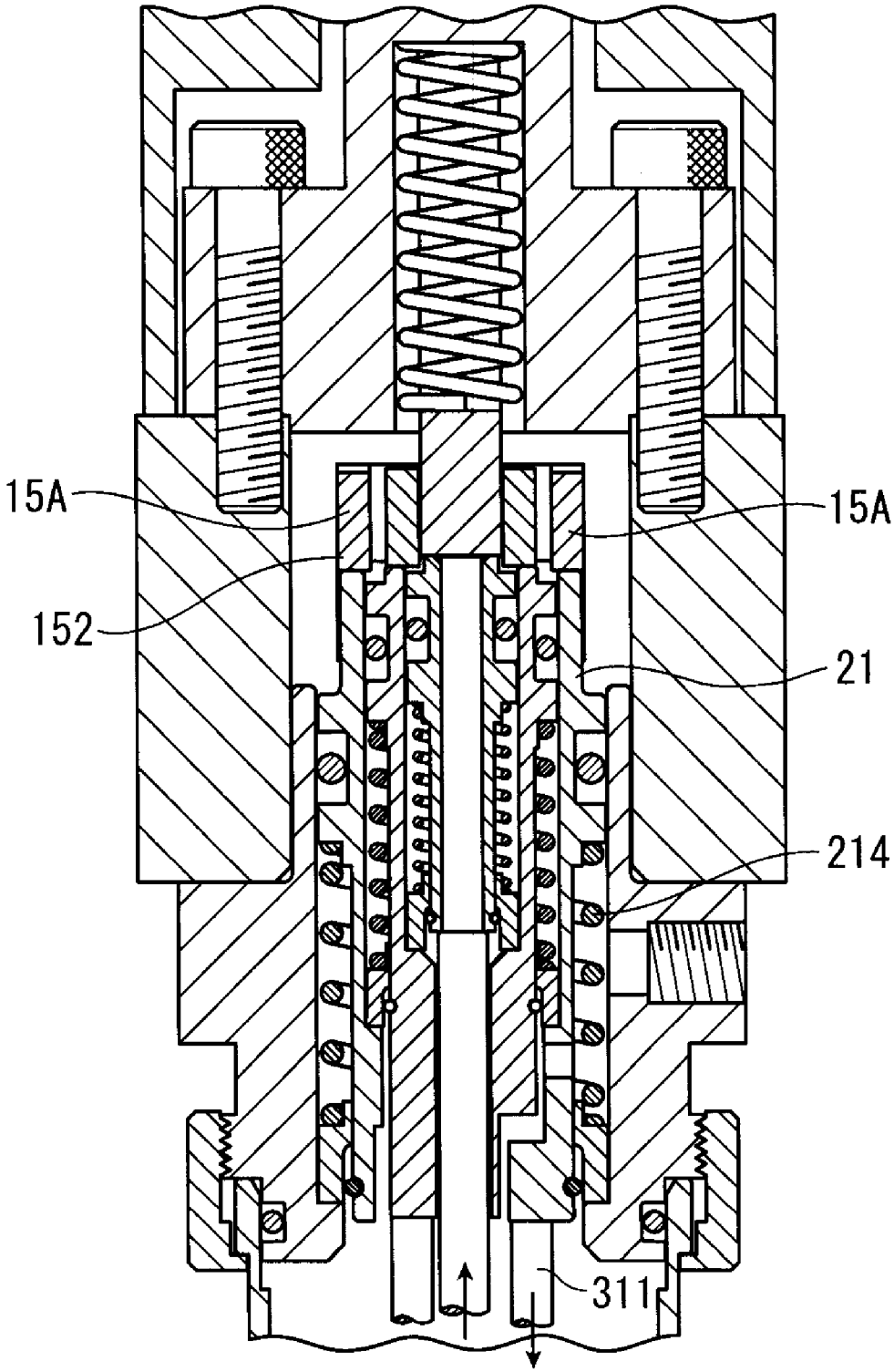
FIG. 8A is a cross-sectional view showing the driving mechanism when a valve-switching process is completed according to the first embodiment.

Next, while continuing to apply to the second piezoelectric element 14B the voltage of the third preset value for the second piezoelectric element, the control device applies to the first piezoelectric element 14A the voltage of the second preset value for the first piezoelectric element. Consequently, the first piezoelectric element 14A is expanded by a dimension in accordance with the applied voltage. Subsequently, the first drive unit 124A, the first displacement transmitter 127A and the first driving arm member 15A are inclined, such that a tip end side of the driving arm 152 is moved toward the discharge outlet 422 side as shown in FIG. 8A.

Figure 9A:
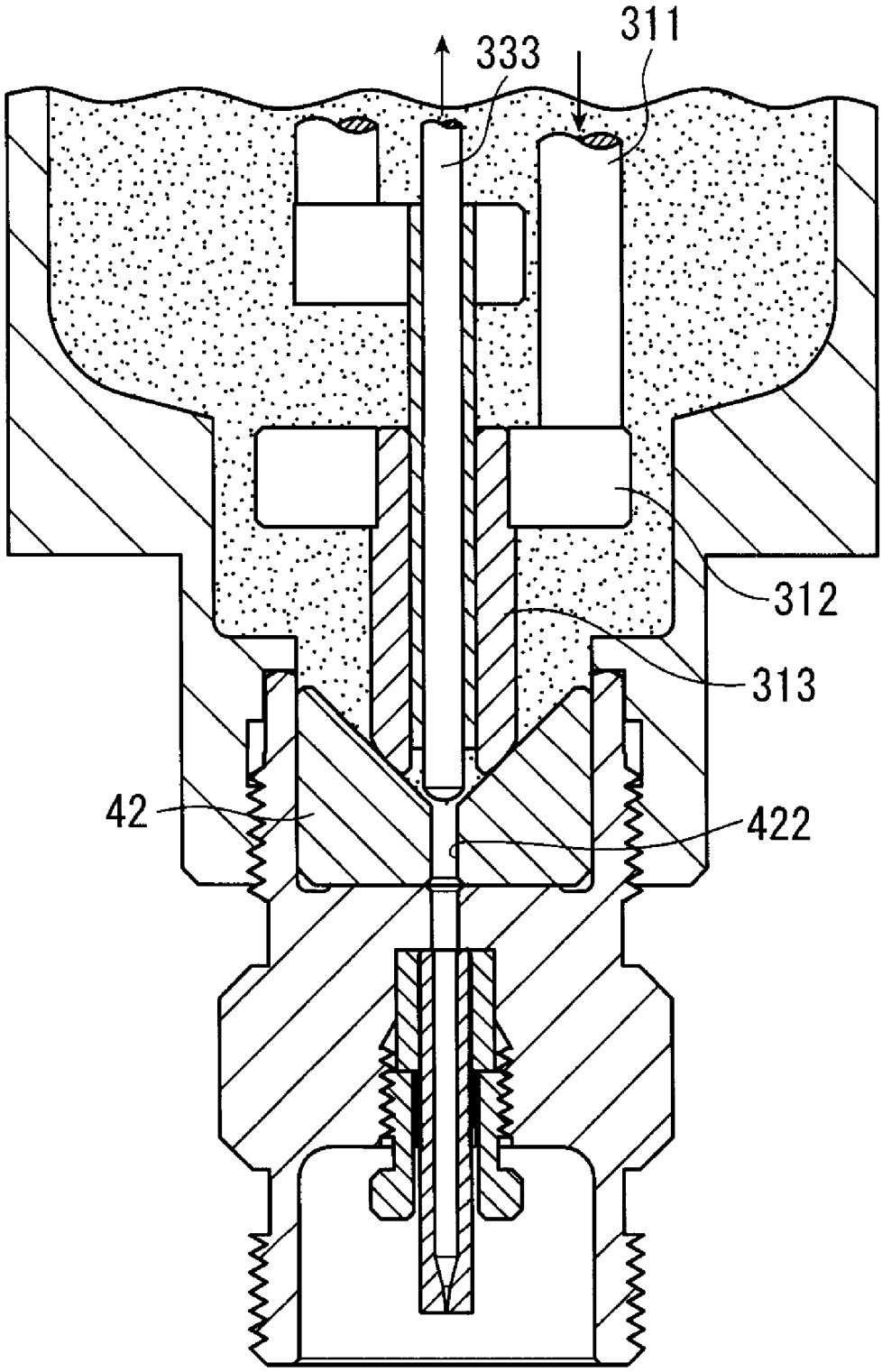
FIG. 9A is a cross-sectional view showing the pump mechanism when the valve-switching process is completed according to the first embodiment.

Accordingly, the inlet valve holder 21 is moved against the biasing force of the inlet return-spring 214 toward the discharge outlet 422 side, such that the inlet valve rod 311, the inlet valve base 312 and the inlet valve member 313 are moved toward the discharge outlet 422 side as shown in FIG. 9A.

A gap between the inlet valve member 313 before the movement and the valve sheet 42 is set smaller than the movement amount of the tip end of the driving arm 152 of the first driving arm member 15A when the voltage of the second preset value is applied (i.e., the movement amount of the inlet valve member 313). With this arrangement, when the first piezoelectric element 14A is applied with the voltage of the second preset value for the first piezoelectric element, such that the inlet valve member 313 is moved, the inlet valve member 313 firstly abuts on the valve sheet 42 to close the liquid supplier (inlet valve).

When the first piezoelectric element 14A is expanded even after the inlet valve member 313 abuts on the valve sheet 42, the inlet valve member 313, the inlet valve rod 311 and the inlet valve holder 21 is not movable any further toward the discharge outlet 422. Accordingly, a reaction force thereby produced moves the first driving arm member 15A and the piezoelectric-element support plate 12 against the biasing force of the spring 13 in a direction away from the discharge outlet 422.

The piezoelectric-element support plate 12 is moved in a direction away from the discharge outlet 422, such that the needle return-spring 234 moves the needle valve holder 23, the needle valve base 331 and the needle 333 in the direction away from the discharge outlet 422. Consequently, the outlet valve is opened and the discharge outlet 422 is opened.

Accordingly, the open inlet valve is closed and the closed outlet valve is opened, whereby the valve-switching process is performed.

The valve-switching is mechanically performed such that the first piezoelectric element 14A is further expanded after the inlet valve member 313 abuts on the valve sheet 42 to move the piezoelectric-element support plate 12. In this arrangement, either of the valves is necessarily closed, thereby preventing the inside of the container 4 and the discharge outlet 422 from directly communicating with each other.

[Discharging Process]

Next, while continuing to apply to the first piezoelectric element 14A the voltage of the second preset value for the first piezoelectric element, the control device applies to the second piezoelectric element 14B the voltage of the second preset value for the second piezoelectric element. Subsequently, the second piezoelectric element 14B is expanded in accordance with the applied voltage. In accordance with the expansion, the second drive unit 124B, the second displacement transmitter 127B and the second driving arm member 15B are inclined, such that the tip end side of the driving arm 152 is moved toward the discharge outlet 422 side as shown in FIG. 8B.

Figure 9B:
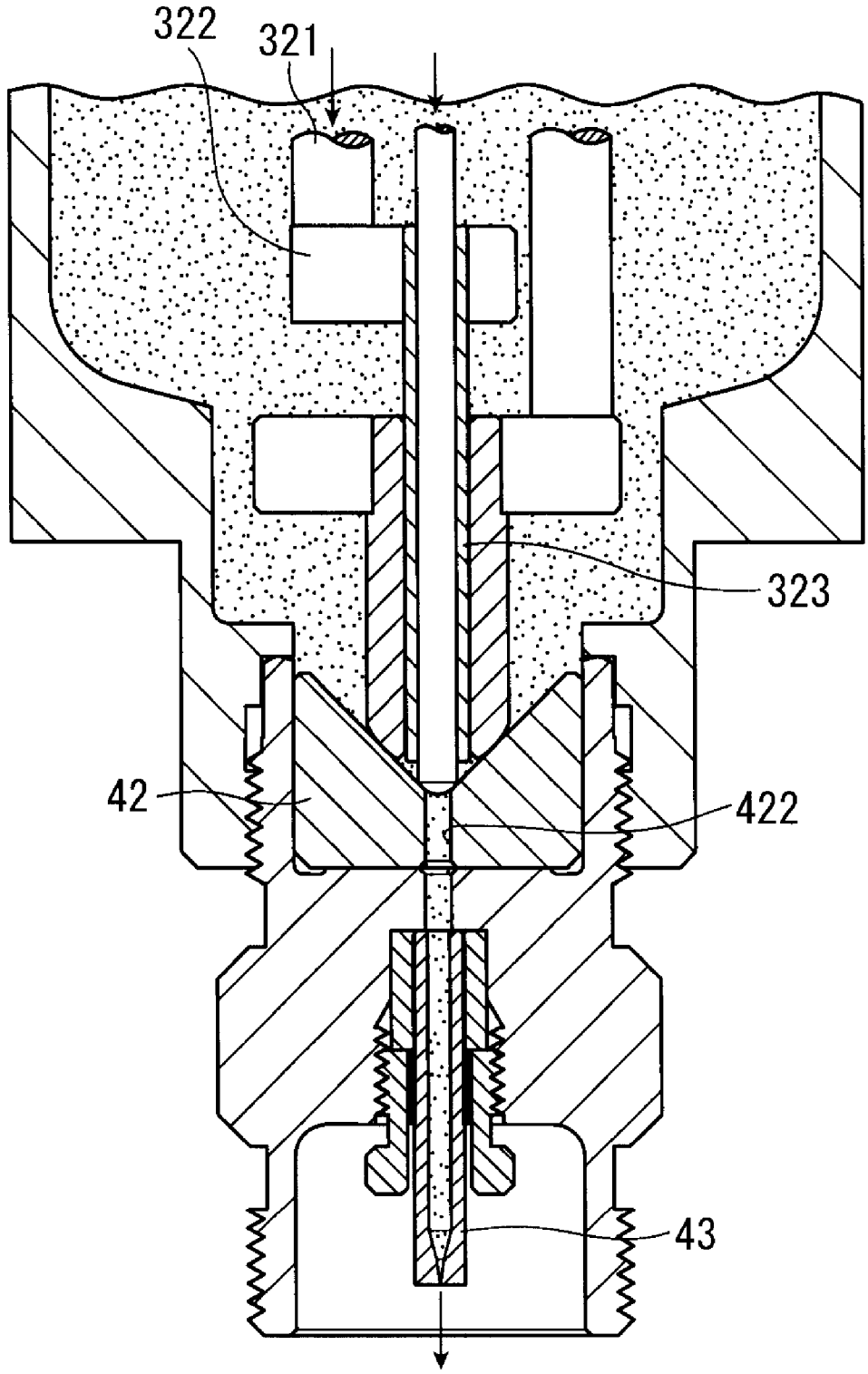
FIG. 9B is a cross-sectional view showing the pump mechanism when the discharging process is completed according to the first embodiment.

Accordingly, as shown in FIG. 9B, the measurement plunger holder 22 is moved against the biasing force of the measurement return-spring 224 toward the discharge outlet 422 side, such that the measurement plunger rod 321, the measurement plunger base 322 and the measurement plunger member 323 are moved toward the discharge outlet 422 side.

Since the inlet valve is closed while the outlet valve is opened at this time, the liquid is discharged from the nozzle 43 via the discharge outlet 422 in accordance with the movement of the measurement plunger member 323.

Figure 8B:
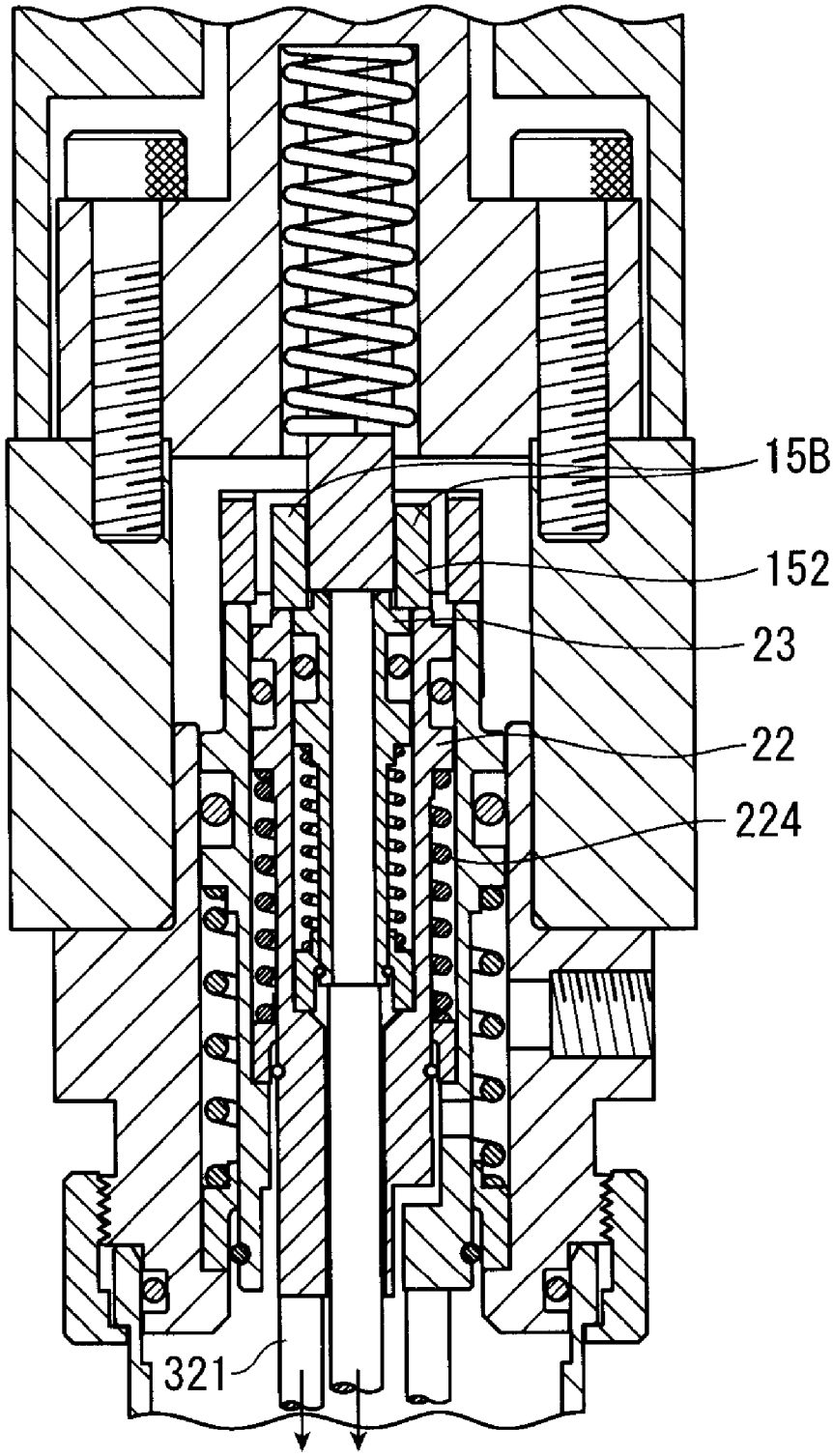
FIG. 8B is a cross-sectional view showing the driving mechanism when a discharging process is completed according to the first embodiment.

As shown in FIG. 8B, the driving arm 152 of the second driving arm member 15B is also engaged with the large-diameter part 231 of the needle valve holder 23 after being moved toward the needle valve holder 23 by a predetermined amount. Although the measurement plunger member 323 is separately moved in an initial stage, the measurement plunger member 323 and the needle 333 are moved together in a final stage. When the needle 333 abuts on and closes the discharge outlet 422, the movement of the measurement plunger member 323 is stopped, and the discharging process is completed.

[Inlet-Valve Opening Process]

Figure 10A:
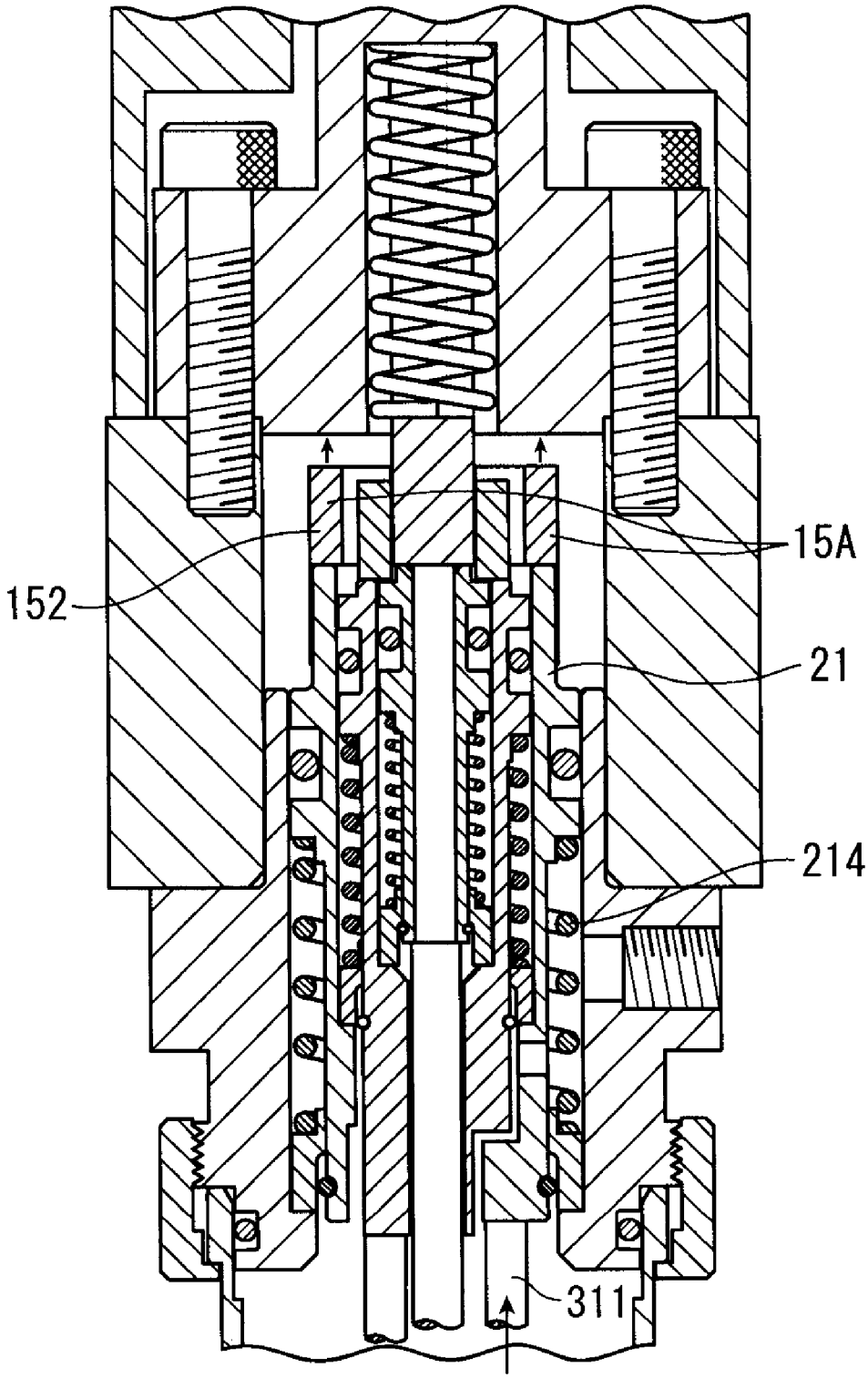
FIG. 10A is a cross-sectional view showing the driving mechanism when inlet-valve opening process is completed according to the first embodiment.

Next, while continuing to apply to the second piezoelectric element 14B the voltage of the second preset value for the second piezoelectric element, the control device applies to the first piezoelectric element 14A the voltage of the first preset value for the first piezoelectric element (i.e., applies no voltage). Subsequently, the first piezoelectric element 14A restores its length dimension in the initial state, and as shown in FIG. 10A, the driving arm 152 of the first driving arm member 15A is moved in the direction away from the discharge outlet 422.

Figure 11A:
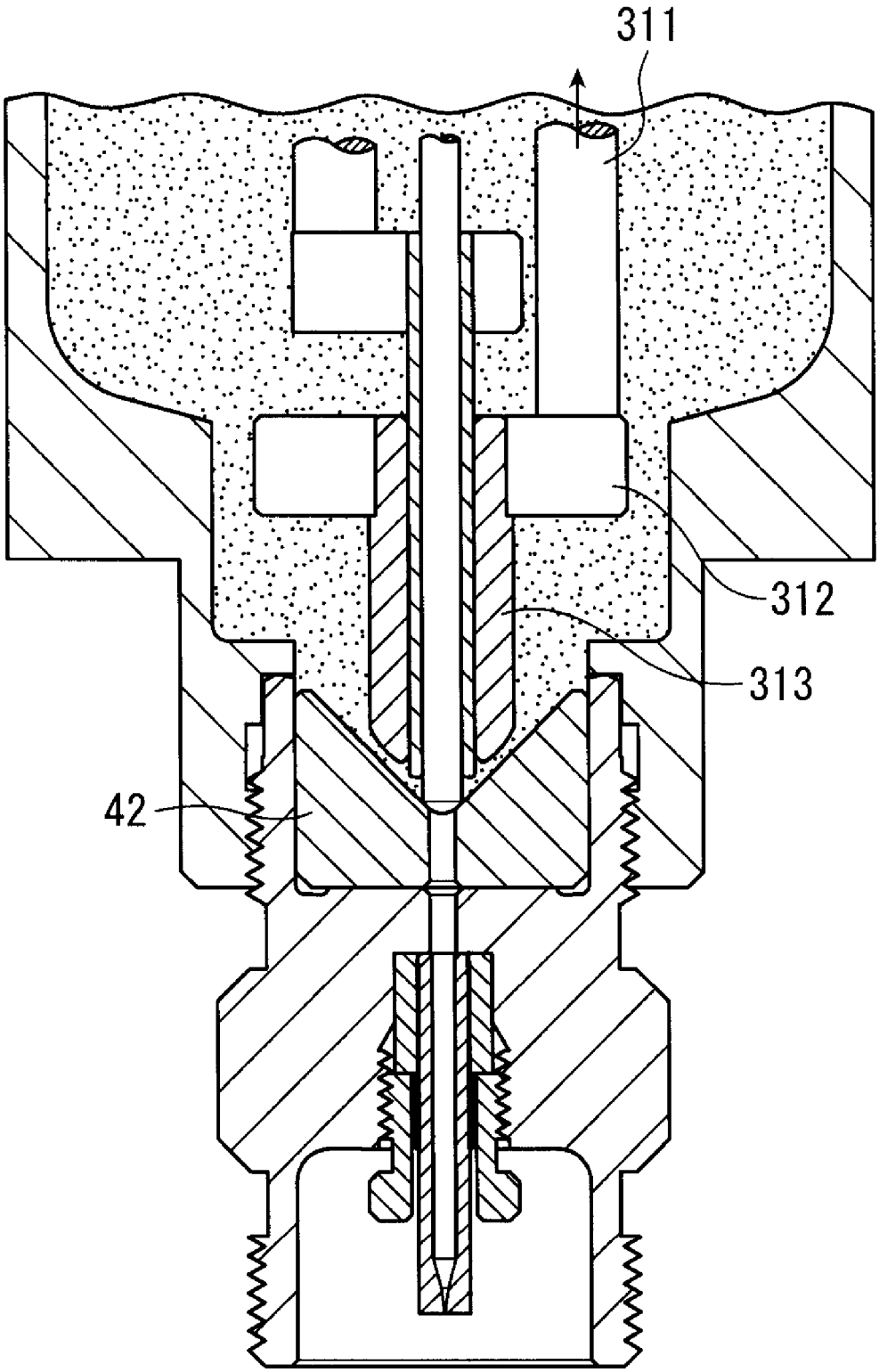
FIG. 11A is a cross-sectional view showing the pump mechanism when the inlet-valve opening process is completed according to the first embodiment.

Consequently, the inlet valve holder 21 is moved by the biasing force of the inlet return-spring 214 in the direction away from the discharge outlet 422, such that the inlet valve rod 311, the inlet valve base 312 and the inlet valve member 313 are moved in the direction away from the discharge outlet 422 as shown in FIG. 11A.

Accordingly, the inlet valve member 313 is away from the valve sheet 42 and the inlet valve is opened.

[Suctioning Process and Original Point Recovering]

Figure 10B:
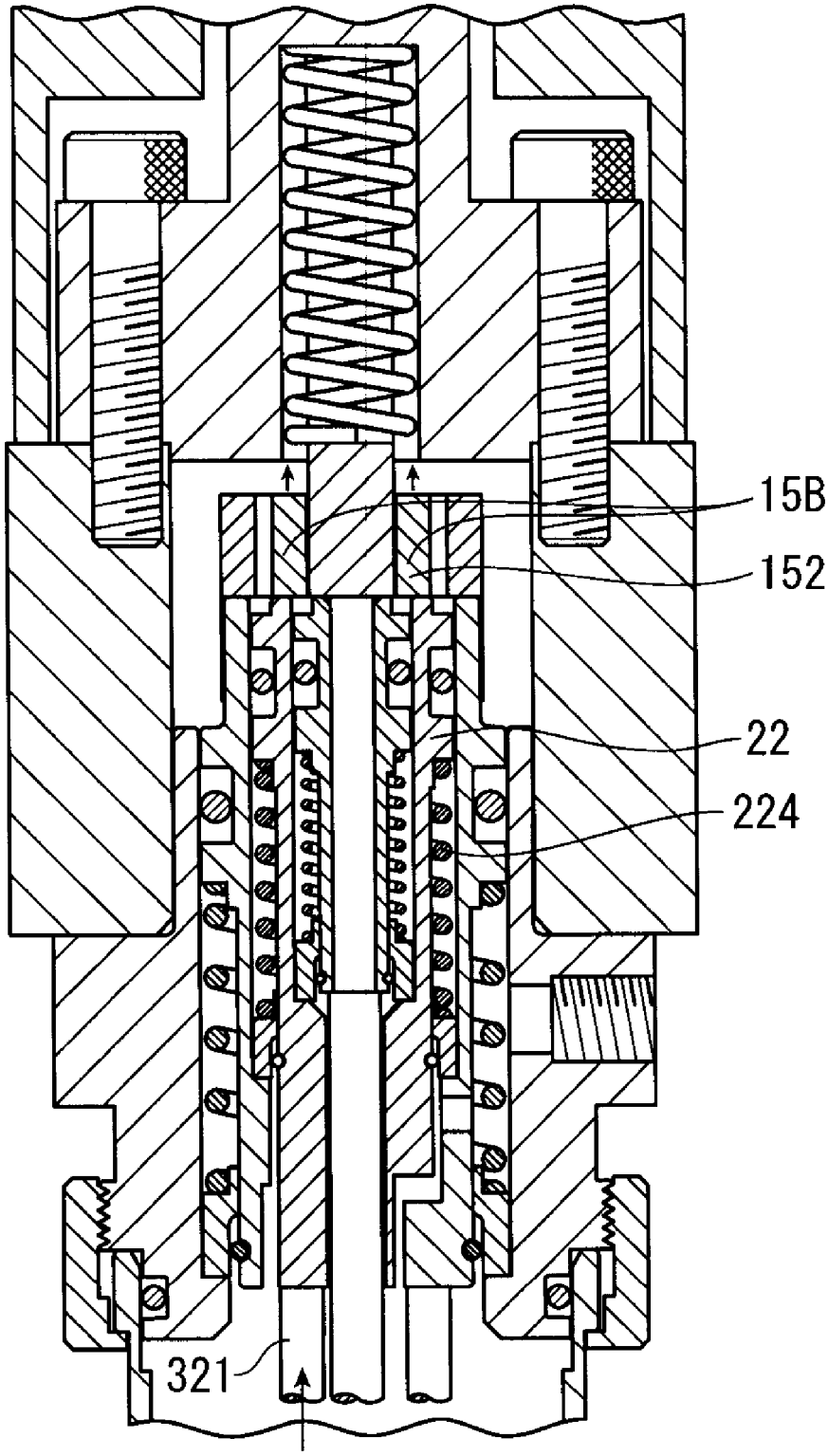
FIG. 10B is a cross-sectional view showing the driving mechanism when a suctioning process is completed according to the first embodiment.

Next, while continuing to apply to the first piezoelectric element 14A the voltage of the first preset value for the first piezoelectric element, the control device applies to the second piezoelectric element 14B the voltage of the first preset value for the second piezoelectric element (i.e., applies no voltage). Subsequently, the second piezoelectric element 14B restores its length dimension in the initial state, and as shown in FIG. 10B, the driving arm 152 of the second driving arm member 15B is moved in the direction away from the discharge outlet 422.

Figure 11B:
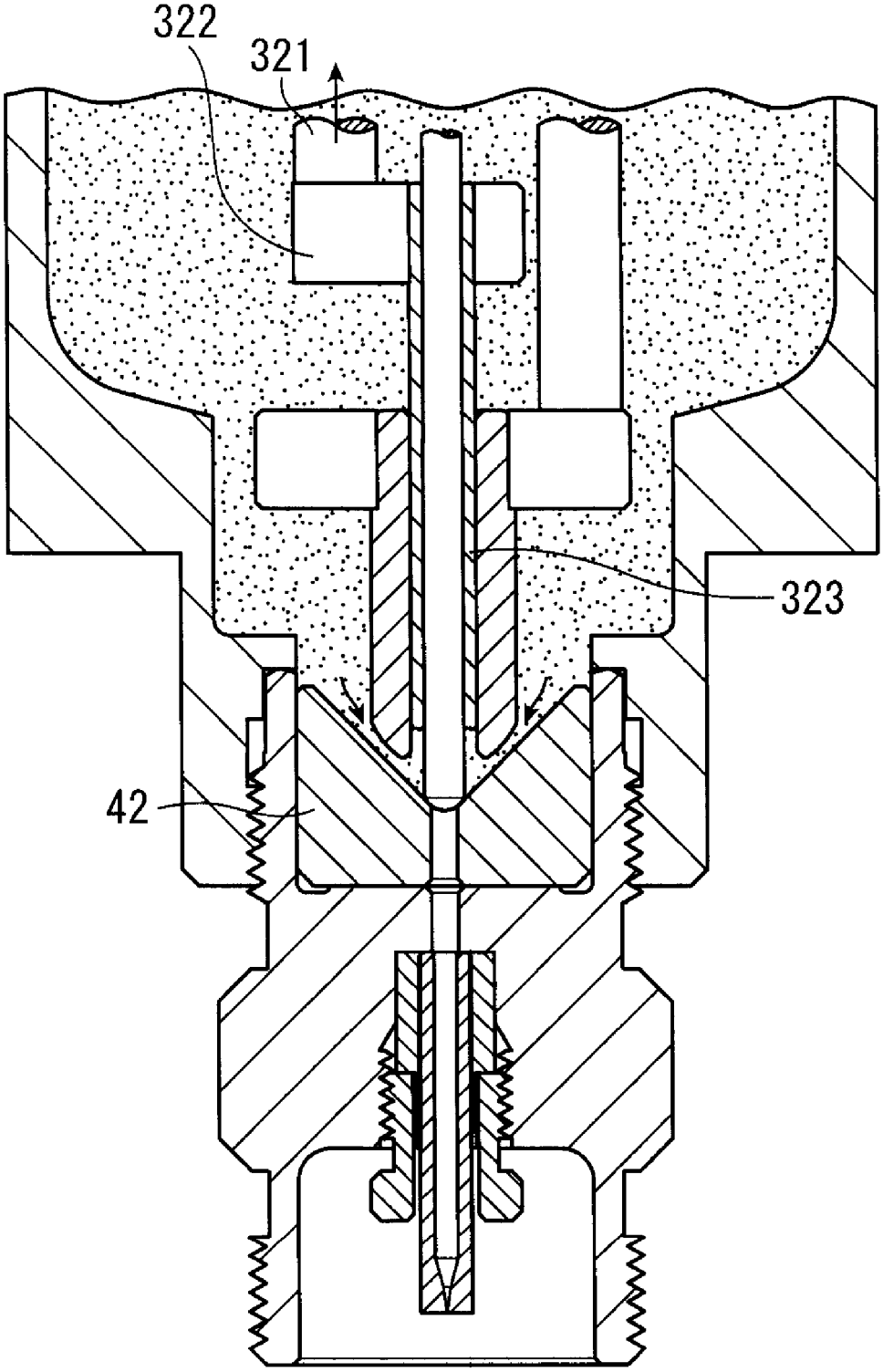
FIG. 11B is a cross-sectional view showing the pump mechanism when the suctioning process is completed according to the first embodiment.

Accordingly, the measurement plunger holder 22 is moved by the biasing force of the measurement return-spring 224 in the direction away from the discharge outlet 422, such that the measurement plunger rod 321, the measurement plunger base 322 and the measurement plunger member 323 are moved in the direction away from the discharge outlet 422 as shown in FIG. 11B.

Since the outlet valve is closed while the inlet valve is opened in this state, the liquid inside the container 4 is suctioned into a space formed due to the movement of the measurement plunger member 323 via the inlet valve. The measurement plunger member 323 returns to the initial position, whereby the liquid discharging device 1 returns to the original point state.

By repeating the above-described operations, the liquid is discharged in turn by the predetermined amount. In every liquid discharging process, the liquid discharging quantity per one time can be adjusted by adjusting the third preset value for the second piezoelectric element. By adjusting the voltage value of the driving signal applied to the piezoelectric element 14A, 14B, the driving speed of the inlet valve member 313, the measurement plunger member 323 and the needle 333 is controlled, whereby cycle time of the liquid discharging can be adjusted.

According to the present embodiment, the following advantage can be obtained.

(1) Since the inlet valve member 313, the measurement plunger member 323 and the needle 333 are driven by use of the piezoelectric elements 14A, 14B, the liquid discharging device 1 can be made as small and lightweight as an air-cylinder-driven device. Specifically, as compared with a device employing a driving mechanism such as a servomotor, solenoid and cam, the liquid discharging device 1 is more easily made small.

Thus, when the liquid discharging device 1 according to the present embodiment is used for discharging adhesives or a variety of pastes in production lines for various products, the device can be mounted on an arm of a robot to be transferred at high speed and high acceleration. Therefore, shortening takt time in the production lines can be realized, thereby contributing to productivity improvement.

(2) Since the piezoelectric elements 14A, 14B are adapted to be driven at high speed, the liquid discharging device 1 can perform the discharging operation, for example, ten times and more per second, thereby realizing a liquid discharging operation at higher speed than an air-cylinder-driven device.

In addition, since the discharging process is completed by closing the discharge outlet 422 with the needle 333, the liquid discharging device can spit the liquid quickly without dripping and finely ejaculate the liquid in this respect as well, thereby enhancing the accuracy of the discharging quantity and realizing a stable discharging operation.

(3) The quantity of the discharging liquid can be easily changed by adjusting the third preset value for the second piezoelectric element applied to the second piezoelectric element 14B during the measuring process. With this arrangement, even in the middle of discharging, the discharging quantity per one discharge operation can be automatically adjusted. Specifically, for example, in a process to mount a plurality of electronic components on a substrate, in order to apply a different amount of an adhesive per mounting position of the electric components, the amount of the adhesive to be discharged on the substrate is required to be changed. Taking another example, in a production line where a plurality of products are conveyed in a mixed state, discharging quantity of liquid may be required to be changed per product. Even in the above examples, the liquid discharging device 1 can easily change the discharging quantity, thereby enhancing the usability.

(4) By operating the two piezoelectric elements 14A, 14B, the driving of the measurement plunger member 323 as the discharging member and the inlet valve member 313 as the supplier opening/closing member is controlled. Further, by biasing with the pressing spring 13 the piezoelectric-element support plate 12 supporting the piezoelectric element 14A, 14B toward the discharge outlet 422 side and by expanding the piezoelectric element 14A even after the inlet valve member 313 abuts on the tapered surface of the valve sheet 42, the piezoelectric-element support plate 12 is moved against the biasing force applied by the spring 13 in the direction away from the discharge outlet 422, such that the driving of the needle 333 as the discharge-outlet opening/closing member is controlled.

As described above, in the present embodiment, the piezoelectric-element support plate 12 can be slid using the pressing spring 13 and the guide member in relation to the body of the liquid discharging device 1. Further, the inlet valve member 313 abuts on the inner surface of the container 4 in the middle of the stroke and the reaction force is utilized. With this arrangement, merely by controlling the driving of the pair of the piezoelectric elements 14A, 14B, the driving of the three members (the inlet valve member 313, the measurement plunger member 323 and the needle 333) can be controlled. Accordingly, the liquid discharging device is free from a problem of complexity of the piezoelectric elements alignment and the drive control, the problem as seen in a case where three members are driven by three piezoelectric elements. Thus, the production cost of the liquid discharging device 1 can be reduced.

Being driven by the piezoelectric element 14A, 14B, the liquid discharging device 1 can be made small as compared to a device whose driving source is a cam, motor, ball screw, solenoid and the like. Thus, the arrangement is particularly advantageous for discharging the liquid in infinitesimal quantity.

(5) Since the piezoelectric-element support plate 12 to which the piezoelectric element 14A, 14B is attached is integrally formed, a displacement amount of the drive unit 124A, 124B and the displacement transmitter 127A, 127B corresponding to the expansion and contraction of the piezoelectric elements 14A, 14B can be accurately set.

In addition, since the driving arm members 15A, 15B are fixed to the displacement transmitters 127A, 127B without rattling, the displacement amount of the displacement transmitter 127A, 127B can be accurately transmitted to the driving arm members 15A, 15B, such that the displacement amount of the driving arm members 15A, 15B corresponding to the expansion and contraction of the piezoelectric elements 14A, 14B (i.e., the movement amount of the inlet valve member 313, measurement plunger member 323 and needle 333) can be accurately set. With this arrangement, the liquid discharging device 1 can accurately discharge the liquid even in infinitesimal quantity.

(6) When the voltage applied to the piezoelectric elements 14A, 14B is turned to be "0", the liquid discharging device 1 is set to become the origin point state (non-driven state). Thus, while no operation is performed, the piezoelectric elements 14A, 14B generate no heat and there is no temperature rise. Accordingly, the piezoelectric elements 14A, 14B can be prevented from having a variation of the displacement amount affected by the temperature change, thereby improving the accuracy of the displacement amount of the piezoelectric elements 14A, 14B, i.e., the accuracy of the discharging liquid quantity.

(7) Since The base end 122A, 122B of the piezoelectric-element support plate 12 is provided with a dimension adjuster formed by the insection and the thread 132, the axial position of the displacement transmitter 127A, 127B can be micro-adjusted with ease by merely adjusting the fastening amount of the thread 132. Accordingly, even if processing accuracy of the piezoelectric-element support plate 12 is more or less low, the discharge-outlet side surface of the driving arm 152 can be flush with the discharge-outlet-422 side surface of the projection 131 in the original point state. Hence, if a state where the discharge-outlet-422 side surfaces of the projection 131 and the driving arm 152 are flush with each other is used as a design status, it is easy to judge whether or not the piezoelectric-element support plate 12 is manufactured and assembled in accordance with the design, thereby preventing errors from occurring.

(8) In the present embodiment, the discharging liquid quantity is determined only based on the stroke of the measurement plunger member 323. Therefore, even when the container 4 or the like expands due to external temperature, the accuracy of the discharging quantity is not affected and the liquid can be discharged even in infinitesimal quantity with a high accuracy.

(9) In the present embodiment, in order for a driving force to be transmitted, the springs 214, 224, 234 are provided such that the holders 21, 22, 23 abut on the projection 131 of the piezoelectric-element support plate 12 and the driving arm members 15A, 15B. With this arrangement, merely by separating the drive-unit base 3 from the pump holder 2, the driving mechanism side including the piezoelectric-element support plate 12 and the pump side including the holders 21, 22, 23 are easily separated. Accordingly, the inlet valve member 313, the measurement plunger member 323 and the needle 333 can be easily detached for washing, whereby a maintenance operation can be easily and efficiently performed.

(10) Although there may be a delay in discharging liquid having high viscosity such as a paste in an arrangement where the pump and the discharge outlet 422 are away from each other, there is no delay in discharging the liquid in the present embodiment since the pump having the needle 333 and the like for discharging the liquid is provided in a close proximity to the discharge outlet 422.

In addition, when a solvent such as alcohol that is evaporable due to its low boiling point flows through a complicated path; for example, when suctioned into the pump and passing through a check valve, the solvent tends to be foamed, and the foam may be accumulated such that the liquid is prevented from being discharged. However, in the present embodiment, since the pump is provided in the close proximity to the discharge outlet 422 and the liquid flowing path is not complicated, there is no risk that the liquid is foamed, whereby a normal liquid discharging operation can be performed.

(11) Since the inlet valve member 313 is concentrically arranged outside the needle 333, a suctioning area when the liquid is suctioned into the inlet valve member 313 from a liquid suction path can be enlarged, thereby shorting the liquid suctioning time (i.e. operation time).

(12) In order for liquid that has a high degree of viscosity to be discharged at high speed, the liquid needs to be extruded with high pressure. By use of the mechanical driving force of the piezoelectric elements 14A, 14B as the driving source, the liquid discharging device 1 can have a more powerful driving force than a device whose driving source is an air-cylinder. Thus, the liquid discharging device 1 can discharge the liquid at high speed.

In addition, since the liquid discharging device 1 can discharge the liquid from an upper position that is away from an object such as a substrate on which the liquid is discharged, whether or not the discharging operation is performed can be checked by providing an infrared radiation sensor outside of the liquid discharging device 1.

As the liquid discharging device 1 does not have any check valves, the liquid can be pressurized to be conveyed. Thus, even liquid having a high viscosity can be easily supplied into the liquid discharging device 1.

Second Embodiment

Next, a second embodiment of the present invention will be described below with reference to FIGS. 12 to 15. In the present embodiment, the same numeral is given to a similar component to or the same component as that of the first embodiment, and the description therefor will be omitted or simplified.

Figure 12:
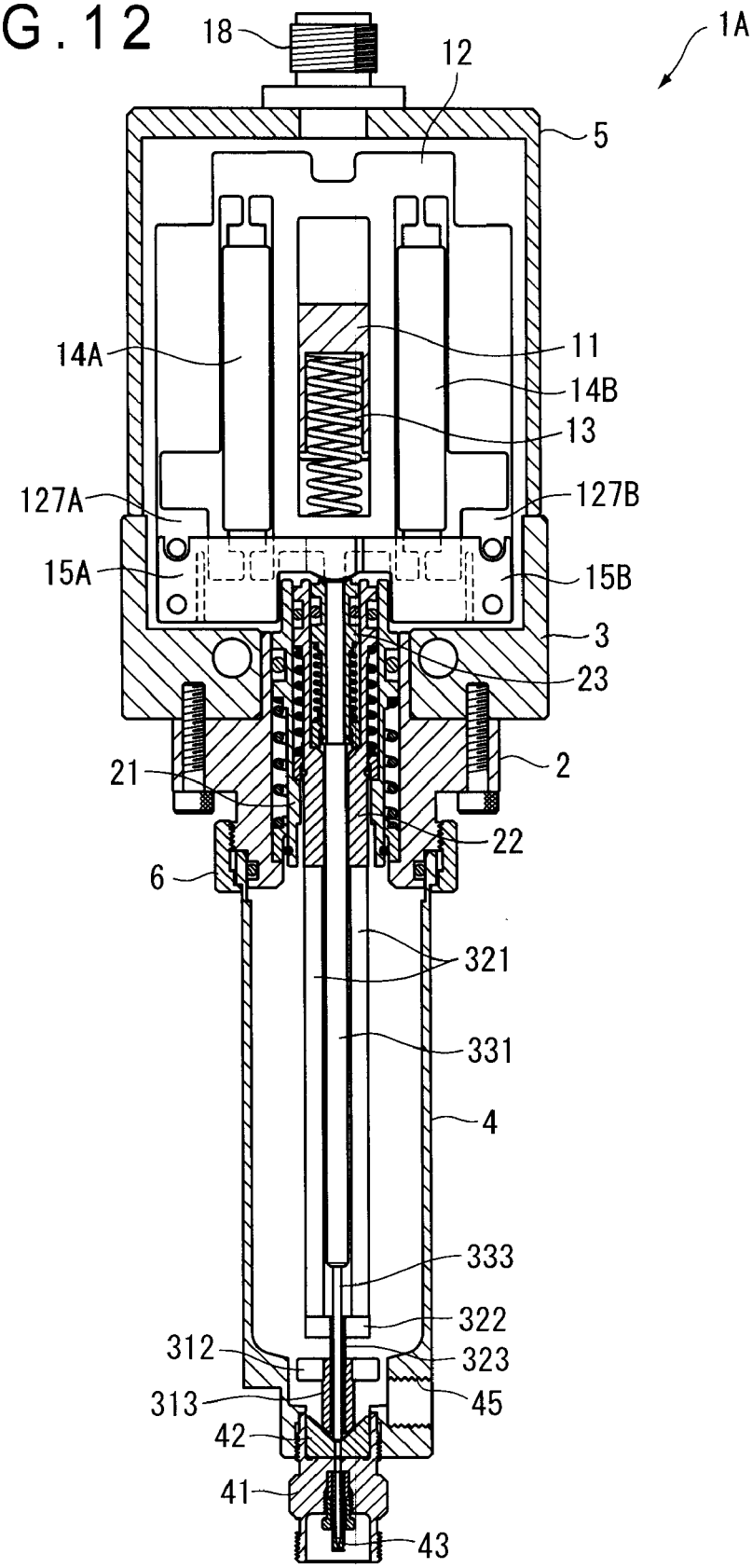
FIG. 12 is a cross-sectional view showing a liquid discharging device according to a second embodiment of the present invention.

As shown in FIG. 12, a liquid discharging device 1A according to the present embodiment is mainly different from the liquid discharging device 1 according to the first embodiment in that: the thread 132 and the folded portion 133 are omitted; the second hinge 125 is made slightly longer and attached with a strain gauge; and when the driving arm member 15A, 15B is fixed to the displacement transmitter 127A, 127B, a tip end position of the driving arm 152 is micro-adjustable.

Figure 13:
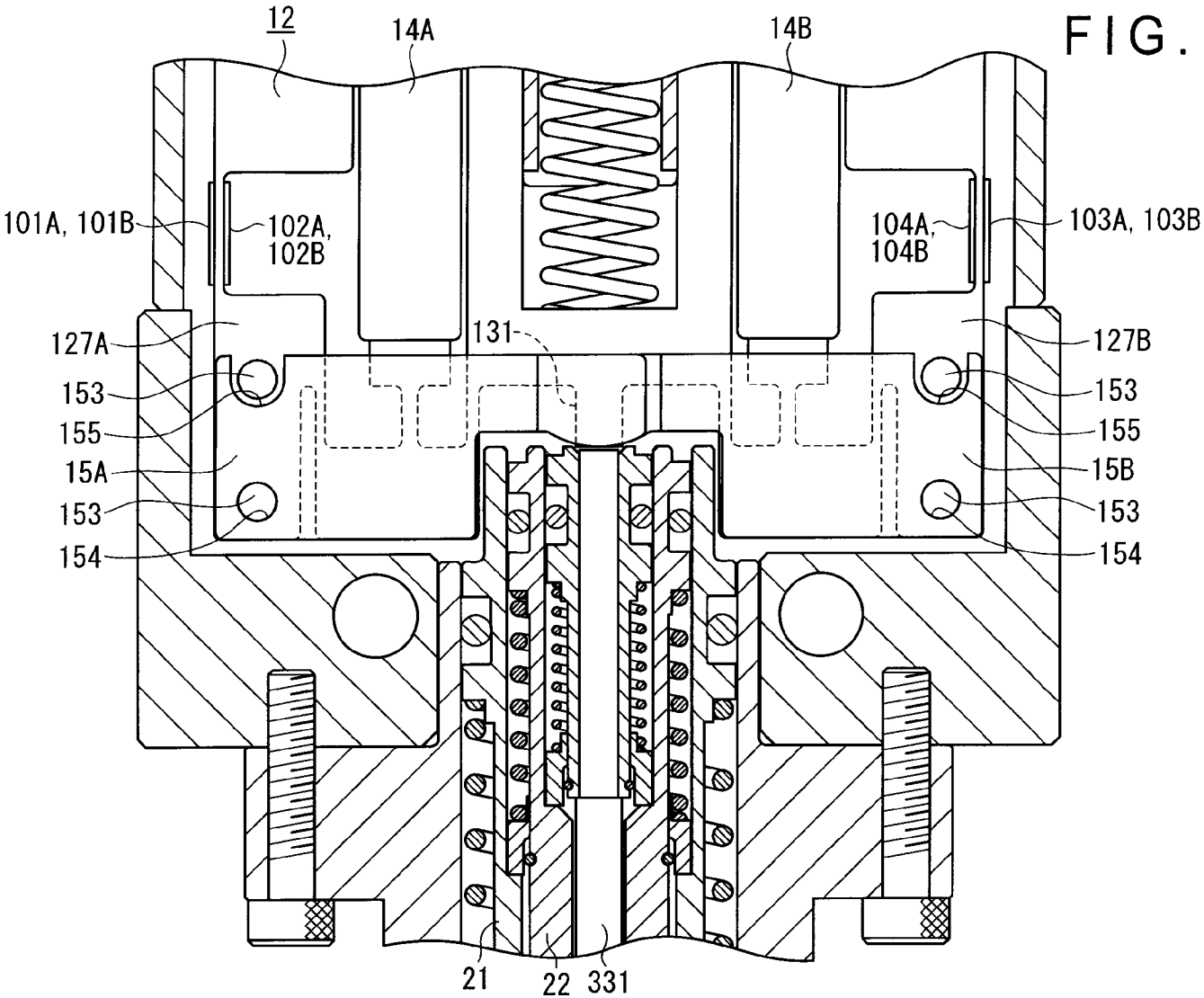
FIG. 13 is a cross-sectional view showing a primary portion of the liquid discharging device according to the second embodiment.

In short, as shown in FIG. 13, in the liquid discharging device 1A, the driving arm member 15A, 15B has: an opening 154 into which the pin 153 is inserted; and a groove 155 in which another pin 153 is arrayed. The groove 155 is formed to have a dimension to define a gap between the groove 155 and the pin 153, and the driving arm member 15A, 15B is rotatable around the pin 153 having been inserted into the opening 154 in a range that the groove 155 does not abut on the pin 153. By filling an adhesive in the groove 155 to be fixed in a state where a tip end lower surface of the projection 131 of the support plate 12 and a tip end lower surface of the driving arms 152 of the driving arm members 15A, 15B abut on the same plane such that both are positioned at the same height, a processing error, which may occur to the support plate 12, the driving arm member 15A, 15B and the like, can be easily adjusted.

In addition, in the present embodiment, strain gauges are attached to both a front and back sides of the second hinge 125. Not that the back side of the second hinge 125 means a side facing the piezoelectric element 14A, 14B while the front side of the second hinge 125 means a side facing the cover 5 in the present embodiment.

Specifically, a pair of strain gauges 101A, 101B are adhered to the front side of the second hinge 125 that is deformed in accordance with the expansion and contraction of the first piezoelectric element 14A while a pair of strain gauges 102A, 102B are adhered to the back side of the second hinge 125. Likewise, strain gauges 103A, 103B and strain gauges 104A, 104B are adhered to the front and back sides of the second hinge 125 that is deformed in accordance with the expansion and contraction of the second piezoelectric element 14B.

Figure 14:
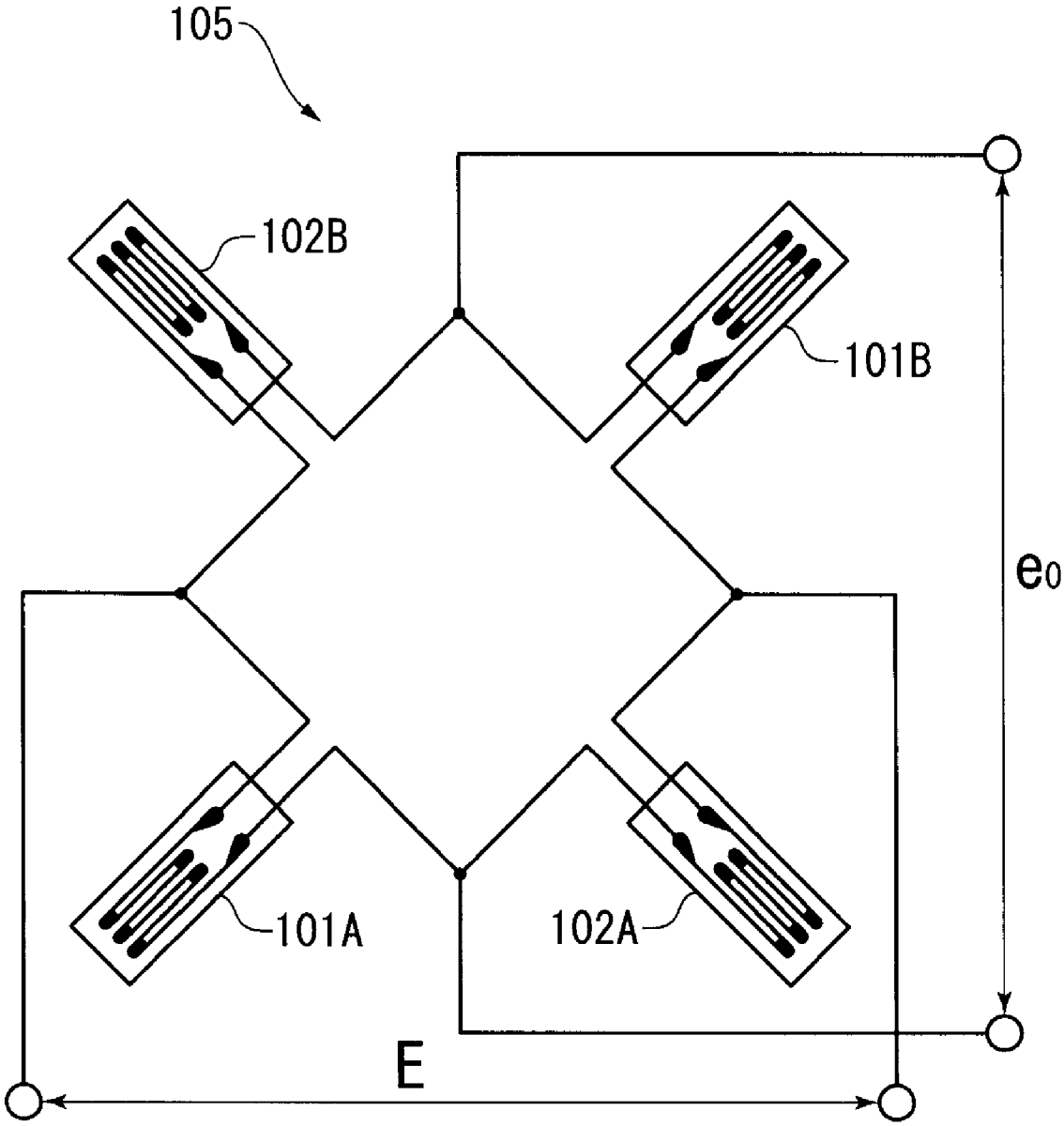
FIG. 14 is a circuit diagram showing an arrangement of a measuring circuit of a strain sensor according to the second embodiment.

The four strain gauges 101A, 101B, 102A, 102B attached to one second hinge 125 is, as shown in FIG. 14, connected to a bridge circuit 105. Likewise, although not shown, the four strain gauges 103A, 103B, 104A, 104B attached to the other second hinge 125 are also connected to a bridge circuit.

Since an output e0 of the bridge circuit 105 is set to satisfy an equation of $e0=KS\cdot\epsilon 0\cdot E$, when a bending strain $\epsilon$ occurs to the second hinge 125, a voltage in accordance with the strain amount is output. Herein, KS represents a gauge rate, and E represents a bridge voltage.

Note that an input-voltage and output-voltage wires for the bridge circuit 105 are connected to the exterior control device via a sensor-output connector (not shown) that is configured similarly with the connector 18. An arrangement where the connector 18 for driving and the connector for the sensor are separately provided is advantageous in denoising. Note that, however, one connector may be configured to have both a driving wire and a sensor wire by shielding the two wires.

As described above in the first embodiment, the second hinge 125 is deformed when the displacement transmitter 127A, 127B is inclined due to the expansion and contraction of the piezoelectric element 14A, 14B, such that a bending strain occurs. Accordingly, by providing the strain gauges 101A, 101B, 102A, 102B, 103A, 103B, 104A, 104B (hereinafter, "strain gauges 101A to 104B") to the second hinge 125 and by measuring the bending strain occurring to the second hinge 125, the inclination amount of the displacement transmitter 127A, 127B (i.e., the movement amount of the driving arm 152) can be measured.

In the present embodiment, the driving arm members 15A, 15B are driven as in the first embodiment, such that the liquid is discharged. In short, the driving arm member 15A is moved during the valve-switching process as shown in the graph A of FIG. 15 while the driving arm member 15B is moved during the measuring process, discharging process and suctioning process as shown in the graph B of FIG. 15.

Figure 15:
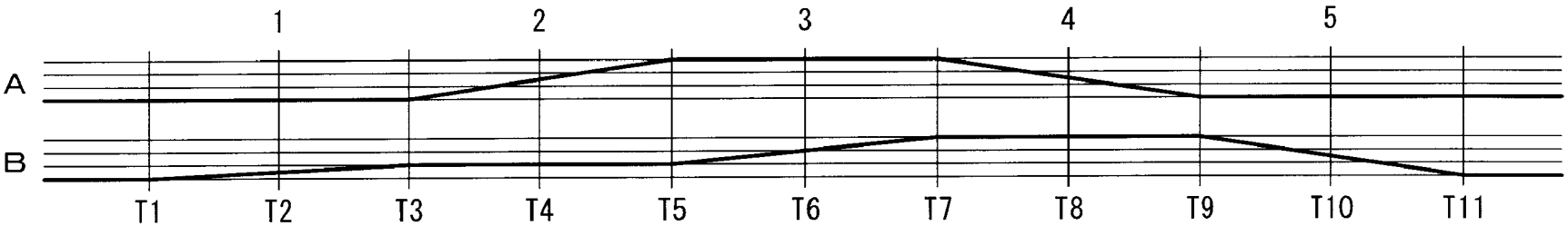
FIG. 15 is a timing diagram explaining operations according to the second embodiment.

Note that, in FIG. 15, timings T1 to T11 respectively represent the original point state (T1), measuring process (T2), measuring completion (T3), valve-switching process (T4), valve-switching completion (T5), discharging process (T6), discharging completion (T7), valve-switching process (T8), valve-switching completion (T9), suctioning process (T10) and original point state (T11).

Also in the present embodiment, the discharging quantity is set by the movement position of the measurement plunger member 323 when the measuring process is completed, as in the first embodiment. Accordingly, the bending strain amount of the second hinge 125 (i.e., the output voltage of the bridge circuit 105) when the measurement plunger member 323 is moved to the position corresponding to the predetermined discharging quantity is set as a target voltage. The output voltage of the bridge circuit 105 is compared with the target voltage when the measuring process is completed. Based on a difference between the output voltage and the target voltage, a feedback control is conducted so as to adjust the voltage applied to the piezoelectric element 14A, 14B in the next measuring process.

Incidentally, a relationship between the discharging quantity and the output voltage of the bridge circuit 105 may be obtained through the following processes: discharging the liquid in advance and obtaining a calibration curve representing the relationship between the discharged liquid quantity and the output voltage at that time (the bending strain amount of the second hinge 125); and when actually measured, obtaining a voltage value (bending strain amount) corresponding to the discharging quantity that has been set based on the calibration curve.

The liquid quantity may be visually judged, may be obtained by measuring an area of the discharged liquid using an image processor or may be obtained by measuring a weight of the discharged liquid.

In the present embodiment, additionally to the advantages similar to those of the first embodiment, the following advantages may be also obtained.

(13) By providing the strain gauges 103A, 103B, 104A, 104B to the second hinge 125 that is deformed in accordance with the expansion and contraction of the second piezoelectric element 14B, the movement amount of the driving arm 152 of the second driving arm member 15B when the measuring process is completed can be detected, such that the measured liquid quantity (i.e., the discharging quantity) can be detected.

With this arrangement, the liquid discharging operation of the liquid discharging device 1A can be controlled by the feedback control, and the device 1A can discharge the liquid even in infinitesimal quantity with high accuracy.

(14) By providing the strain gauges 101A, 101B, 102A, 102B to the second hinge 125 that is deformed in accordance with the expansion and contraction of the first piezoelectric element 14A, the positions of the inlet valve member 313 (supplier opening/closing member) and of the needle 333 (discharge-outlet opening/closing member) and the opening/closing state of the liquid supplier and of the discharge outlet can be reliably detected. Accordingly, by monitoring the output from the bridge circuit 105, operation state of the liquid discharging device 1A can be observed.

(15) Since the displacement is detected using the strain gauges 103A, 103, 104A, 104B, the bending strain amount (the movement amount of the measurement plunger member 323) can be detected with high accuracy. Accordingly, the movement amount of the measurement plunger member 323 can be detected with accuracy of 0.1 micron and less, thereby realizing a liquid discharging operation in infinitesimal quantity with high accuracy.

In addition, as the strain gauges 101A to 104B are small and thin sensors, the liquid discharging device 1A can be prevented from increasing its size.

Since the strain gauges 101A to 104B are provided to the second hinges 125, which are deformed the most amount the hinges, the output voltage from the bridge circuit 105 can be made large, such that the bending strain amount of the second hinge 125 (i.e., the movement amount of the measurement plunger member 323) can be reliably detected.

(16) Since, in the discharging cycle, the movement amount of the measurement plunger member 323 in the next measuring process is adjusted based on the strain amount of the second hinge when the measuring process is completed, there is no need to measure or control in real-time the output from the strain gauges 101A to 104B. Since there is no need to process the data in real-time, a higher-speed operation is realized. Also, since the controlling voltage does not finely fluctuate in real-time, a vibration that arises when the piezoelectric element is driven at high speed can be prevented, whereby an optimal driving state can be maintained.

(17) Since the groove 155 is provided to the driving arm member 15A, 15B such that the height position of the tip end of the driving arm 152 can be micro-adjusted, there is no need to provide the thread 132 or folded portion 133 unlike the first embodiment, thereby simplifying the shape of the support plate 12 and facilitating the manufacturing of the plate 12. Further, with this arrangement, the height positions of the lower surfaces of the projection 131 and of the driving arms 152 can be easily and accurately matched.

Third Embodiment

A third embodiment of the present invention will be described below with reference to FIGS. 16 to 48.

Figure 16:
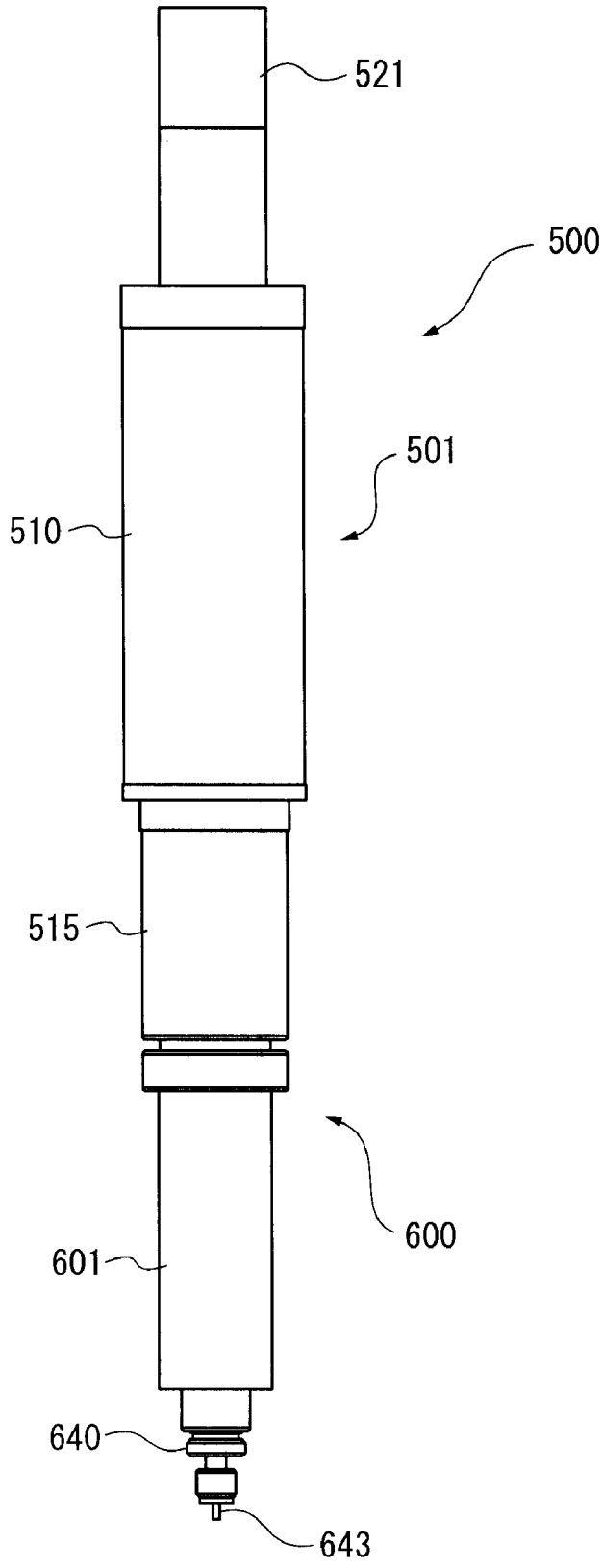
FIG. 16 is a front view showing a liquid discharging device according to a third embodiment of the present invention.
Figure 17:
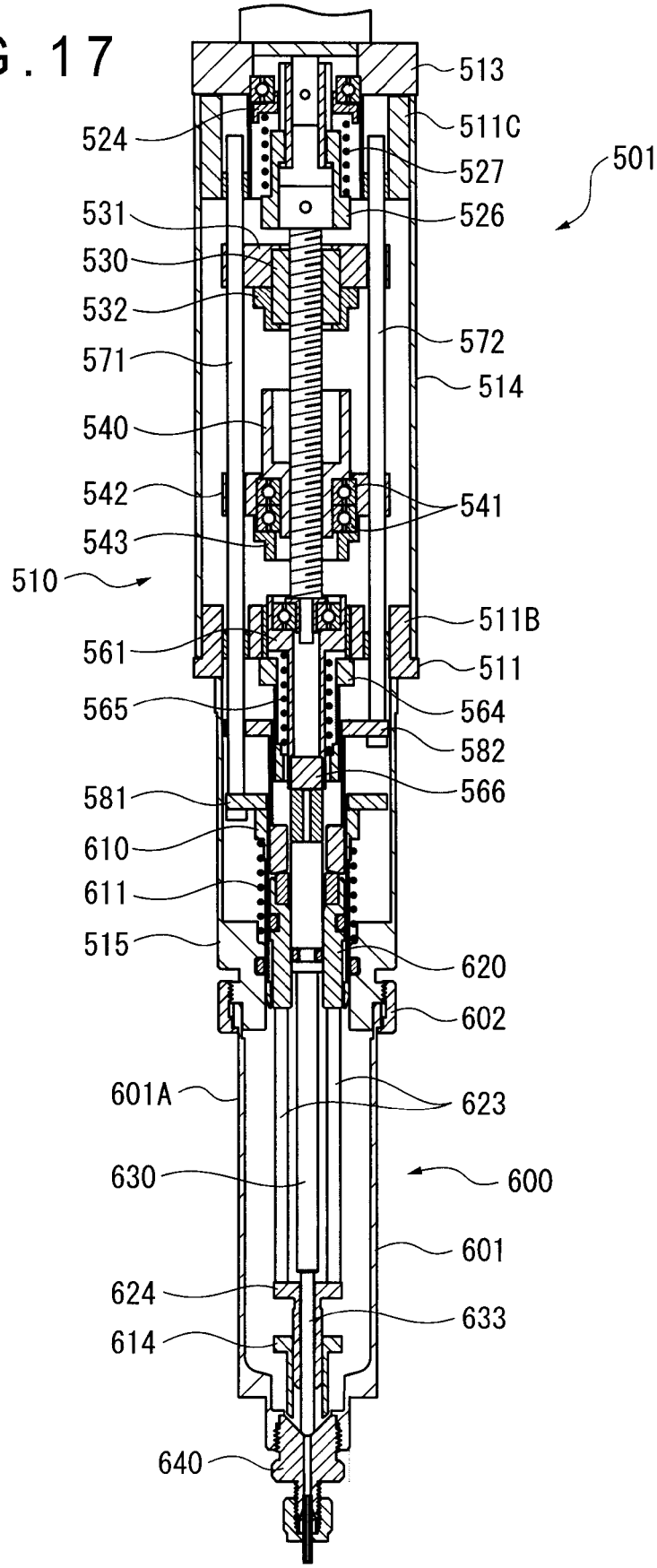
FIG. 17 is a cross-sectional view showing the liquid discharging device according to the third embodiment.
Figure 18:
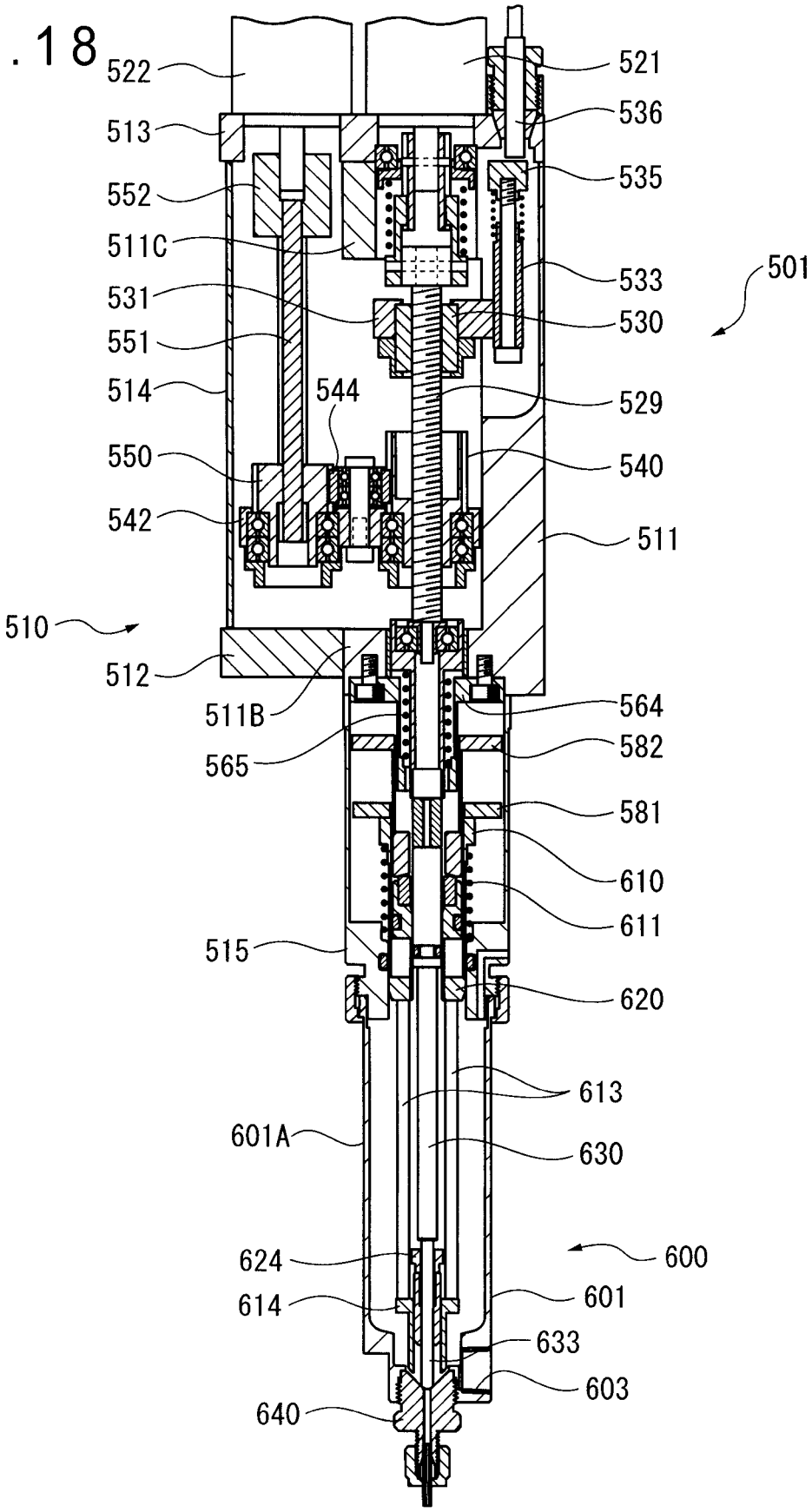
FIG. 18 is a cross-sectional view showing the liquid discharging device according to the third embodiment.

FIGS. 16 to 18 show a liquid discharging device 500 according to the third embodiment.

broadly speaking, the liquid discharging device 500 includes a drive unit 501 and a pump 600. Note that a direction from the pump 600 to the drive unit 501 is defined as an upper direction while a direction from the drive unit 501 to the pump 600 is defined as a lower direction because the liquid discharging device 500 according to the present invention is usually used with the drive unit 501 side placed at an upper side while the pump 600 side placed at a lower side.

[Arrangement of Driving Mechanism]

As shown in FIGS. 19 to 22, the drive unit 501 includes a case 510 as a driving-mechanism housing portion, and the case 510 includes: a frame 511 having a side plate 511A, a lower flange 511B and an upper flange 511C and formed substantially in C-shaped in side view; a spacer 512 screwed to the lower flange 511B of the frame 511; a motor flange 513 fixed to the upper flange 511C of the frame 511; and a cover 514 for covering an opening lateral portion of the frame 511. A substantially cylindrical joint 515 is screw-connected to the lower flange 511B of the frame 511.

A first motor 521 and a second motor 522 are fixed to the motor flange 513, and driven components driven by the motors 521, 522 are arrayed inside the case 510.

Although a servo motor is used for the motor 521, 522 in the present embodiment, a stepping motor may be alternatively used. In short, any motor can be used as the motor 521, 522 as long as the motor can change a displacement amount as commanded by the driving signal (i.e., as long as the motor is a motor whose displacement amount is settable).

Figure 21:
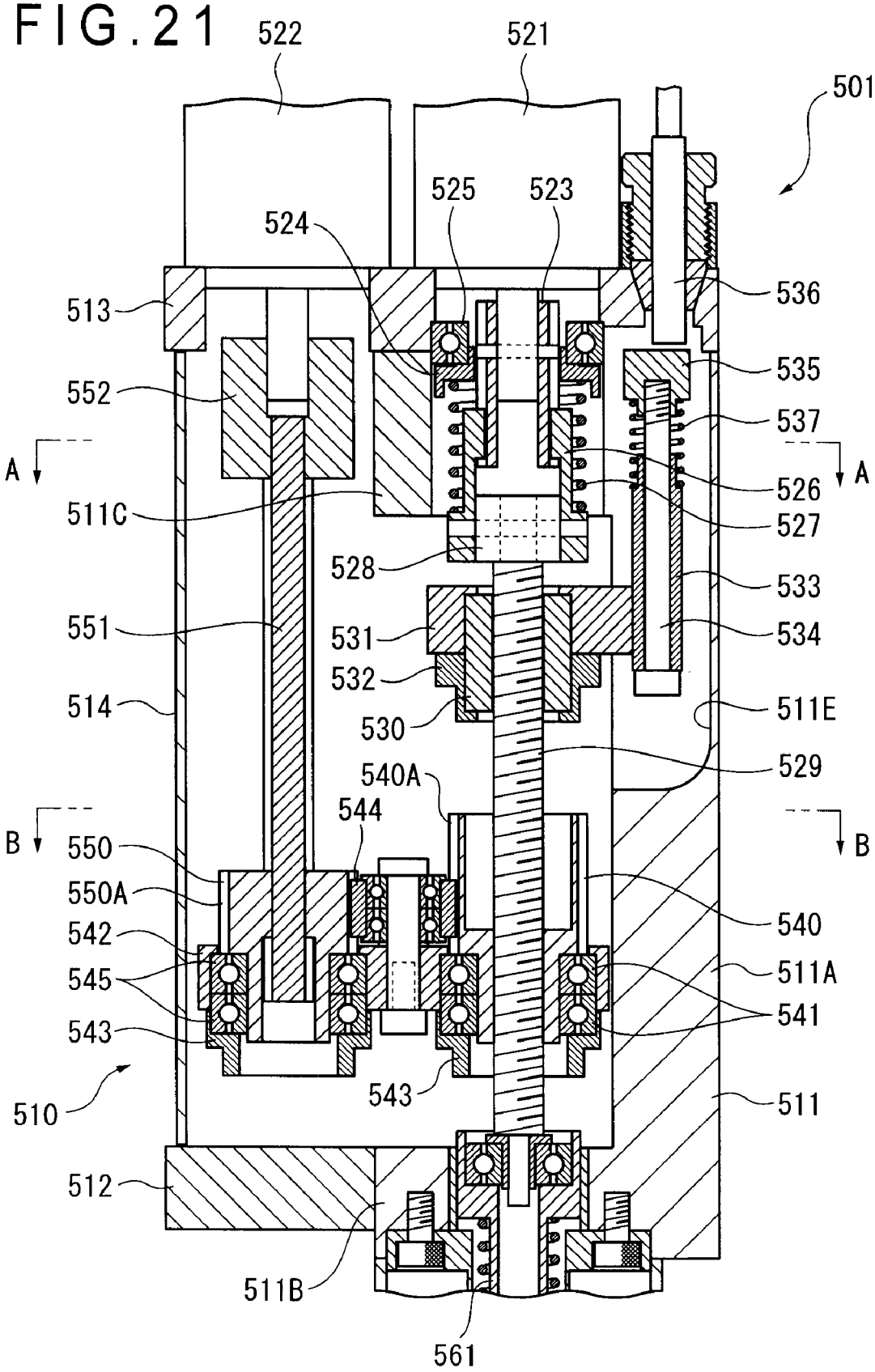
FIG. 21 is a cross-sectional view showing a primary portion of the drive unit of the liquid discharging device according to the third embodiment.

As shown in FIG. 21, a spline shaft 523 is fixed to an output shaft of the first motor 521 by a pin. The spline shaft 523 is fitted into a substantially disc-shaped upper spring washer 524, which is supported by a bearing 525 to be rotatable relative to the case 510.

Accordingly, the spline shaft 523 and the upper spring washer 524 are rotatably supported by the bearing 525 and integrally rotated with the output shaft of the first motor 521.

An outer cylinder (boss) 526 is engaged with the spline shaft 523 such that the outer cylinder 526 is slidable in the axis direction of the spline shaft 523 and rotatable together with the spline shaft 523. A coil spring 527 as a biasing unit is interposed between the outer cylinder 526 and the upper spring washer 524, the coil spring 527 biasing the outer cylinder 526 downwardly. Inside the outer cylinder 526, a spacer 528 and an end of a thread shaft 529 are fixed by spring pin.

An inlet nut 530 as a first nut member and a measurement nut 540 as a second nut member are screwed with the thread shaft 529. Incidentally, although a general thread shaft and nut may be used as the thread shaft 529 and nuts 530, 540, it may be particularly advantageous to use a ball screw that has a high transmission efficiency and can enhance a position accuracy.

Figure 23:
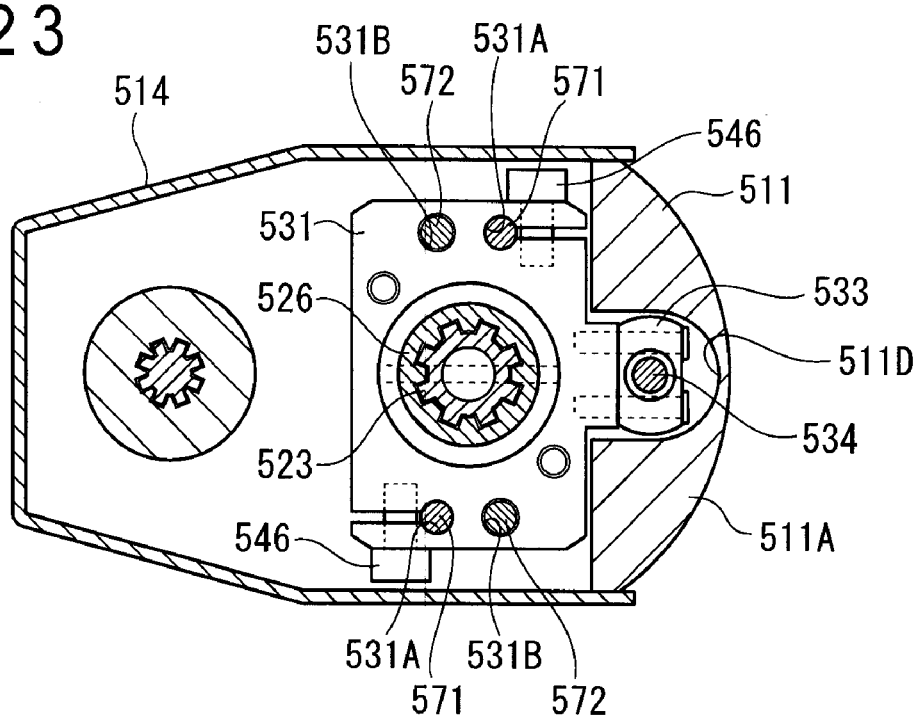
FIG. 23 is a cross-section taken along A-A line in FIG. 21.

The inlet nut 530 is held between an inlet-nut receiving plate 531 and an inlet-nut retainer 532 screwed to the inlet-nut receiving plate 531. As shown in FIG. 23, the inlet-nut receiving plate 531 is substantially square-plate shaped.

A sensor-head guide 533 is screwed to a protruding portion of the inlet-nut receiving plate 531, which protrudes into a concave groove 511D formed on the side plate 511A of the frame 511. A through hole, into which a screw (bolt) 534 is inserted, is provided to the sensor-head guide 533. A sensor head 535 is screwed to a tip end of the screw 534.

A coil spring 537 is arrayed between the sensor-head guide 533 and the sensor head 535. With this arrangement, the sensor head 535 and the screw 534 are biased by the coil spring 537 upwardly, and the screw 534 is held at a position where a head of the screw 534 (a lower end of the screw 534) is engaged with a sensor-head guide 533.

A proximity sensor 536 is fixed to the motor flange 513 facing the sensor head 535. With this arrangement, when the inlet nut 530 is lifted up in accordance with the rotation of the first motor 521 so that the sensor head 535 is integrally lifted up to approach the proximity sensor 536, the proximity sensor 536 detect a proximity state. A detection signal from the proximity sensor 536 is output to a drive control device (drive controller) (not shown).

Even if the sensor 535 abuts on the proximity sensor 536, the coil spring 537 is compressed to displace the position of the sensor head 535, thereby preventing the damage on the proximity sensor 536 and the like.

The measurement nut 540 is stepped cylinder shaped, in which a small-diameter part and large-diameter part are provided. The small-diameter part of the measurement nut 540 is mounted with a bearing 541.

The bearing 541 is held between a measurement-nut receiving plate 542 and a measurement-nut retainer 543 screwed to the measurement-nut receiving plate 542.

Figure 24:
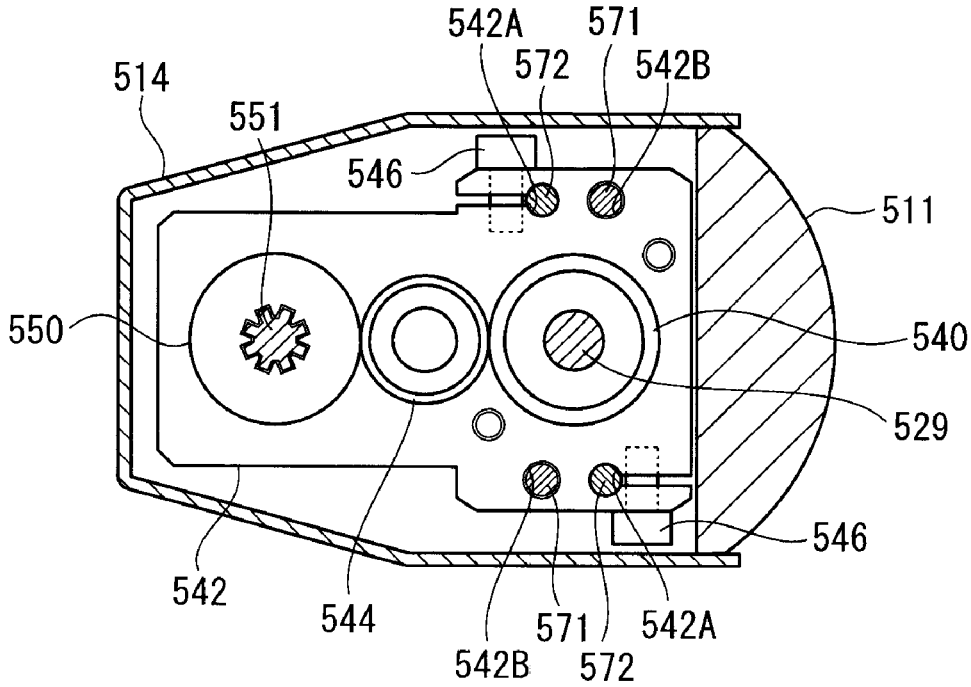
FIG. 24 is a cross-section taken along B-B line in FIG. 21.

As shown in FIG. 24, the measurement-nut receiving plate 524 is rectangular-plate shape in plan view, substantially at a center of which a middle gear 544 is rotatably mounted. The middle gear 544 is screwed with a gear 540A formed on an outer circumference of the large-diameter part of the measurement nut 540.

The measurement-nut receiving plate 542 is provided with: a bearing 545 held between the measurement-nut receiving plate 542 and the measurement-nut retainer 543; and a motor gear 550 supported by the bearing 545 to be rotatable relative to the measurement-nut receiving plate 542. A gear 550A that is screwed to the middle gear 544 is formed on an outer circumference of the motor gear 550. A gear tooth engageable with a motor gear shaft 551 is provided on a through hole formed on a center axis of the motor gear 550.

The motor gear shaft 551 is formed of the spline shaft and linked in a manner integrally rotatable with an output axis of the second motor 522 via a coupling 552. With this arrangement, the motor gear 550 is movable in an up- and down direction along the motor gear shaft 551, and rotatable integrally with the rotation of the motor gear shaft 551.

When the motor gear shaft 551 is rotated by driving the second motor 522 while the first motor 521 is stopped, the measurement nut 540 is rotated via the motor gear 550 and the middle gear 544. At this time, since the thread shaft 529 is not rotated, the measurement nut 540 is moved upwardly/downwardly along the thread shaft 529.

On the other hand, when the thread shaft 529 of a ball screw is rotated by driving the first motor 521 while the second motor 522 is stopped, the inlet nut 530 and the measurement nut 540 are moved upwardly/downwardly.

In addition, when the first motor 521 and the second motor 522 are rotated in the same direction so that the measurement nut 540 and the thread shaft 529 are rotated in the same direction at the same speed, the position of the measurement nut 540 in the up-and-down direction is not changed but remains the same. On the other hand, the inlet nut 530 is moved upwardly/downwardly in accordance with the rotation of the thread shaft 529.

Accordingly, when only the first motor 521 is rotated, the inlet nut 530 and the measurement nut 540 are moved. When only the second motor 522 is rotated, only the measurement nut 540 is moved. When the first motor 521 and the second motor 522 are rotated, only the inlet nut 530 is moved. The movement direction of the nuts 530, 540 is determined by the rotation direction of the motors 521, 522.

With this arrangement, the middle gear 544 and the motor gear 550 define a transmitting gear for transmitting the rotation of the second motor 522 to the measurement nut 540.

Figure 22:
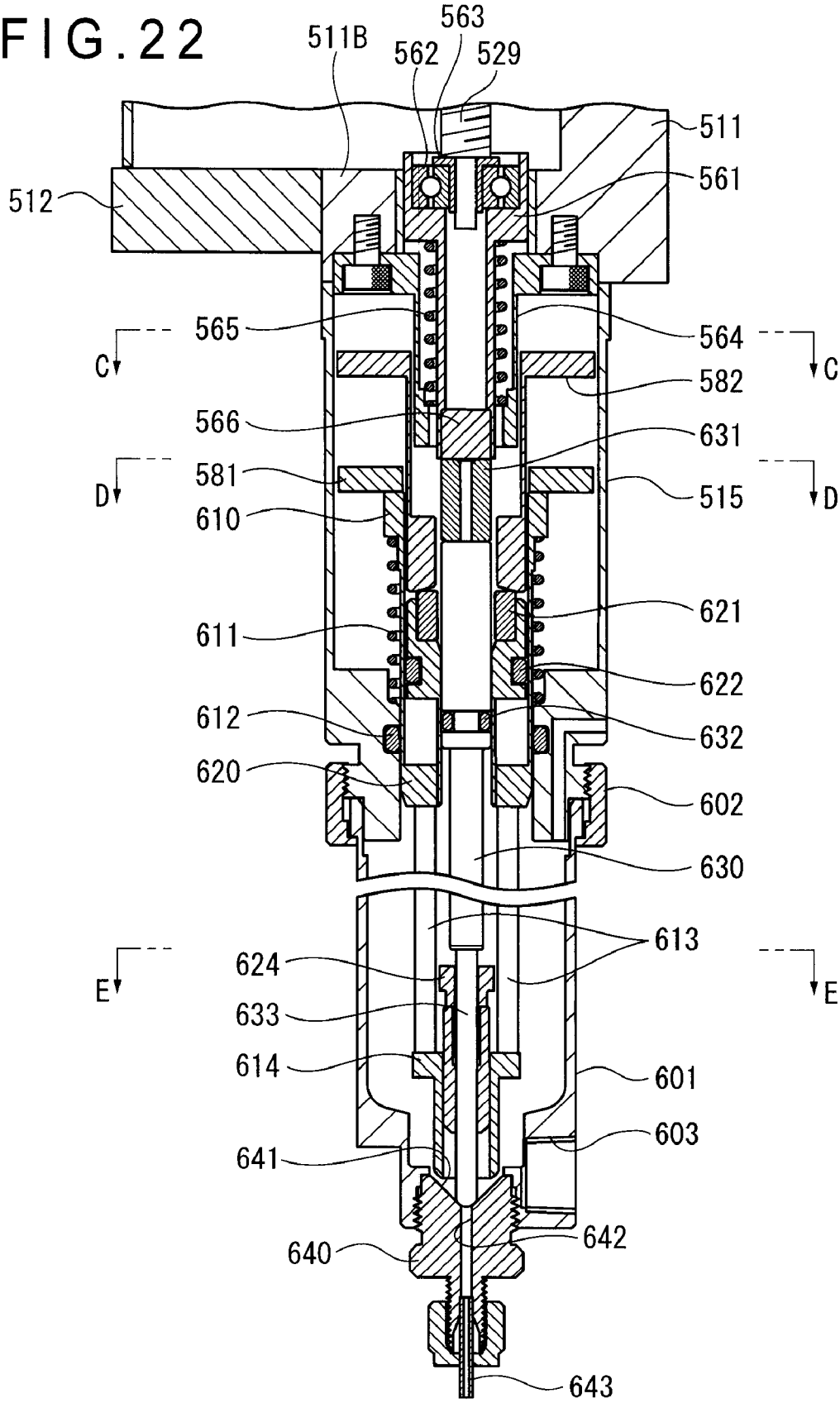
FIG. 22 is a cross-sectional view showing a primary portion of the pump of the liquid discharging device according to the third embodiment.

As shown in FIG. 22, a needle pressing member 561 is arranged on the lower flange 511B of the frame 511 to be movable in an axis direction (up-and-down direction). The needle pressing member 561 includes two cylinders, each of which has a different diameter, thereby providing a small-diameter part and a large-diameter part. The large-diameter part supports the other end of the thread shaft 529 via a bearing 562 and a bush 563 so that the thread shaft 529 is rotatable and upwardly movable relative to the bush 563.

A return-spring receiving member 564 formed of a cylinder member having a flange is screw-fixed to a lower surface of the lower flange 511B of the frame 511. The needle pressing member 561 and a return spring 565 are arranged inside the return-spring receiving member 564.

The return spring 565 is arranged between the return-spring receiving member 564 and the needle pressing member 561, and upwardly biases the needle pressing member 561 relative to the return-spring receiving member 564, i.e., the frame 511 (biases the member toward the thread shaft 529 side).

Figure 20:
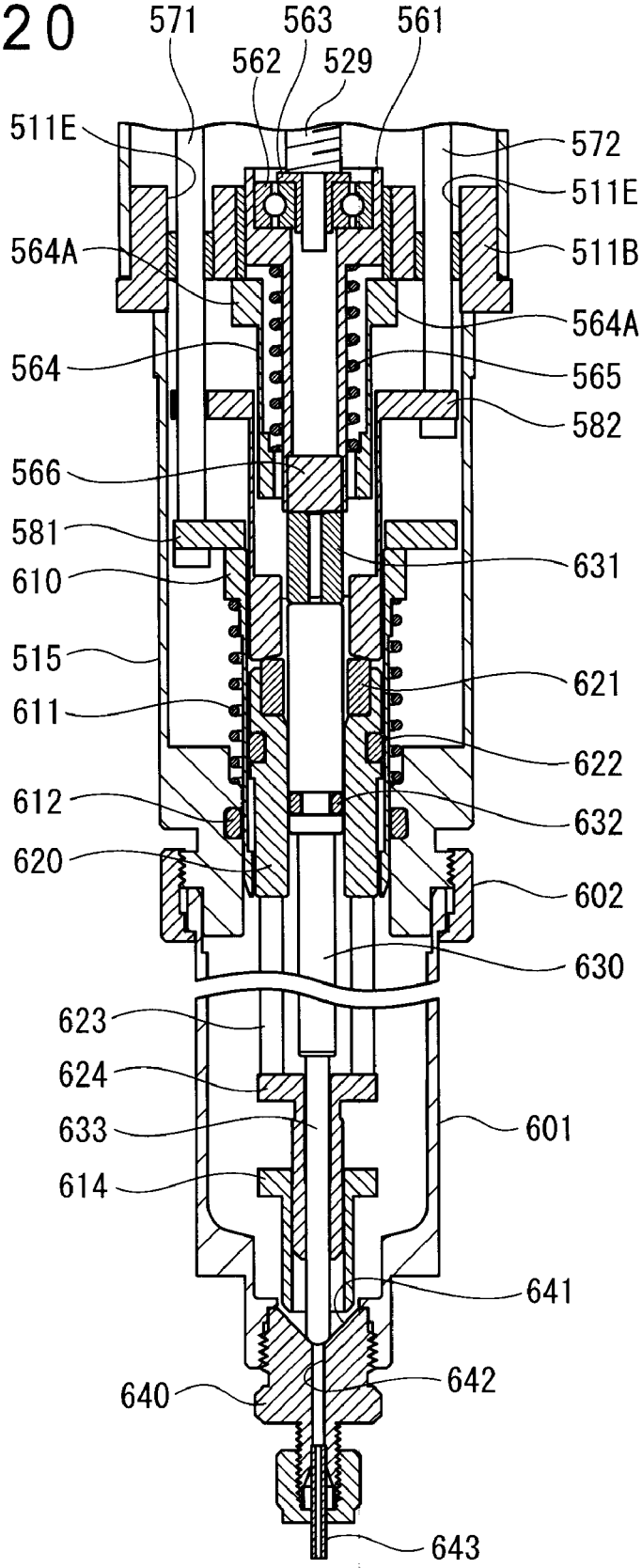
FIG. 20 is a cross-sectional view showing a primary portion of a pump of the liquid discharging device according to the third embodiment.

As shown in FIG. 20, a cutout 564A is provided to the return-spring receiving member 564 at two points facing the flange. As described below, rods 571, 572 are inserted into the cutout 564A, so that the rods 571, 572 do not interfere with the return-spring receiving member 564.

A columnar magnet 566 is fixed on a lower end of the needle pressing member 561.

Figure 19:
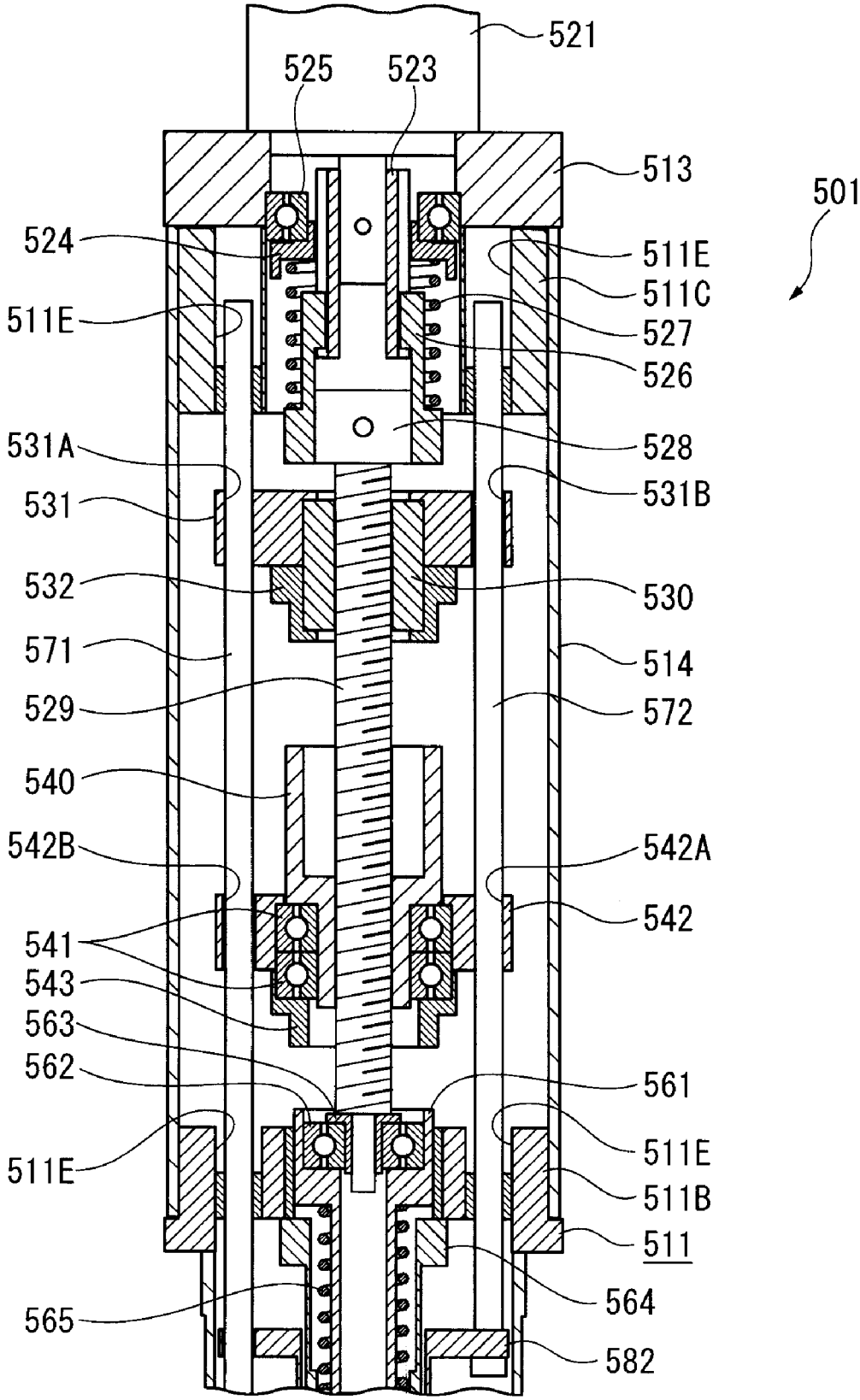
FIG. 19 is a cross-sectional view showing a primary portion of a drive unit of the liquid discharging device according to the third embodiment.

As shown in FIGS. 19 and 20, four guide holes 511E are formed on the upper flange 511C and the lower flange 511B of the frame 511. The inlet rod 571 and the measurement rod 572 are inserted into the guide holes 511E such that the rods 571, 572 are movable in the axial direction (up-and-down direction).

The inlet rod 571 is provided in a pair, and as shown in FIGS. 23 to 26, each of the rods 571 is arranged at a position where the rods 571 each is symmetric about a center axis of the thread shaft 529. The inlet rods 571 are fixed to the inlet-nut receiving plate 531, which is moved in the up-and-down direction together with the inlet nut 530. Accordingly, as the inlet nut 530 is moved in the up-and-down direction by driving the first motor 521, the inlet rod 571 is integrally moved with the inlet nut 530 in the up-and-down direction.

Figure 25:
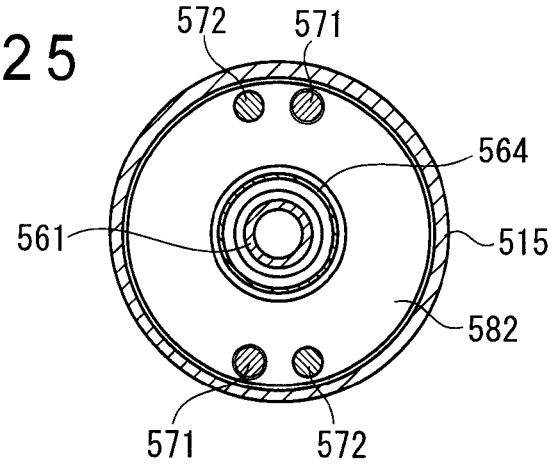
FIG. 25 is a cross-section taken along C-C line in FIG. 22.
Figure 26:
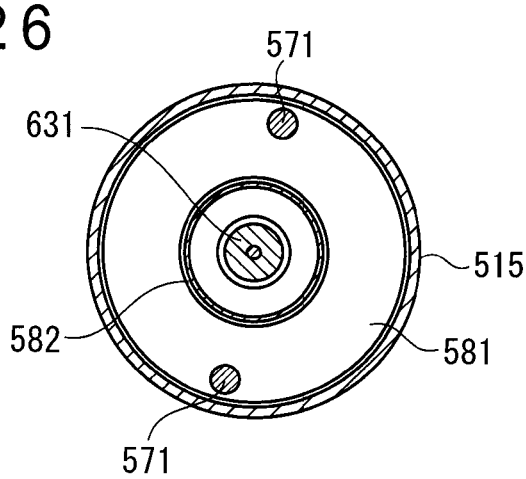
FIG. 26 is a cross-section taken along D-D line in FIG. 22.

The measurement rod 572 is provided in a pair, and as shown in FIGS. 23 to 25, each of the rods 572 is respectively arranged at a position where the rods 572 are symmetric about the center axis of the thread shaft 529. The measurement nut 572 is fixed to the measurement-nut receiving plate 542, which is moved in the up-and-down direction together with the measurement nut 540. Accordingly, as the measurement nut 540 is moved in the up-and-down direction, the measurement rod 572 is integrally moved with the measurement nut 540 in the up-and-down direction.

Incidentally, there are formed on the inlet-nut receiving plate 531 an insert hole 531A into which the inlet rod 571 is inserted to be fixed and an insert hole 531B into which the measurement rod 572 is inserted.

Likewise, there are formed on the measurement-nut receiving plate 542 an insert hole 542A into which the measurement rod 572 is inserted to be fixed and an insert hole 542B into which the inlet rod 571 is inserted.

A slotted groove is formed on the insert holes 531A, 542A. By fastening the slotted groove with a fixing bolt 546, the inlet rod 571 and the measurement rod 572 are immovably fixed to the inlet-nut receiving plate 531 and the measurement-nut receiving plate 542 respectively.

The insert holes 531B, 542B are though holes that have a larger diameter than that of the rods 571, 572. The measurement rod 572 is movable relative to the inlet-nut receiving plate 531 while the inlet rod 571 is movable relative to the measurement-nut receiving plate 542.

A measurement pressing member 582 formed of a cylinder member having a flange is arranged outside of the return-spring receiving member 564. A lower end of the measurement rod 572 is screw-fixed to the flange of the measurement pressing member 582.

A disc-shaped inlet pressing member 581 is arranged outside of the measurement pressing member 582. A lower end of the inlet rod 571 is screw-fixed to the inlet pressing member 581.

[Arrangement of Pump]

The pump 600 includes a container 601 detachably attached to the joint 515 via a cap nut 602.

A substantially cylindrical inlet-spring receiving member 610 is arranged inside the joint 515, a substantially cylindrical measurement guide member 620 is arranged inside the inlet-spring receiving member 610, and a needle rod 630 is arranged inside the measurement guide member 620.

In short, the needle rod 630, measurement guide member 620 and inlet-spring receiving member 610 are concentrically arranged in triplicate inside the joint 515 and the container 601 in this order from the center axis.

An inlet valve return-spring 611 is interposed between the inlet-spring receiving member 610 and the joint 515. The inlet-spring receiving member 610 is upwardly biased by the inlet valve return-spring 611 to be constantly abutted on the inlet pressing member 581.

A concave groove is formed on an inner circumference of the joint 515, in which a seal member 612 such as an o-ring is positioned. With this arrangement, the liquid is prevented from leaking into the drive unit 501 side from between the inlet-spring receiving member 610 and the joint 515.

A ring magnet 620 is mounted to an upper side of the measurement guide member 620. The measurement guide member 620 is detachably mounted to the measurement pressing member 582 using the magnetic force of the ring magnet 621.

A concave groove is formed on an outer circumference of the measurement guide member 620, in which a seal member 622 such as an o-ring is positioned. With this arrangement, the liquid is prevented from leaking into the drive unit 501 side from between the inlet-spring receiving member 610 and the measurement guide member 620.

A magnet receiver 631 is mounted to an upper side of the needle rod 630. The needle rod 630 is detachably mounted to the needle pressing member 561 using the magnetic force acting between the magnet 566 and the magnet receiver 631.

A concave groove is formed on an outer circumference of the needle rod 630, in which a seal member 632 such as an o-ring is positioned. With this arrangement, the liquid is prevented from leaking into the drive unit 501 side from between the measurement guide member 620 and the needle rod 630.

Ends of a pair of inlet valve rods 613 are fixed to the inlet-spring receiving member 610. The other ends of the inlet valve rods 613 are mounted with an inlet valve member 614.

The inlet valve member 614 is substantially a cylinder having a flange, a tip end of which is tapered so as to closely fit to a tapered inner surface of the container 601 described below.

Figure 27:
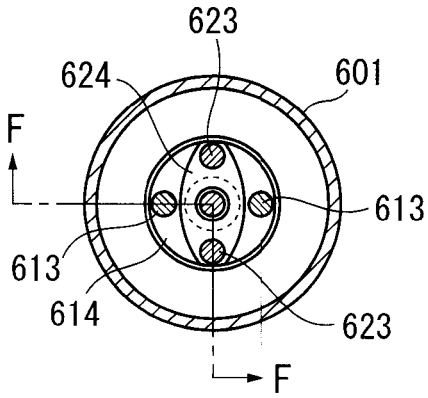
FIG. 27 is a cross-section taken along E-E line in FIG. 22.

Ends of a pair of measurement plunger rods 623 are fixed to the measurement guide member 620. As shown in FIG. 27, the measurement plunger rods 623 are arranged such that an orientation of the measurement plunger rods 623 is perpendicular to that of the inlet valve rods 613 in an axis-perpendicular direction of the liquid discharging device 500, whereby the rods 613, 623 avoid interfering with each other.

Connecting the other ends of the measurement plunger rod 623, a measurement plunger member 624 is fixed on the measurement plunger rod 623. The measurement plunger member 624 is substantially a cylinder having a flange, the flange part of which is shaped substantially in an elliptic plate so as to avoid interference with the inlet valve rod 613. A lower end side of the measurement plunger member 624 is inserted into the through hole formed on the center axis of the inlet valve member 614.

An end of a rod-shaped needle 633 is fixed to the needle rod 630.

The other end of the needle 633 is inserted into the through hole formed on the center axis of the measurement plunger member 624. An end surface of the needle 633 is formed to be spherical, and the needle 633 is adapted to open/close a discharge outlet 642 provided to the container 601 as described below.

The needle pressing member 561, needle rod 630 and needle 633 joined by the magnet 566 are upwardly biased by the return spring 565. On the other hand, the coil spring 527 downwardly biases the needle pressing member 561, needle rod 630 and needle 633 via the thread shaft 529, bush 563 and bearing 562. Since the biasing force of the coil spring 527 is set to be larger than that of the return spring 565, the needle 633 generally abuts on and closes the discharge outlet 642.

The container 601 includes: a container body 601A whose one end side is mounted to the joint 515 via the cap nut 602; and a valve sheet 640 mounted to the other end of the container body 601A. A liquid housing space is defined by the inner space of the container 601.

On one end surface of the valve sheet 640 facing the inner surface of the container 601, a taper hole portion 641 is formed whose diameter is gradually reduced. The discharge outlet 642 is provided between the taper hole portion 641 and the other end surface of the valve sheet 640, penetrating the taper hole portion 641 and the other end surface of the valve sheet 640.

The discharge outlet 642 communicate with a nozzle 643 fixed to the valve sheet 640, such that the liquid inside the container 601 is discharged to the outside of the liquid discharging device 500 via the discharge outlet 642 of the valve sheet 640 and the nozzle 643.

Although the liquid may be supplied into the container 601 after detaching the container 601 from the joint 515, a port 603 communicating with the inside of the container 601 is provided in the present embodiment such that the liquid may be supplied without detaching the container 601. In short, the port 603 is connected with an exterior container (not shown) via a tube (not shown). The exterior container is provided with a liquid-level gauge (not shown) for detecting the liquid level inside the exterior container. The liquid is supplied into the exterior container from a tank through a valve that is controlled in accordance with the liquid level detected by the liquid-level detector. With this arrangement, the valve is controlled to be opened to supply the liquid into the exterior container when the liquid level inside the exterior container is lowered to a predetermined level, while the valve is controlled to be closed when the liquid is filled to a predetermined level. In this manner, the liquid can be constantly supplied into the container 601 from the exterior container via the tube. Accordingly, the liquid discharging device 500 may be automatically operated consecutively for twenty four hours.

The needle 633 abuts on an opening of the discharge outlet 642 and is adapted to open and close the discharge outlet 642, thereby providing a discharge-outlet opening/closing member. The inlet valve member 614 abuts on the taper hole 641 and is adapted to open and close a liquid supplier communicating with the inside of the container 601 and the discharge outlet 642, thereby providing a supplier opening/closing member. As will be described below, when the inlet valve member 614 abuts on the taper hole 641 to close the supplier and the measurement plunger member 624 is moved toward the discharge outlet 642 side while the outlet 642 is opened, the liquid pooled inside the inlet valve member 614 is discharged from the discharge outlet 642. In this manner, the measurement plunger member 624 provides a discharging member.

A supplier opening/closing driver is provided by the inlet valve rod 613 that moves the inlet valve member 614 as the supplier opening/closing member downwardly (in a first direction) and upwardly (in a second direction), the inlet-spring receiving member 610, the inlet valve return-spring 611, the inlet pressing member 581, the inlet rod 571, the inlet-nut receiving plate 531, the inlet nut 530, the thread shaft 529, the first motor 521 and the like.

A discharging driver is provided by the measurement plunger rod 623 that moves the measurement plunger member 624 as the discharging member in the up-and-down direction, the measurement guide member 620, the measurement pressing member 582, the measurement rod 572, the measurement-nut receiving plate 542, the measurement nut 540, the middle gear 544, the motor gear 550, the motor gear shaft 551, the second motor 522 and the like.

A body of the liquid discharging device 500 includes the container 601, the joint 515, the frame 511 and the like.

[Explanation of Discharging Operation]

Next, a liquid discharging operation of the liquid discharging device 500 according to the present embodiment will be explained below with reference to FIGS. 28 to 47 explaining the operation and the timing chart of FIG. 48. Incidentally, FIGS. 29, 31, 33, 35, 37, 39, 41, 43, 45 and 47 are cross-sections taken along F-F line in FIG. 27, and illustrate both the inlet valve rod 613 and the measurement plunger rod 623.

Figure 48:
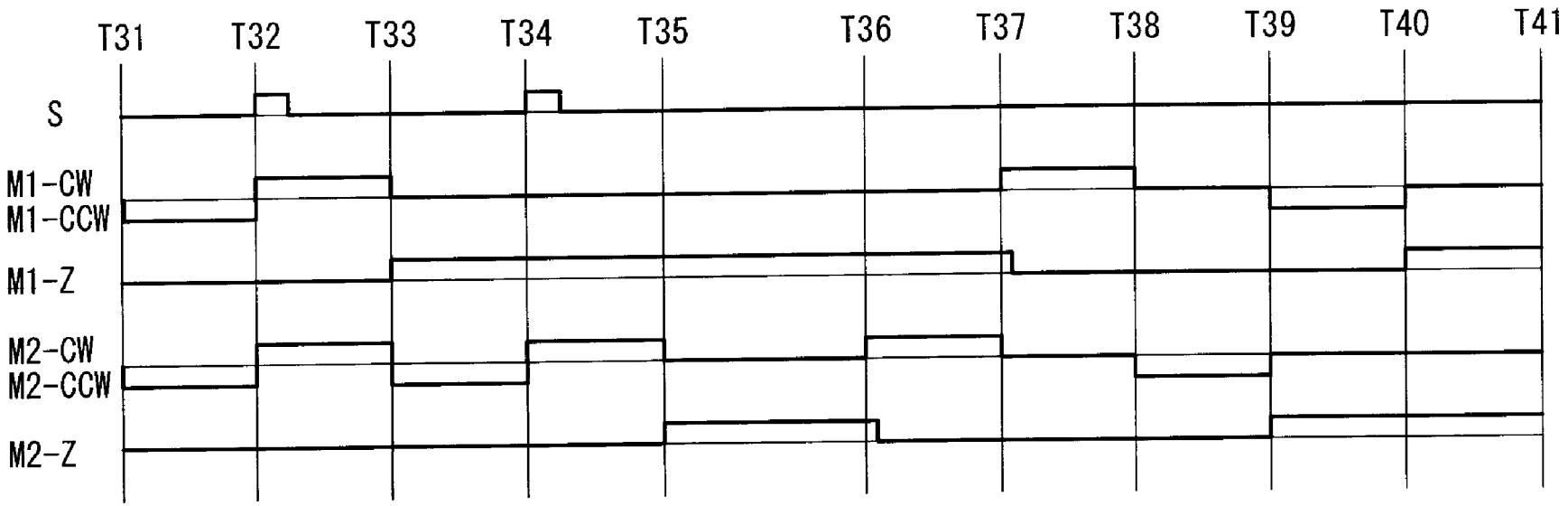
FIG. 48 is a timing diagram explaining operations according to the third embodiment.

In the timing chart of FIG. 48: S represents a detection signal from the proximity sensor 536; M1-CW represents a signal rotating the first motor 521 in a CW direction; M1-CCW represent a signal rotating the first motor 521 in a CCW direction; M1-Z represents a Z-phase signal of the first motor 521; M2-CW represents a CW-direction signal of the second motor 522; M2-CCW represents a CCW-direction signal of the second motor 522; and M2-Z represents a Z-phase signal of the second motor 522.

Each of T31 to T41 represents: an original point setting operation starting point (T31); a state in which the proximity sensor 536 is turned on due to the upward movement of the inlet nut 530 (T32); a detecting point of Z-phase of the first motor 521 (T33); a state in which the proximity sensor 536 is turned on due to the movement of the measurement nut 540 (T34); a detecting point of Z-phase of the second motor 522; an original point state of the pump operation (T36); a suctioning process completion point (T37); a completion of a first valve-switching process to switch to a state of the inlet valve closure and discharge outlet opening (T38); a discharging process completion point (T39); a completion of a second valve-switching process to switch to a state of the inlet valve opening and discharge outlet closure (T40); and an original point recovering state (T41).

[Original Point Setting]

In the present embodiment, the original points of the motors 521, 522 are initially set since the rotary operation of the motors 521, 522 is controlled with a driving pulse number.

Figure 28:
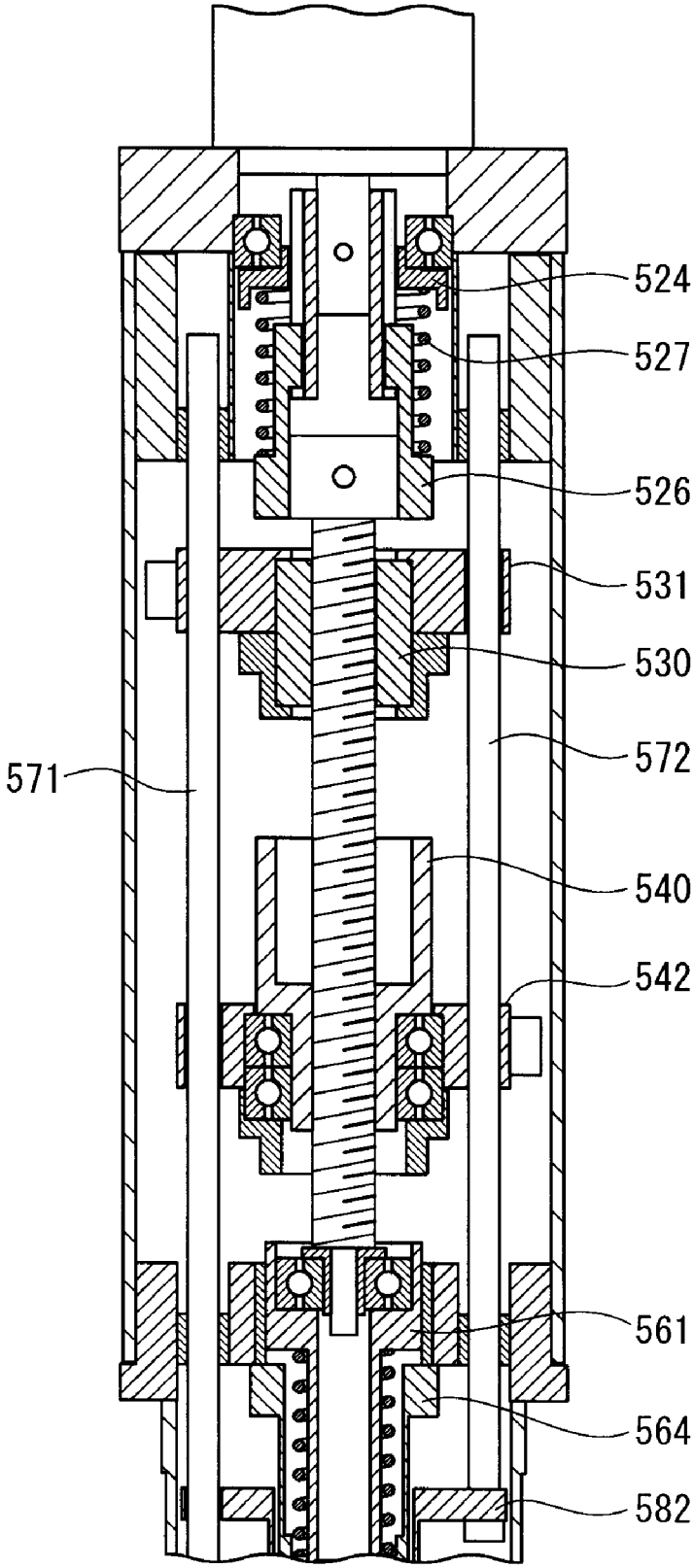
FIG. 28 is a cross-sectional view showing the drive unit when an original point setting operation is started according to the third embodiment.
Figure 29:
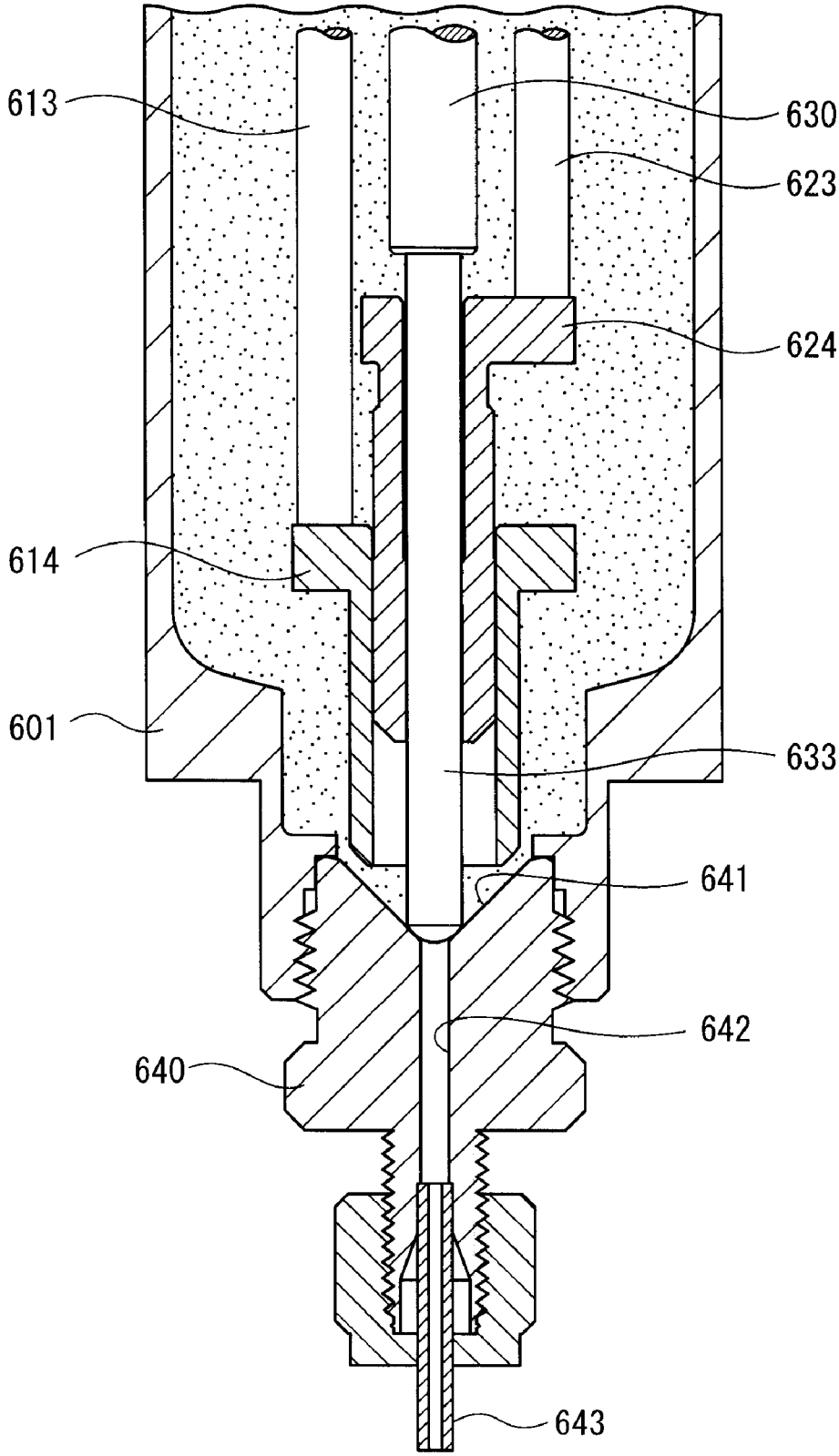
FIG. 29 is a cross-sectional view showing the pump when the original point setting operation is started according to the third embodiment.

When the original point setting process is started, the needle 633 biased by the coil spring 527 abuts on and closes the discharge outlet 642 as shown in FIGS. 28 and 29.

Figure 30:
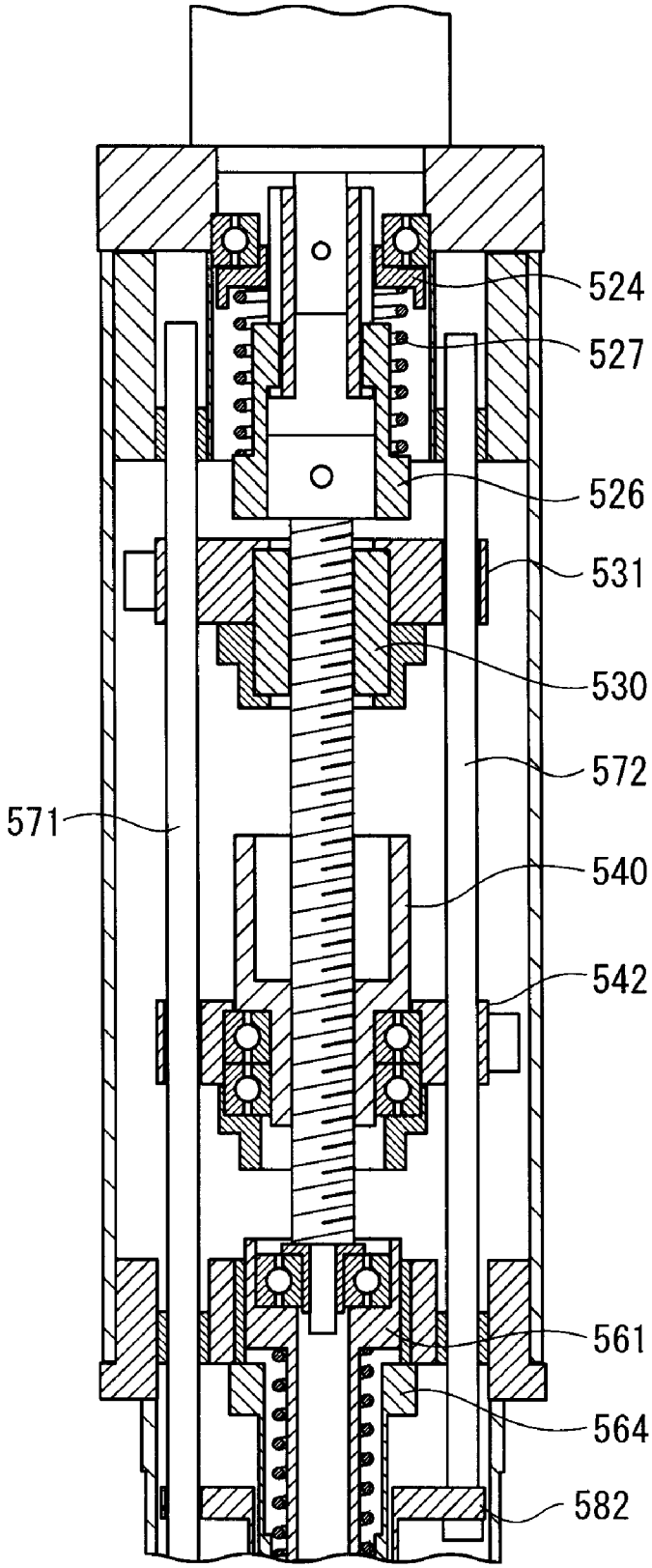
FIG. 30 is a cross-sectional view showing the drive unit when a first motor is moved to a position where a proximity sensor is turned on according to the third embodiment.
Figure 31:
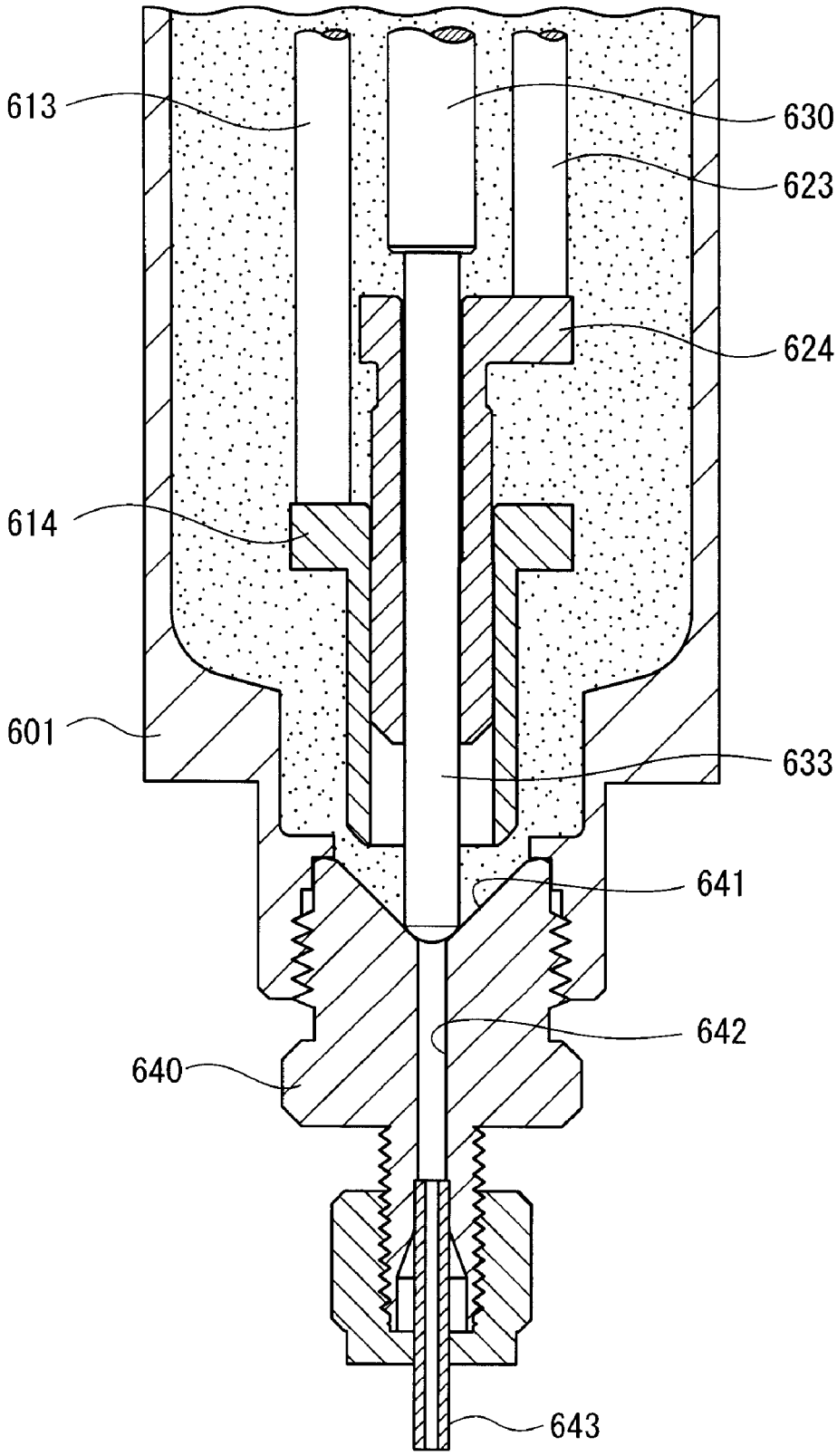
FIG. 31 is a cross-sectional view showing the pump when the first motor is moved to the position where the proximity sensor is turned on according to the third embodiment.

Once the original point setting process is started, the drive control device rotates the two motors 521, 522 in a CCW direction (counterclockwise direction seen from the output axis of the motor). In accordance with the rotation of the first motor 521, the thread shaft 529 is rotated in the CCW direction, and the inlet nut 530 is upwardly moved as shown in FIGS. 30 and 31. On the other hand, since the measurement nut 540 is rotated in the CCW direction via the motor gear shaft 551, motor gear 550 and middle gear 544 in accordance with the CCW-direction rotation of the second motor 522, the thread shaft 529 and the measurement nut 540 are rotated in the same direction at the same speed, such that the measurement nut 540 stays at the same position without moving in the up-and-down direction.

In accordance with the upward movement of the inlet nut 530, the sensor head 535 gradually approaches the proximity sensor 536. When the sensor head 535 approaches the sensor 536 up to a predetermined distance, the proximity sensor 536 is turned on to output a detection signal.

Once the proximity sensor 536 is turned on, the drive control device rotates the two motors 521, 522 in CW direction (a clockwise direction seen from the output axis of the motor).

Figure 32:
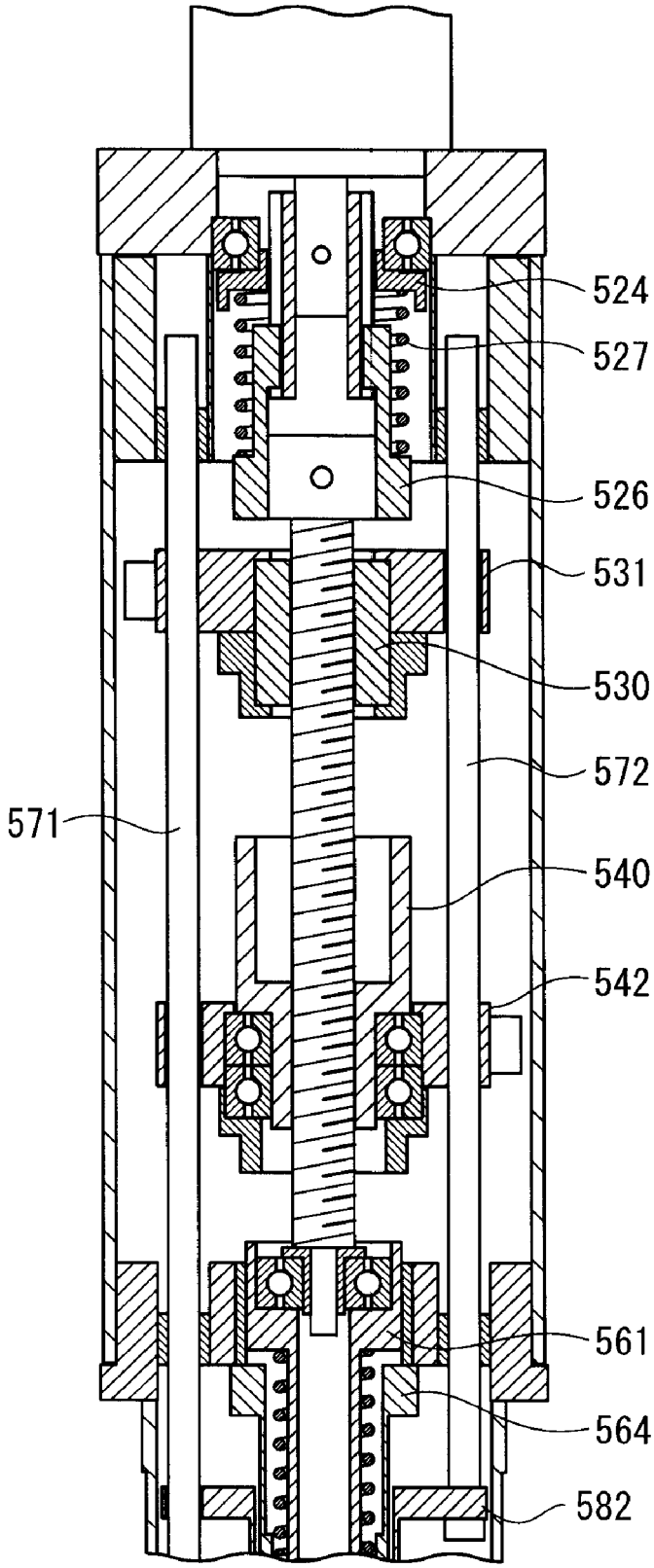
FIG. 32 is a cross-sectional view showing the drive unit when the first motor is moved to an original point position according to the third embodiment.
Figure 33:
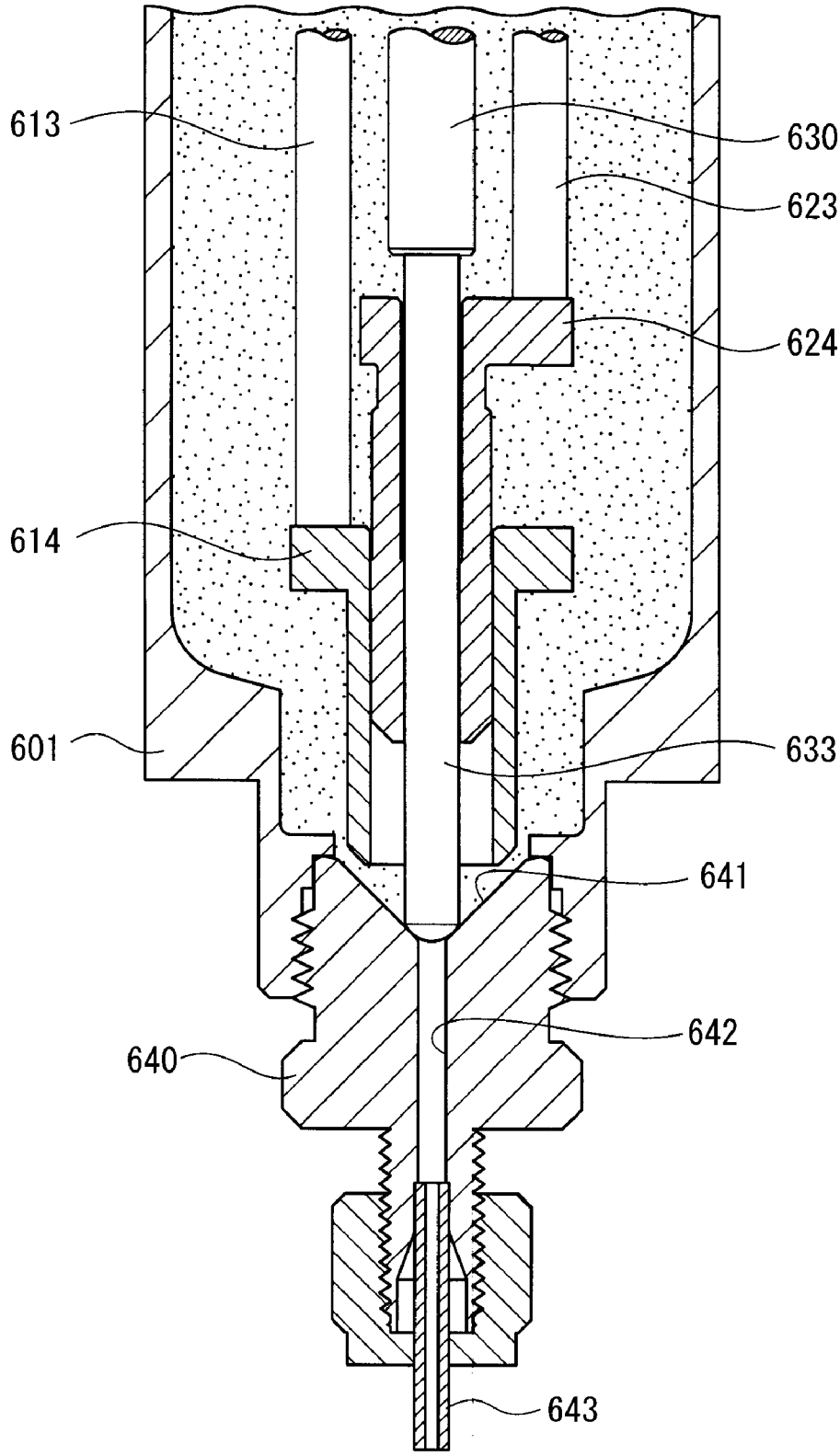
FIG. 33 is a cross-sectional view showing the pump when the first motor is moved to the original point position according to the third embodiment.

In accordance with the CW-direction rotation of the first motor 521, the inlet nut 530 is downwardly moved as shown in FIGS. 32 and 33, and the sensor head 535 moves gradually away from the proximity sensor 536, such that the output from the proximity sensor 536 is stopped.

After the output from the proximity sensor 536 is stopped, a Z-phase (C-phase) signal that is output by one pulse per one output shaft rotation is detected from the first motor 521. Once an output pulse is detected, the first motor 521 is stopped, and the position of the first motor 521 is set as the original point. In short, when the inlet nut 530 and the inlet valve member 614, which are driven by the first motor 521, are at positions shown in FIGS. 32 and 33, the positions are set as the original point position.

On the other hand, since the thread shaft 529 and the measurement nut 540 are rotated in the same direction at the same speed when the motors 521, 522 are rotated in the CW direction, the measurement nut 540 is not vertically moved and stays at the same position.

Figure 34:
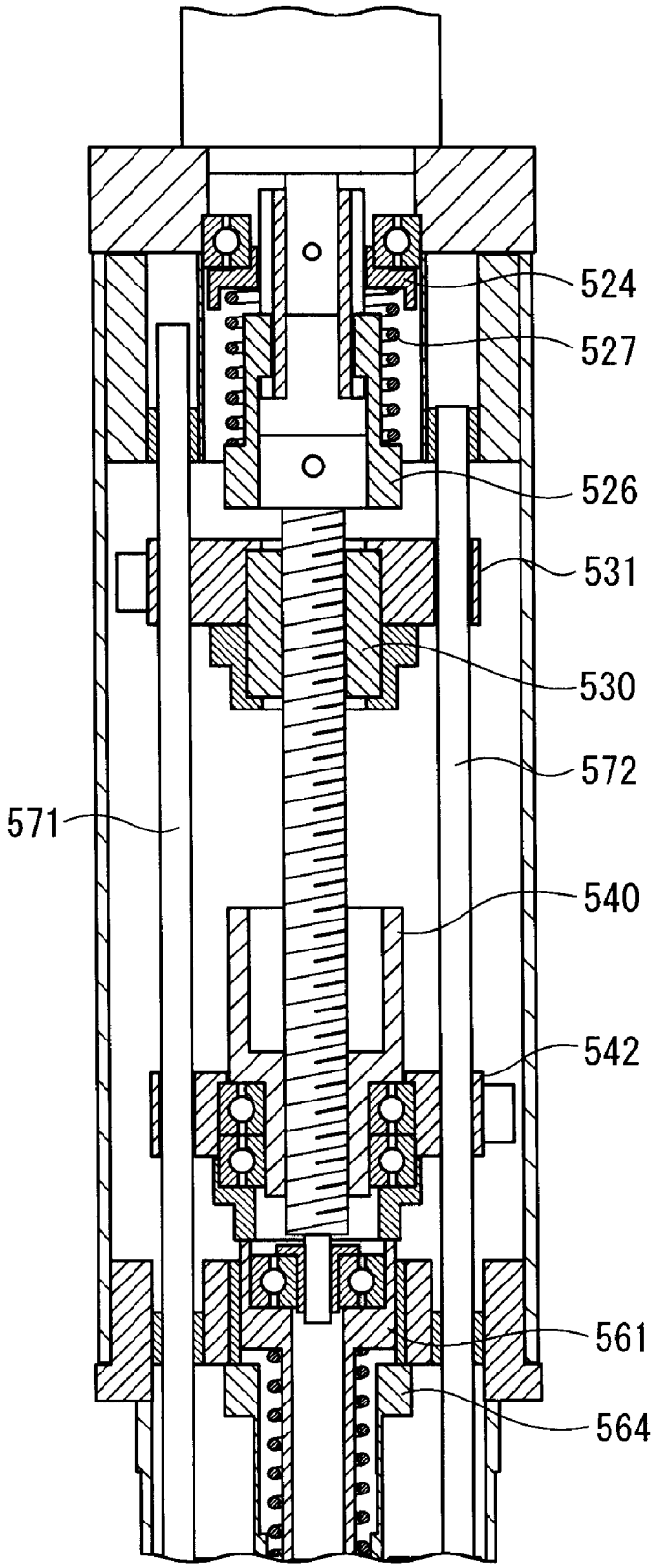
FIG. 34 is a cross-sectional view showing the drive unit when a second motor is moved to the position where the proximity sensor is turned on according to the third embodiment.
Figure 35:
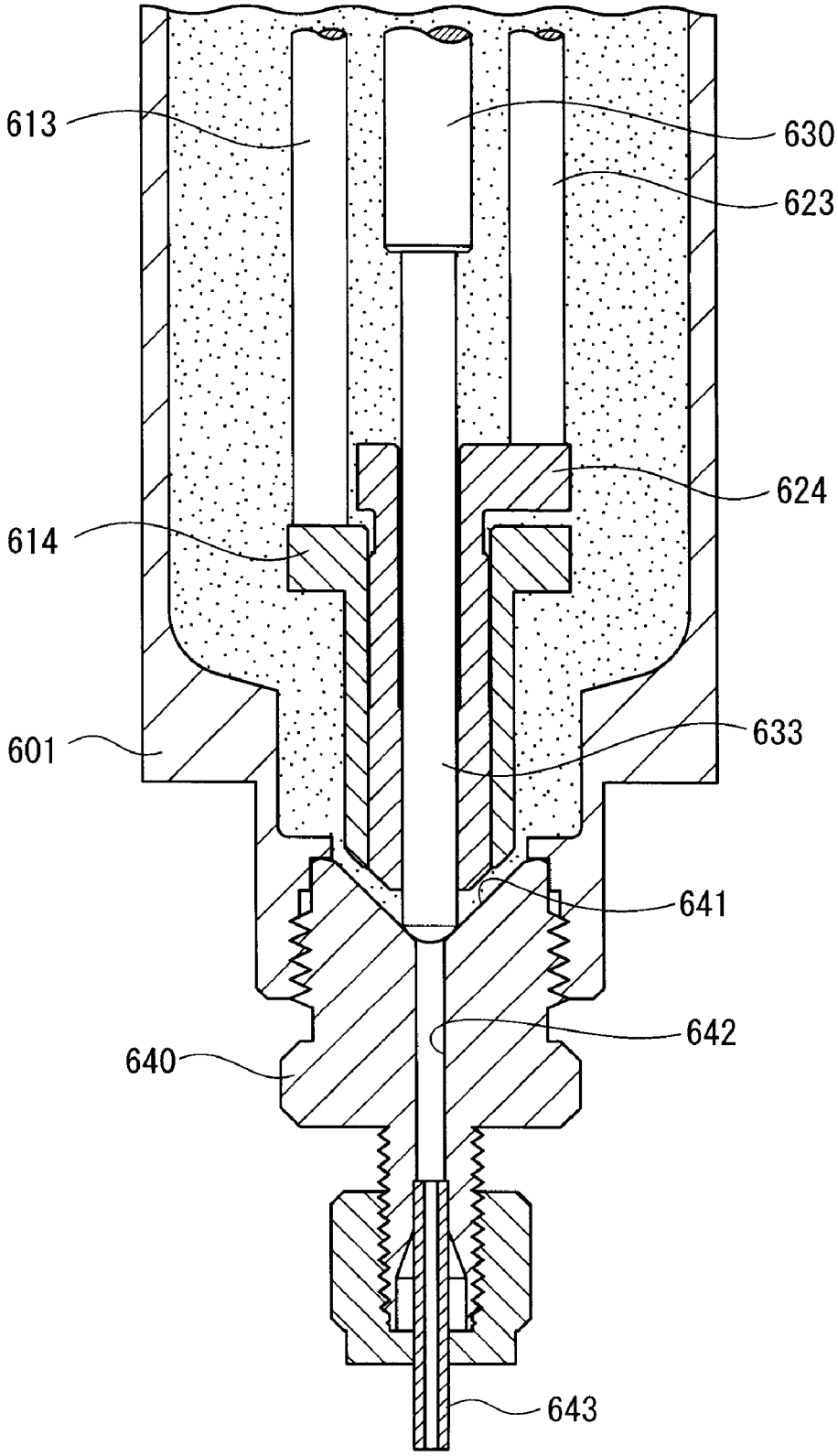
FIG. 35 is a cross-sectional view showing the pump when the second motor is moved to the position where the proximity sensor is turned on according to the third embodiment.

The drive control device drives the second motor 522 to be rotated as soon as the first motor 521 is stopped following the detection of the Z-phase of the first motor 521. When the measurement nut 540 is rotated by the second motor 522 in the CCW direction while the thread shaft 529 is stopped, the measurement nut 540 is downwardly moved as shown in FIGS. 34 and 35. Then, the measurement-nut retainer 543 being integrally moved with the measurement nut 540 abuts on the needle pressing member 561. Since the needle pressing member 561 is biased by the coil spring 527 to reach the stroke end position and not capable of further downward movement, the thread shaft 529 is moved against the biasing force of the coil spring 527 in the upper direction. In short, the thread shaft 529 is upwardly moved relative to the bush 563.

When the thread shaft 529 is upwardly moved, the inlet nut 530 not having been rotated relative to the thread shaft 529 is also upwardly moved together with the thread shaft 529, and the sensor head 535 approached the proximity sensor 536.

At this time, the needle pressing member 561 is pressed by the measurement-nut retainer 543 that is integrally moved with the measurement nut 540, such that the needle 633 remains in contact with the discharge outlet 642 irrespective of the upward movement of the thread shaft 529.

Figure 36:
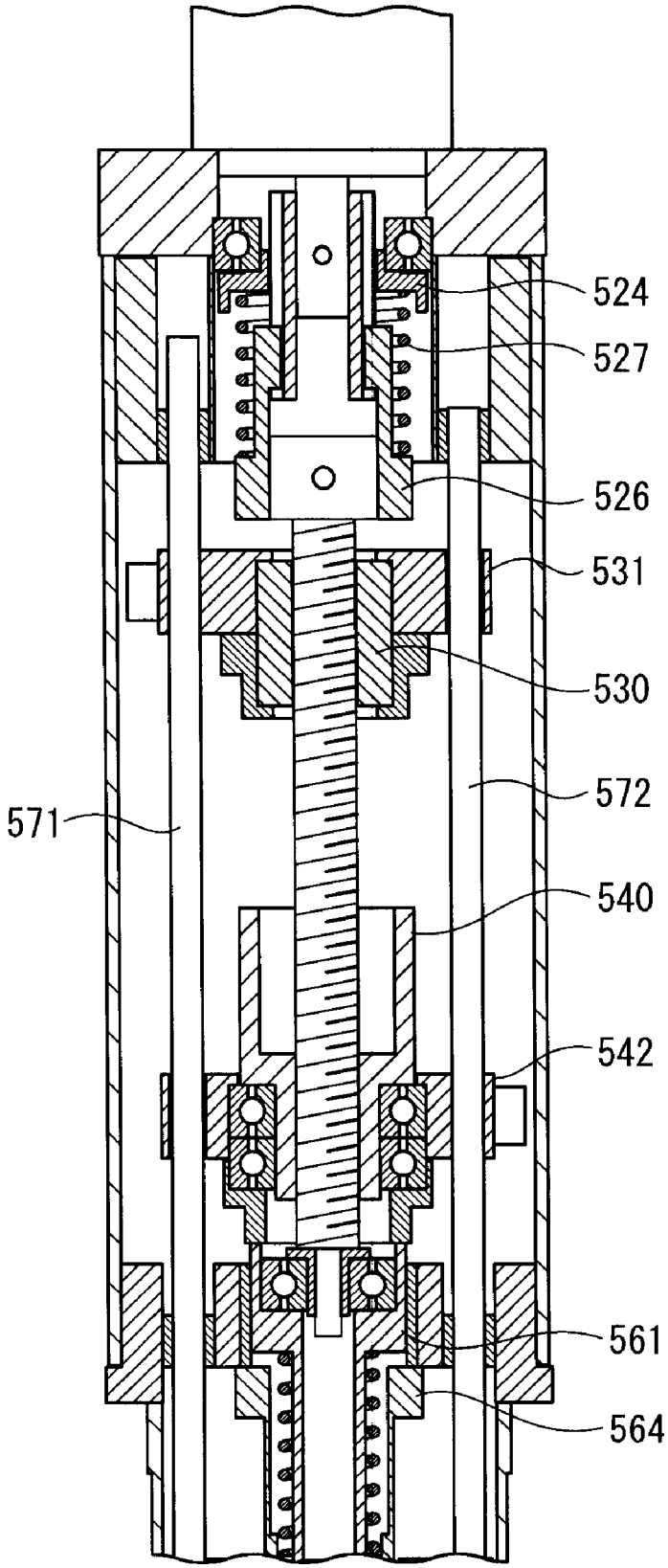
FIG. 36 is a cross-sectional view showing the drive unit when the second motor is moved to the original point position such that the original point setting operation is completed according to the third embodiment.
Figure 37:
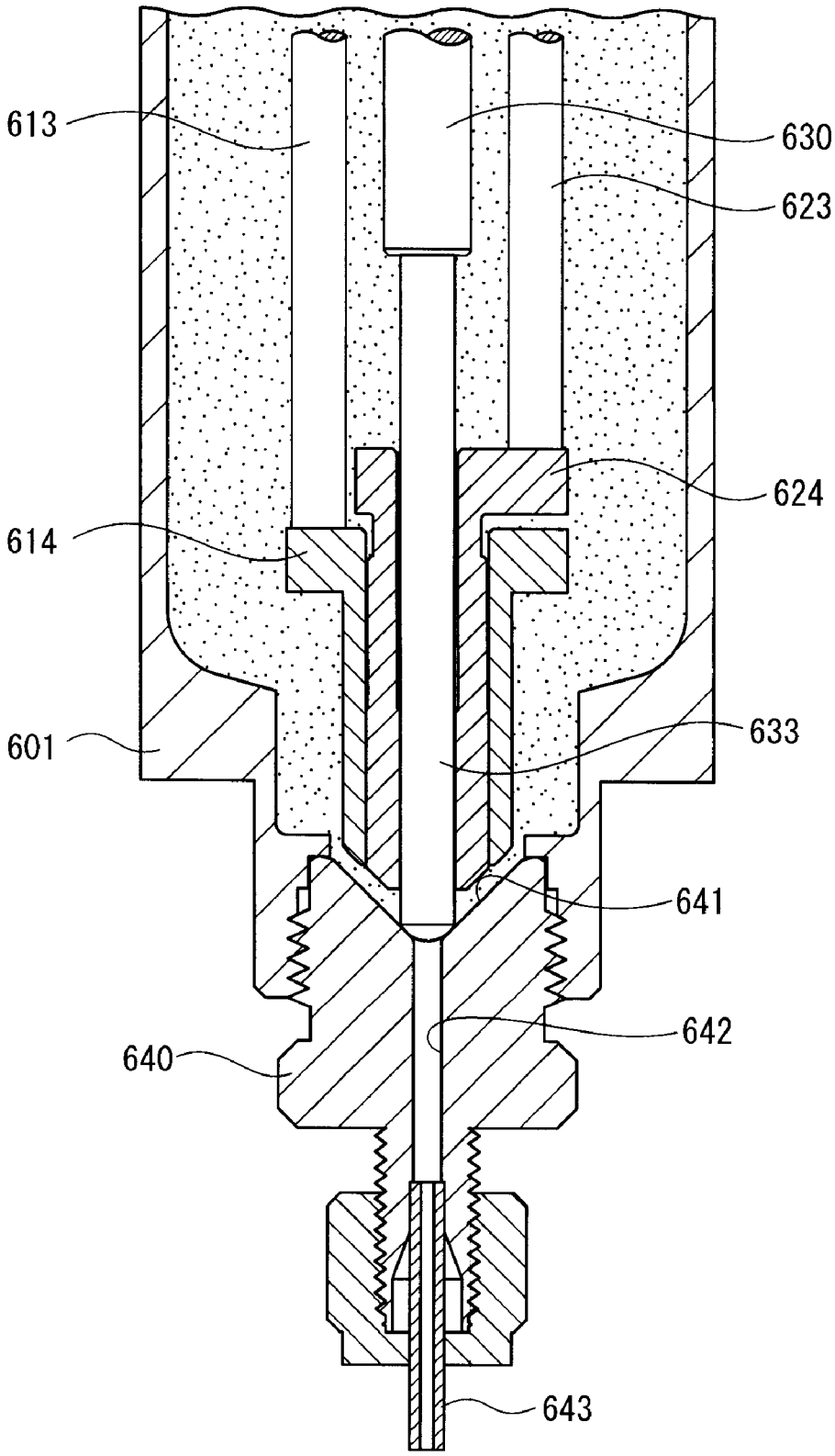
FIG. 37 is a cross-sectional view showing the drive unit when the second motor is moved to the original point position such that the original point setting operation is completed according to the third embodiment.

Once the sensor head 535 approaches the proximity sensor 536 and a detection signal is output, the drive control device drives the second motor 522 to be rotated in the CW direction. Subsequently, as shown in FIGS. 36 and 37, the measurement nut 540 is rotated in the CW direction and the thread shaft 529 is downwardly moved. At the same time, since the sensor head 535 moves away from the proximity sensor 536, the output of the detection signal from the proximity sensor 536 is stopped.

After the output from the proximity sensor 536 is stopped, a Z-phase (C-phase) signal that is output by one pulse per one output shaft rotation is detected from the second motor 522. Once an output pulse is detected, the second motor 522 is stopped, and the position of the second motor 522 is set as the original point.

Incidentally, while the original point position of the second motor 522 is being set, either of the thread shaft 529 biased by the coil spring 527 or the measurement-nut retainer 543 integrated with the measurement nut 540 screwed to the thread shaft 529 abuts on the needle pressing member 561 to bias the needle 633. Accordingly, the needle 633 remains to be biased to close the discharge outlet 642.

[Original Point State (Initial State)]

Figure 38:
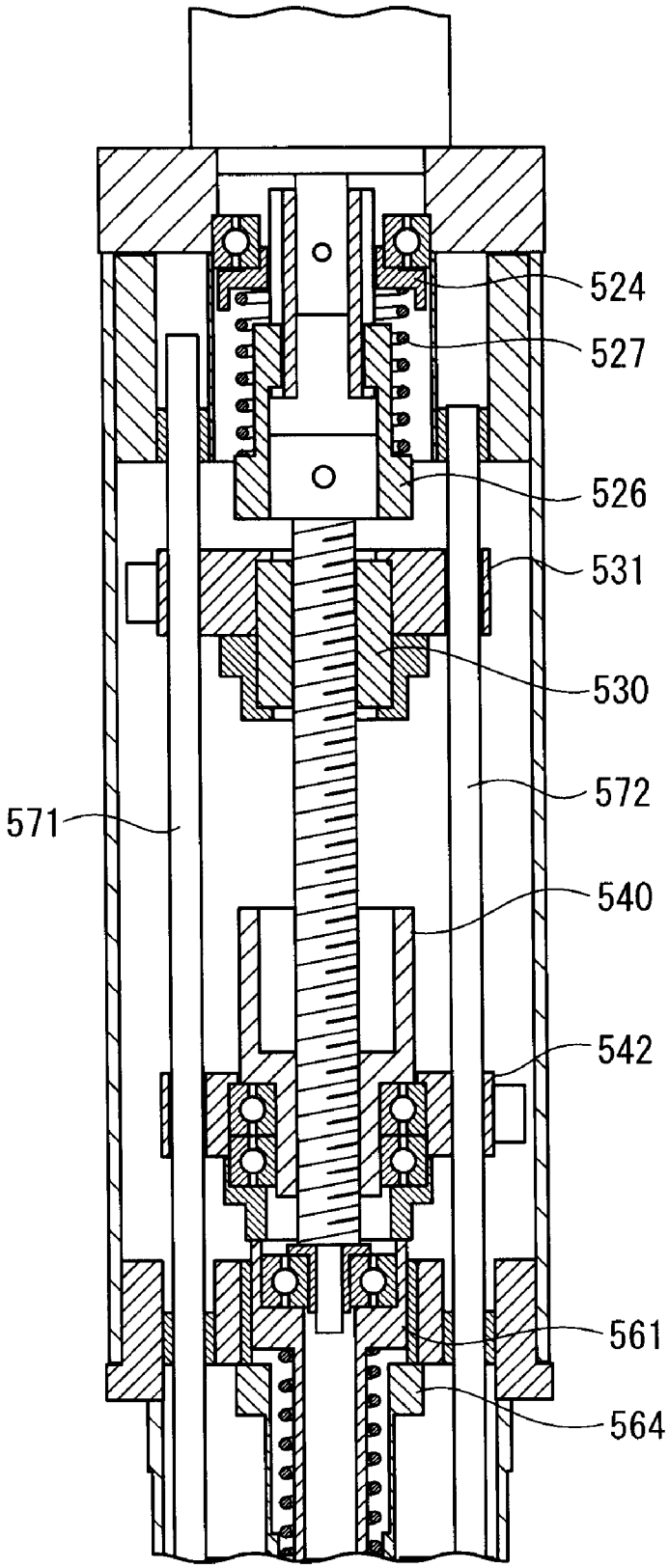
FIG. 38 is a cross-sectional view showing the drive unit when a pumping operation is started (original point state) according to the third embodiment.
Figure 39:
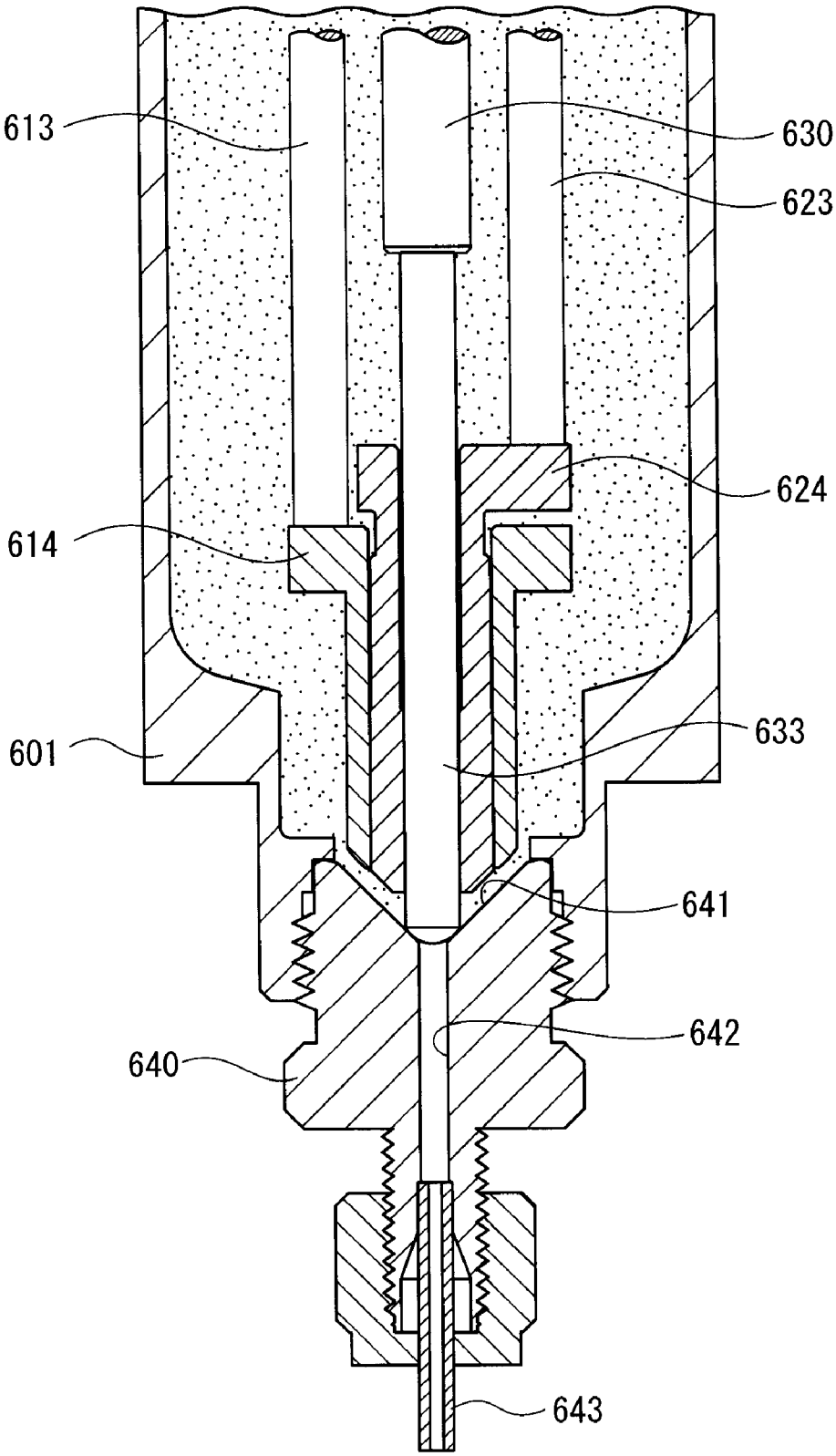
FIG. 39 is a cross-sectional view showing the pump when the pumping operation is started (original point state) according to the third embodiment.

Throughout the above processes, the original point of the motors 521, 522 are set, and the liquid discharging device 500 is set to be in an original point state as shown in FIGS. 36 and 37 (FIGS. 38 and 39 show the same). Operations performed after the original point setting are controlled with the driving pulse number input into the motors 521, 522.

As shown in FIG. 39, before the start of the operations, i.e., in a non-driven state where the liquid discharging device 500 is stopped (state of original point), the needle 633 is set to abut on the opening of the discharge outlet 642 to close the discharge outlet 642. In the present embodiment, the measurement plunger member 624 moved together with the measurement nut 540 is at a lower stroke end position in the original point state. Dimension such as length of the measurement plunger rod 623 and the needle 633 is set such that the measurement plunger rod 623 and the needle 633 are slightly away from the taper hole portion 641 of the valve sheet 640 when the measurement plunger member 624 is at the lower stroke end position.

Dimension such as length of the inlet valve rod 613 and the inlet valve member 614 is set such that a tip end of the inlet valve member 614 upwardly/downwardly moved together with the inlet nut 530 is located away for a predetermined distance from the taper hole portion 641 of the valve sheet 640.

[Suctioning (Measuring) Process]

Next, while keeping the first motor 521 non-driven, the drive control device drives only the second motor 522 to rotate in the CW direction for an amount proportional to a predetermined discharge-setting pulse number.

Figure 40:
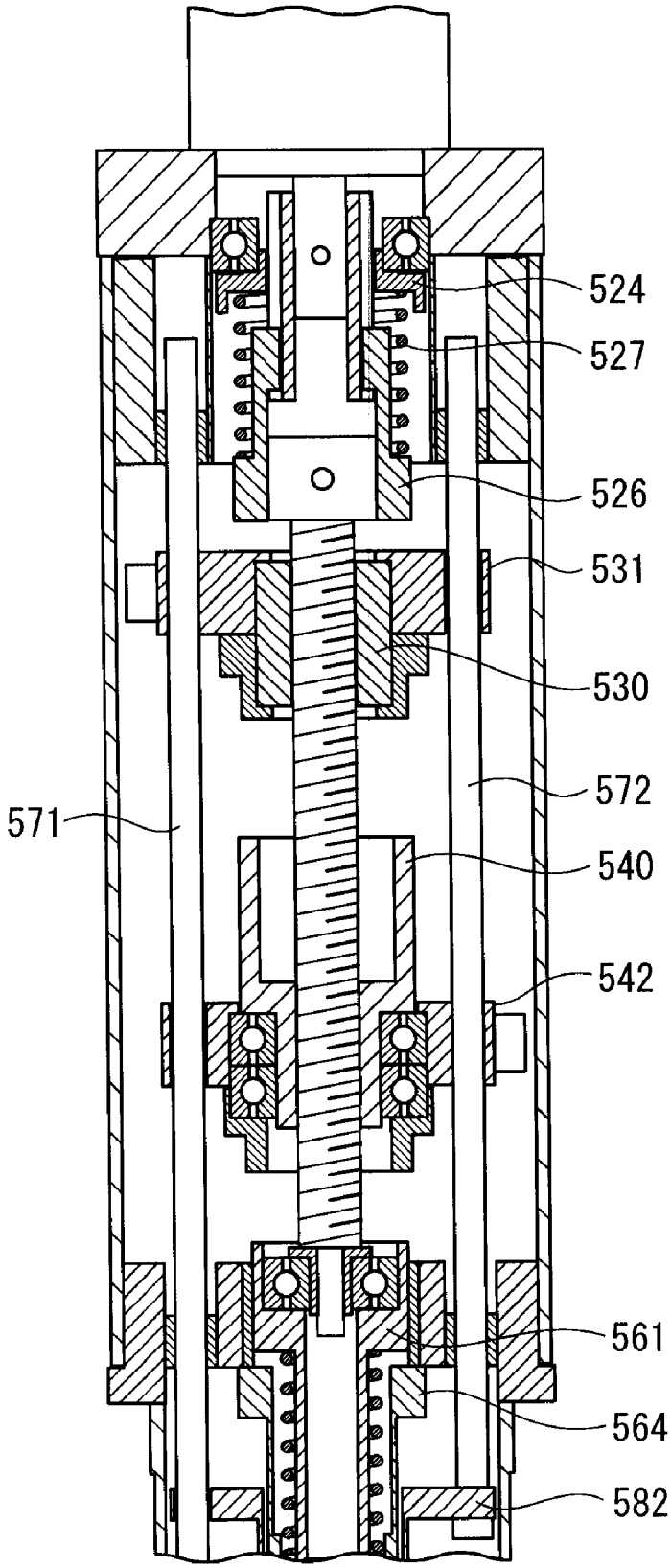
FIG. 40 is a cross-sectional view showing the drive unit when a suctioning process is completed according to the third embodiment.
Figure 41:
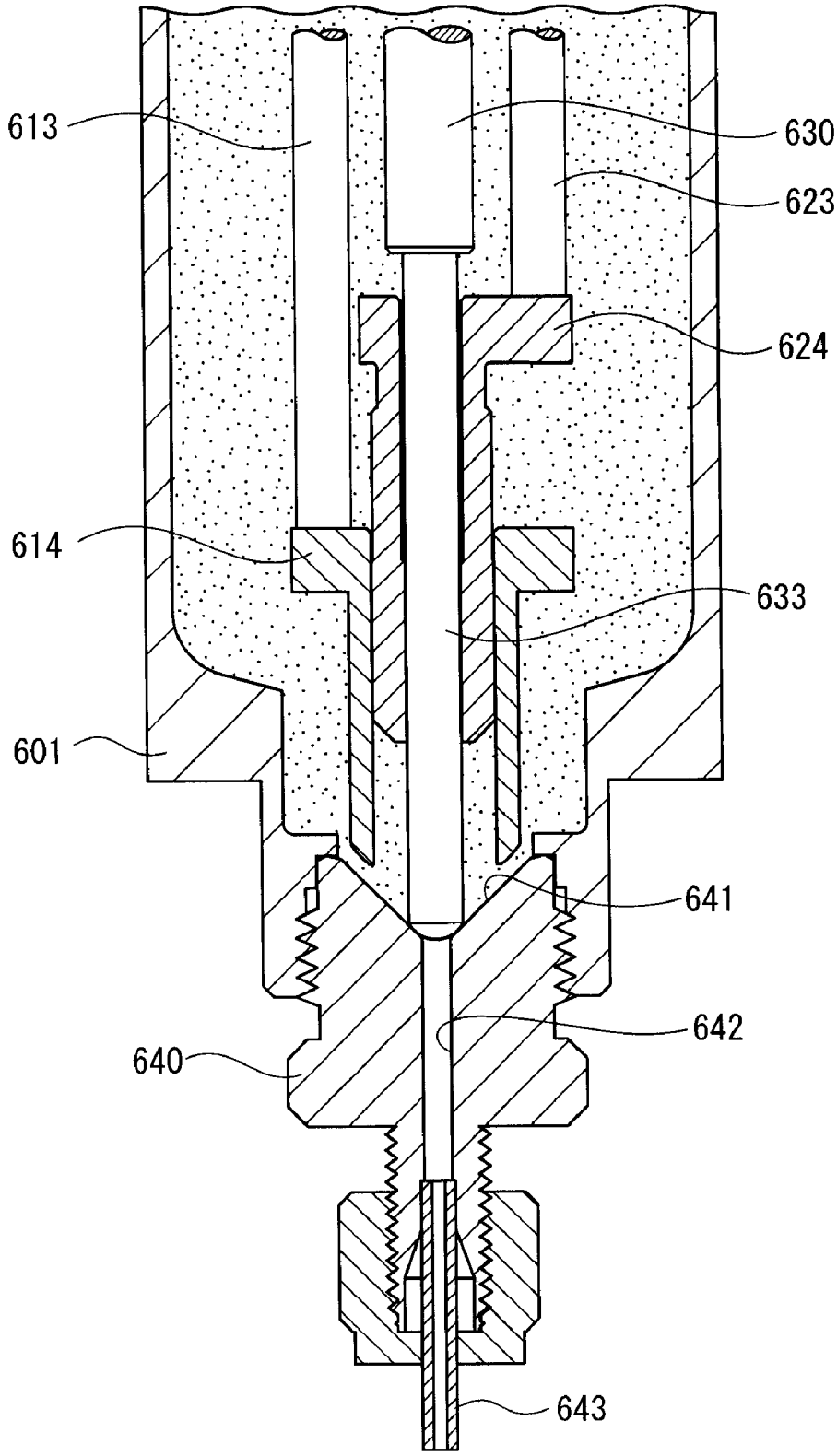
FIG. 41 is a cross-sectional view showing the pump when the suctioning process is completed according to the third embodiment.

Subsequently, as shown in FIGS. 40 and 41, the measurement nut 540 is upwardly moved by a predetermined stroke amount in accordance with the rotation driving of the second motor 522. Consequently, the measurement-nut receiving plate 542, the measurement rod 572, the measurement pressing member 582, the measurement guide member 620 and the measurement plunger member 624 are also upwardly moved, such that a tip end of the measurement plunger member 624 is moved to a position corresponding to the discharge-setting pulse number.

[First Valve-Switching Process]

Next, the drive control device stops the second motor 522, and simultaneously drives the first motor 521 to be rotated in the CW direction for an amount proportional to a switch-setting pulse number.

Figure 42:
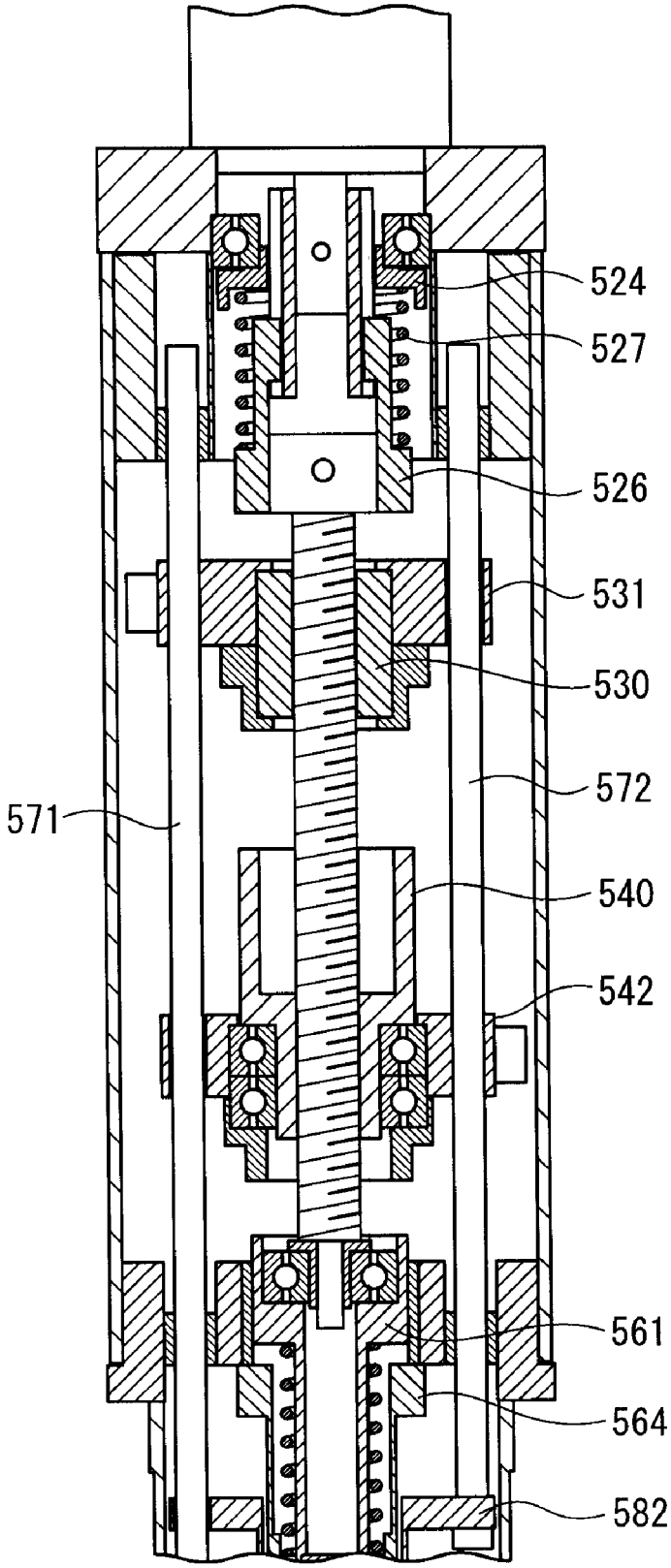
FIG. 42 is a cross-sectional view showing the drive unit when a valve-switching process is completed according to the third embodiment.
Figure 43:
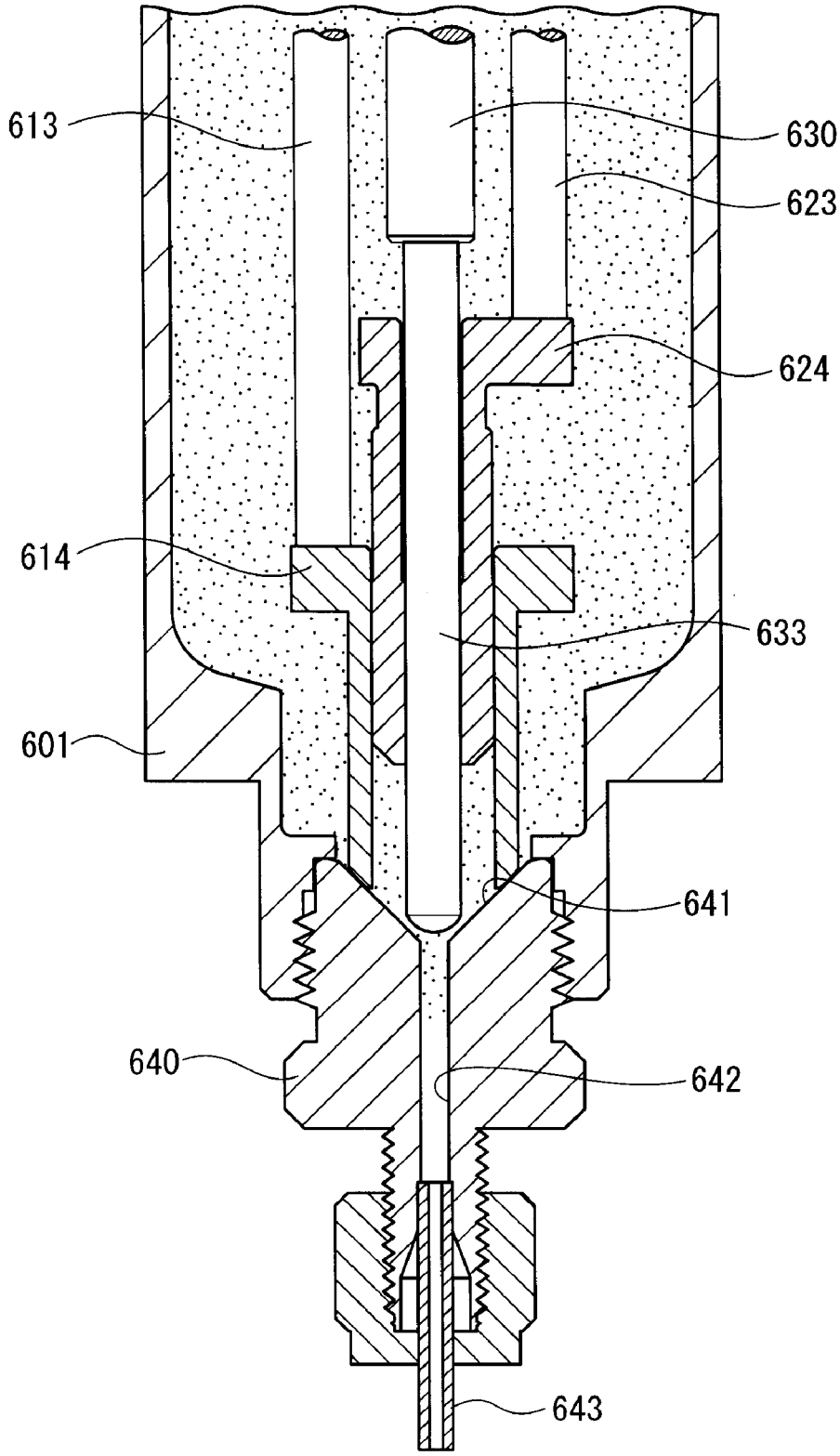
FIG. 43 is a cross-sectional view showing the pump when the valve-switching process is completed according to the third embodiment.

As shown in FIGS. 42 and 43, the inlet nut 530 and the measurement nut 540 are both downwardly moved. In accordance with the downward movement of the inlet nut 530, the inlet-nut receiving plate 531, the inlet pressing rod 571, the inlet pressing member 581, the inlet-spring receiving member 610, the inlet valve rod 613 and the inlet valve member 614 are downwardly moved.

The inlet valve member 614 abuts on the taper hole portion 641 of the valve sheet 640, such that the liquid supplier (inlet valve) is closed.

When the first motor 521 is further rotated in the CW direction while the inlet valve member 614 abuts on the taper hole portion 641, the inlet nut 530 is not capable of further downward movement since the inlet valve member 614 has abutted on the taper hole portion 641. Thus, the thread shaft 529 is upwardly moved against the biasing force of the coil spring 527. In accordance with the upward movement of the thread shaft 529, the needle pressing member 561, the needle rod 630 and the needle 633 are also upwardly moved by the biasing force of the return spring 565, such that the discharge outlet 642 having been closed by the needle 633 is opened. In short, the outlet valve is opened and the discharge outlet 642 is opened. Incidentally, an opening degree of the discharge outlet 642 opened by the needle 633 is set in accordance with the movement amount of the thread shaft 529, i.e., the switch-setting pulse number when the first motor 521 is rotated in the CW direction.

Accordingly, the inlet valve, which has been previously opened, is closed while the outlet valve, which has been previously closed, is opened, whereby the valve-switching process is performed. The valve-switching is mechanically performed such that the first motor 521 is further driven to be rotated after the inlet valve member 614 abuts on the valve sheet 640 to move the thread shaft 529. In this arrangement, either one of the valves is necessarily closed, so that the inside of the container 601 and the discharge outlet 642 are prevented from directly communicating with each other.

The measurement nut 540 is downwardly moved in accordance with the CW-direction rotation of the first motor 521. However, since the thread shaft 529 is upwardly moved after the inlet valve member 614 abuts on the taper hole portion 641 as described above, the downward movement of the measurement nut 540 is offset by the upward movement of the thread shaft 529 and the measurement nut 540 stays substantially at the same height. Accordingly, the measurement plunger member 624 also stays substantially at the same position.

In short, by the time that the valve-switching process is completed as shown in FIG. 43, the measurement plunger member 624 has been moved downwardly from the position when the suctioning process is completed (i.e., the position shown in FIG. 41) by the stroke amount of the inlet valve member 614, with which the inlet valve member 614 abuts on the taper hole portion 641.

[Discharging Process]

Figure 45:
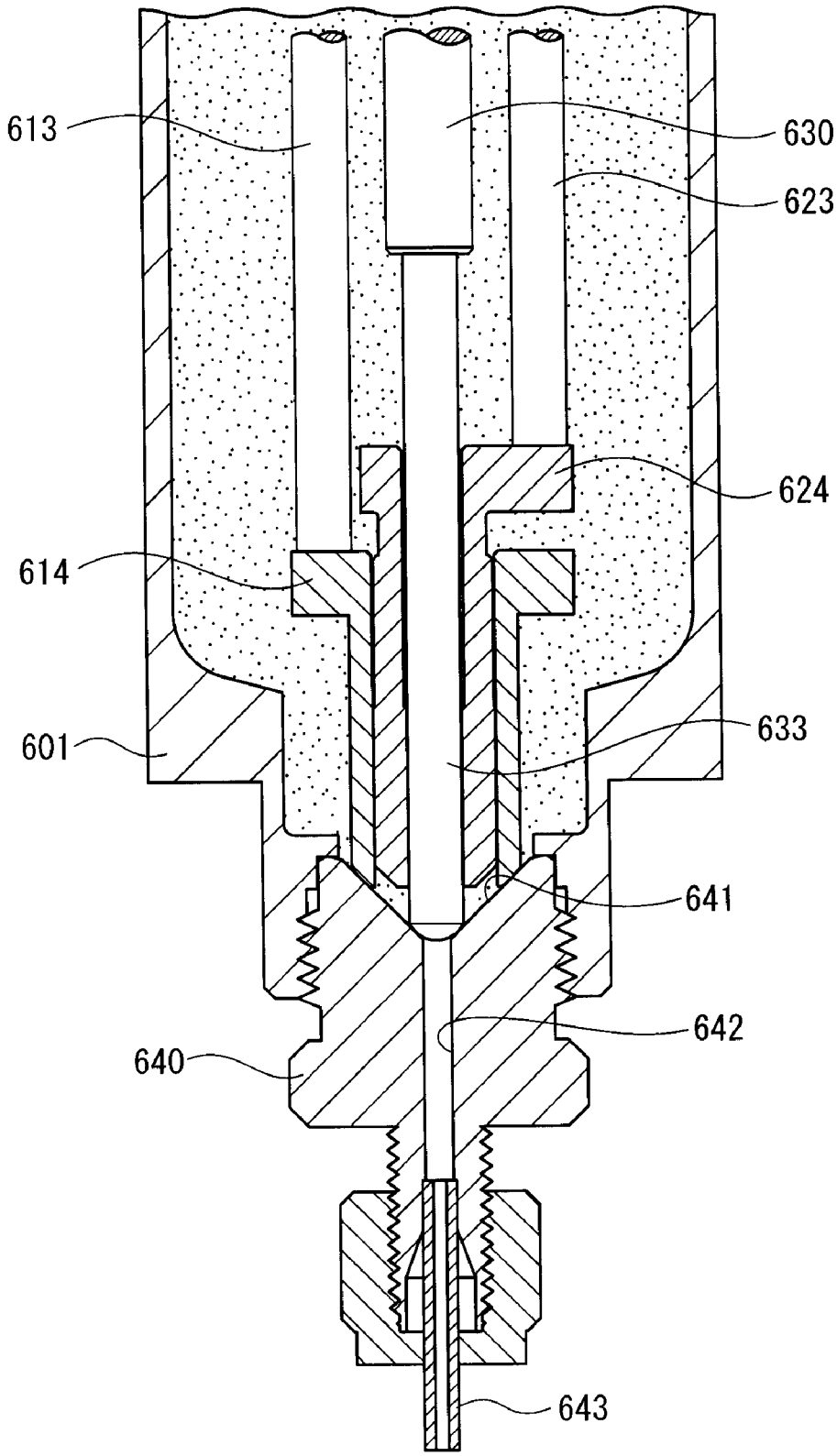
FIG. 45 is a cross-sectional view showing the pump when the discharging process is completed according to the third embodiment.

Next, the control device stops the first motor 521 and simultaneously drives the second motor 522 to be rotated in the CCW direction for an amount proportional to the discharge-setting pulse number (the same pulse number as the discharge-setting pulse number in the suctioning process). The measurement nut 540 is downwardly moved corresponding to the discharge-setting pulse number, and the measurement plunger member 624 is also moved toward the discharge outlet 642 side as shown in FIG. 45.

Since the inlet valve is closed while the outlet valve is opened at this time, the liquid is discharged from the nozzle 643 via the discharge outlet 642 in accordance with the movement of the measurement plunger member 624.

In the present embodiment, the discharging quantity is set by the movement amount of the measurement plunger member 624, which is determined based on the discharge-setting pulse number when the second motor 522 is driven. In short, in the present embodiment, while a movement-completed position of the measurement plunger member 624 when the discharging process is completed is fixed, a movement-start position of the measurement plunger member 624 is adjusted by adjusting the discharge-setting pulse number, whereby the movement amount of the measurement plunger member 624 during the discharging process (i.e., the discharging quantity) is adjusted. Accordingly, the discharging quantity is freely adjustable by merely adjusting the pulse number to drive the second motor 522 in the suctioning (measuring) process, and the discharging liquid quantity is measured.

Figure 44:
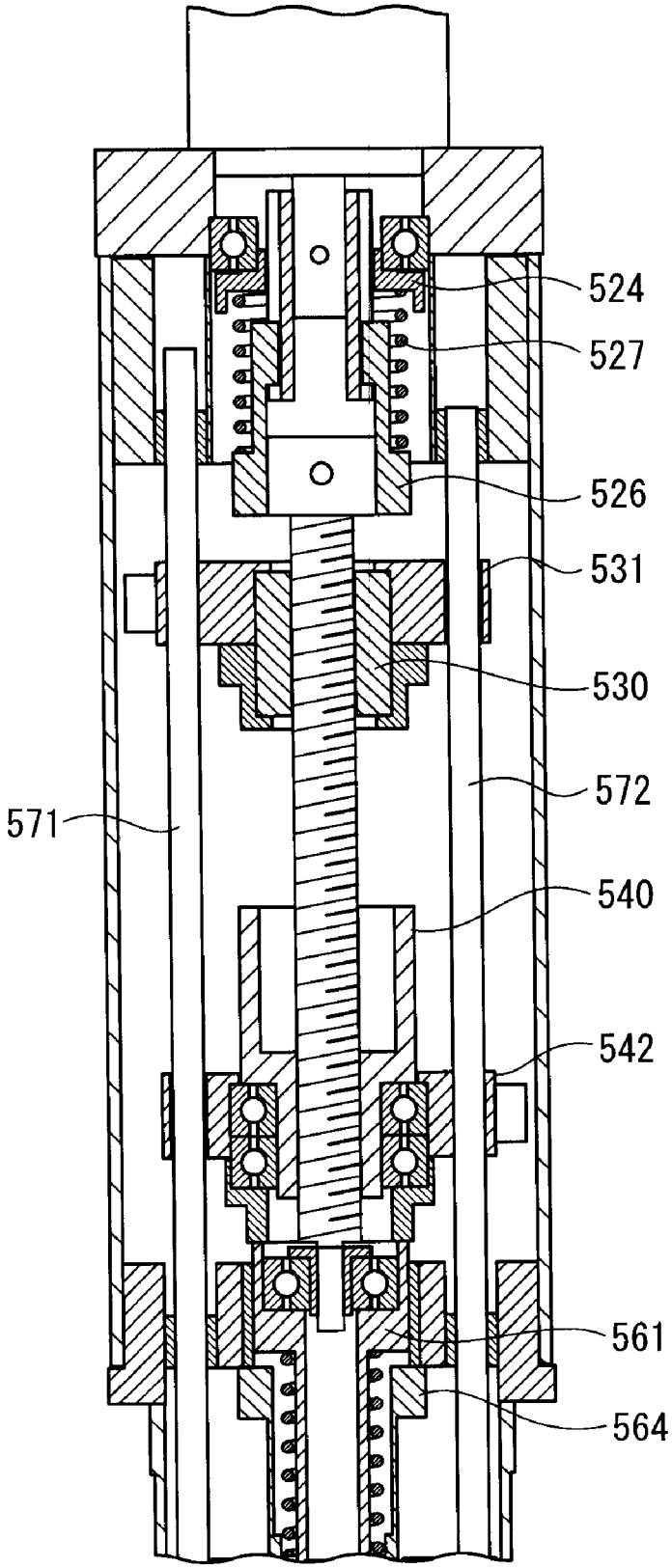
FIG. 44 is a cross-sectional view showing the drive unit when a discharging process is completed according to the third embodiment.

In addition, as shown in FIG. 44, when the discharging process is completed, the measurement nut 540 and the measurement-nut retainer 543 are downwardly moved until abutting on the needle pressing member 561. Thus, when the discharging is completed, the needle 633 also abuts on and closes the discharge outlet 642.

[Second Valve-Switching Process]

Next, the drive control device stops the second motor 522 and simultaneously drives the first motor 521 to be rotated in the CCW direction for an amount proportional to the switch-setting pulse number (the same pulse number as the switch-setting pulse number in the valve-switching process).

Then, the inlet nut 530 is moved upwardly relative to the thread shaft 529. However, since the thread shaft 529 is downwardly biased by the coil spring 527, the thread shaft 529 is relatively moved downwardly until abutting on the bush 563. Until the thread shaft 529 abuts on the bush 563 of the needle pressing member 561, the inlet valve member 614 remains in contact with the taper hole portion 641, When the thread shaft 529 abuts on the bush 563 to be incapable of further downward movement, the inlet nut 530 and the inlet valve member 614 are upwardly moved, such that the inlet valve is opened.

The measurement nut 540 is upwardly moved in accordance with the CCW-direction rotation of the first motor 521. However, since the measurement nut 540 is downwardly biased by the coil spring 527 via the thread shaft 529, the upper movement of the measurement 540 is suppressed until abutting on the bush 563. Thus, the measurement nut 540 stays at the position where the measurement-nut retainer 542 abuts on the needle pressing member 561.

When the first motor 521 is continuously rotated even after the thread shaft 529 abuts on the bush 563 to be not capable of further downward movement, the measurement nut 540 is upwardly moved.

Figure 46:
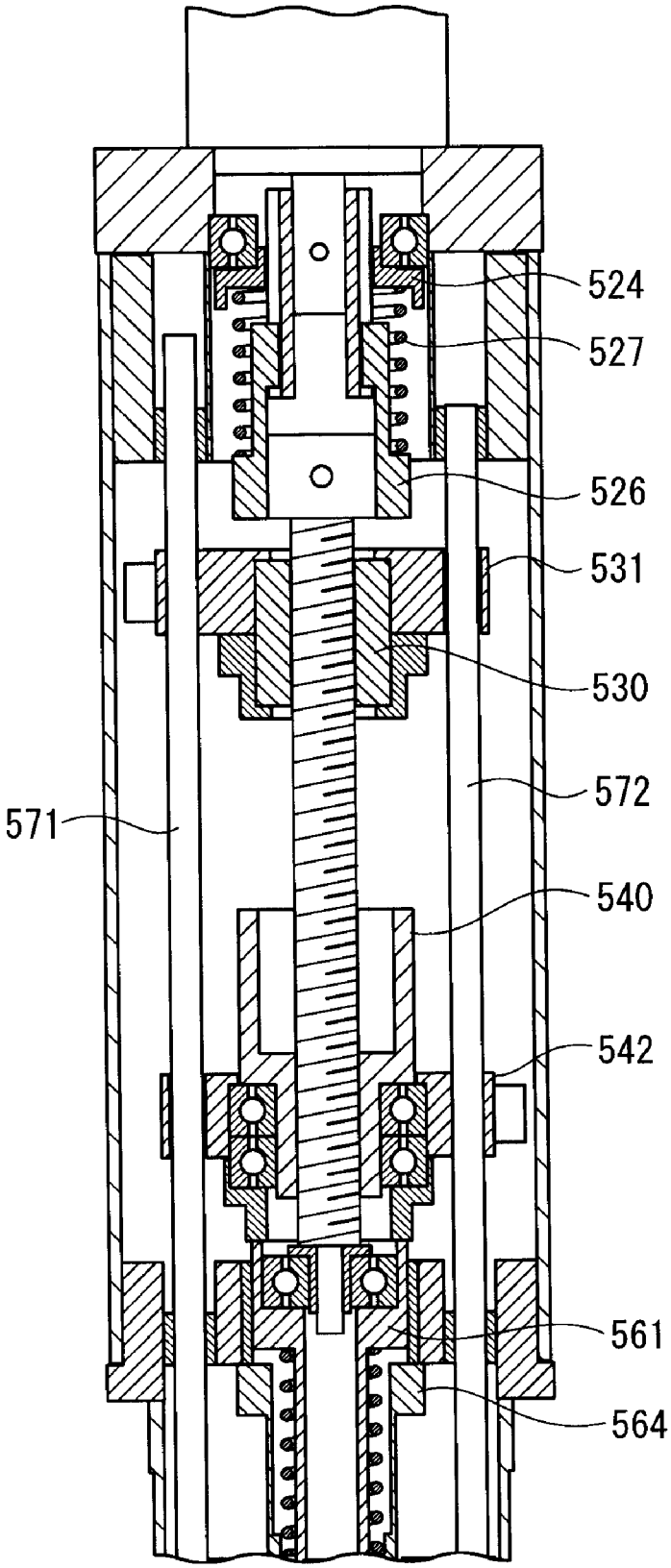
FIG. 46 is a cross-sectional view showing the drive unit in an original point recovering state according to the third embodiment.
Figure 47:
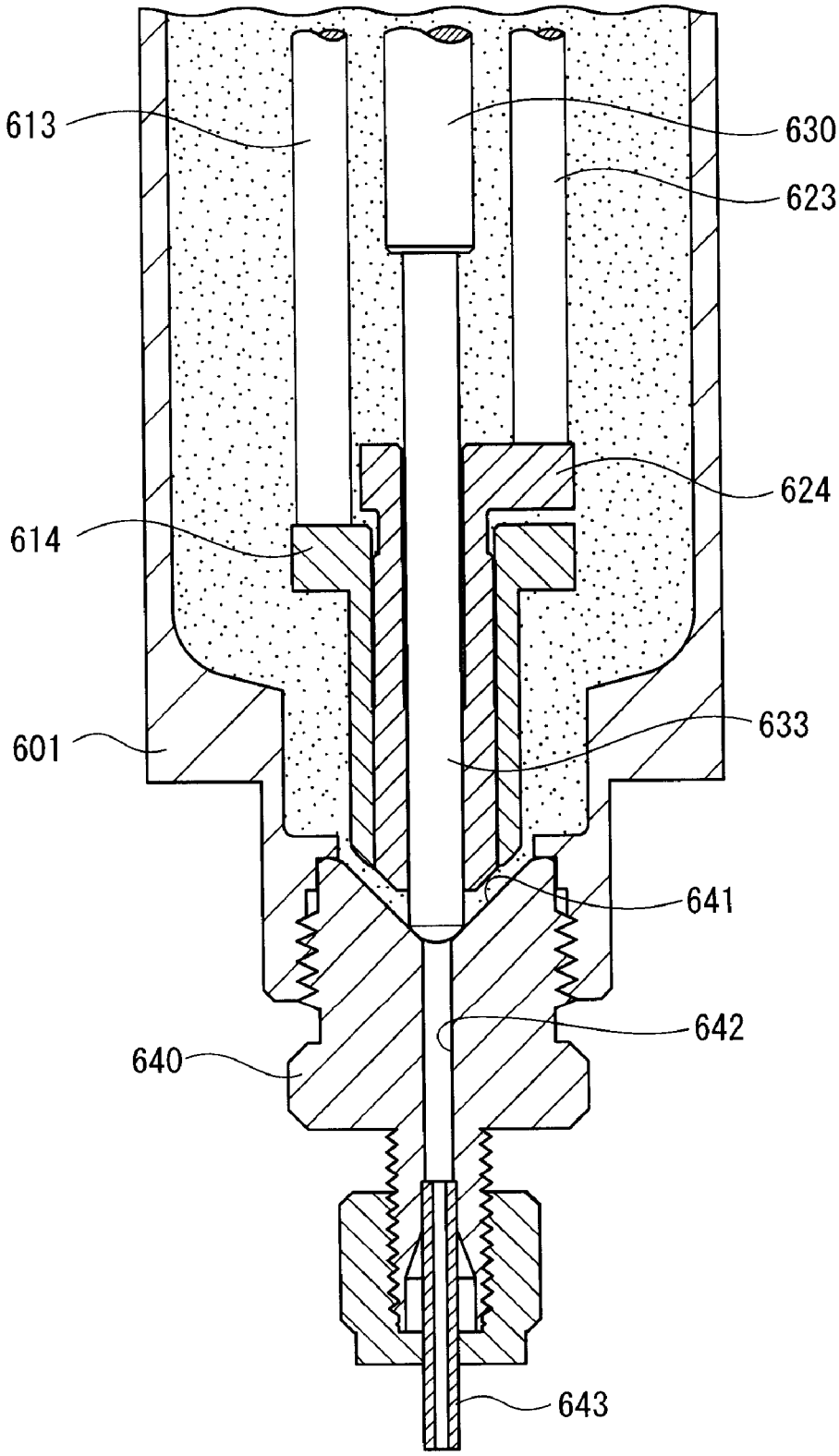
FIG. 47 is a cross-sectional view showing the pump in the original point recovering state according to the third embodiment.

In the end, from the original point state, the first motor 521 is rotated for an amount proportional to the same switch-setting pulse number both in the CW and CCW directions while the second motor 522 is also rotated for an amount proportional to the same discharge-setting pulse number both in the CW and CCW directions. Consequently, as shown in FIGS. 46 and 47, the members such as the motors 521, 522 and the nuts 530, 540 return to the original point state (the state shown in FIGS. 38 and 39).

By repeating the above-described processes, the liquid is discharged in turn by the predetermined amount. In every liquid discharging process, the liquid discharging quantity per one time can be adjusted by adjusting the discharge-setting pulse number. By adjusting the frequency and the like of the driving pulse input into the motor 521, 522, the driving speed of the inlet valve member 614, the measurement plunger member 624 and the needle 633 is controlled, whereby a cycle time of the liquid discharging can be adjusted.

According to the third embodiment, the following advantages can be obtained:

(1) Since the two motors 521, 522, the ball screw (thread shaft 529 and the nuts 530, 540), the coil spring 527, the return spring 565 are used to drive the three members of the inlet valve member 614, the measurement plunger member 624 and the needle 633, size and weight of the liquid discharging device 500 can be reduced as compared with, for example, a device in which members are driven by three motors.

Thus, when the liquid discharging device 500 according to the present embodiment is used for discharging adhesives or a variety of pastes in production lines for various products, the device can be mounted on an arm of a robot to be transferred at high speed and high acceleration. Therefore, shortening takt time in the production lines can be realized, thereby contributing to productivity improvement.

(2) Since the inlet valve member 614, the measurement plunger member 614, the needle 633 and the like are driven by the motor 521, 522, the liquid discharging device 500 can realize a liquid discharging operation at high speed as compared with an air-cylinder driven device. Further, since the motors 521, 522 generates greater force than an air-cylinder, even when the nozzle is made thinner and resistance is increased, the liquid discharging device 500 can ejaculate and discharge the liquid. The liquid discharging device can finely ejaculate even water of, for example, 0.01 microliter, whereby a stable operation is realized.

In addition, since the discharging process is completed by closing the discharge outlet 642 with the needle 633, the liquid discharging device can spit the liquid quickly without dripping and finely ejaculate the liquid in this respect as well, thereby enhancing the accuracy of the discharging amount and realizing a stable discharging operation.

(3) The discharging liquid quantity is easily and accurately adjusted using the driving pulse number for driving the motors 521, 522. With this arrangement, even in the middle of discharging, the discharging quantity per one discharge operation can be automatically adjusted. Specifically, for example, in a process to mount a plurality of electronic components on a substrate, in order to apply a different amount of an adhesive per mounting position of the electric components, the amount of the adhesive to be discharged on the substrate is required to be changed. Taking another example, in a production line where a plurality of products are conveyed in a mixed state, discharging quantity of liquid may be required to be changed per product. Even in the above examples, the liquid discharging device 500 can easily change the discharging quantity, thereby enhancing the usability.

(4) Since the drive of the motors 521, 522 is controlled only with the driving pulse number and not controlled with a sensor, an error in sensor detecting is prevented from affecting the driving accuracy, thereby realizing a drive control of high accuracy.

(5) When the original point of the motors 521, 522 is set, the original point setting process is performed using only one proximity sensor 536. Accordingly, the number of the sensor parts can be reduced and the cost is also reduced.

(6) In the present embodiment, the discharging liquid quantity is determined only based on the stroke of the measurement plunger member 624. Therefore, even when the container 601 or the like expands affected by external temperature, the accuracy of the discharging quantity is not affected and even infinitesimal quantity of the liquid can be discharged with high accuracy.

(7) In the present embodiment, since the magnets 566, 621 and return springs 565, 611 are provided, the inlet-spring receiving n ember 610, the inlet valve rod 613 and the inlet valve member 614 can be easily detached once the container 601 and the joint 515 are removed. Likewise, the measurement guide member 620, the measurement plunger rod 623, the measurement plunger member 624, the needle rod 630 and the needle 633 can be easily detached. Accordingly, the inlet valve member 614, measurement plunger member 624 and needle 633 can be easily detached for washing, whereby a maintenance operation can be easily and efficiently performed.

(8) Although there may be a delay in discharging liquid having high viscosity such as a paste in an arrangement where the pump and the discharge outlet 642 are located away from each other, there is no delay in discharging the liquid in the present embodiment since the pump having the needle 633 and the like for discharging the liquid is provided in a close proximity to the discharge outlet 642.

In addition, when a solvent such as alcohol that is evaporable due to its low boiling point flows through a complicated path (e.g., when suctioned into the pump and passing through a check valve), the solvent tends to be foamed, and accumulation of the foam prevents the liquid from being discharged. However, in the present embodiment, since the pump is provided in the close proximity to the discharge outlet 642 and the liquid flowing path is not complicated, there is no risk that the liquid is foamed, whereby a normal liquid discharging operation can be performed.

(9) Since the inlet valve member 614 is concentrically arranged outside the needle 633, a suctioning area when the liquid is suctioned into the inlet valve member 614 from a liquid suction path can be enlarged, thereby shorting the liquid suctioning time (i.e. operation time).

(10) In order to discharge liquid that has a high degree of viscosity at high speed, the liquid needs to be extruded with high pressure. Since the liquid discharging device uses as a driving source the mechanical driving force of the motor 521, 522, the liquid discharging device can have a more powerful driving force than a device whose driving source is an air-cylinder. Thus, the liquid discharging device can discharge the liquid at high speed.

In addition, since the liquid discharge device 500 can discharge the liquid from an upper position that is away from an adhered object such as a substrate, whether or not the discharging operation is performed can be checked by providing an infrared radiation sensor ion the outside of the liquid discharging device 500.

As the liquid discharging device 500 does not have any check valves, the liquid can be pressurized to be conveyed. Thus, even liquid having a high viscosity can be easily supplied into the liquid discharging device 500.

It should be noted that the invention is not limited to the arrangements according to the embodiments above, but includes modifications and improvements as long as advantages of some aspects of the invention can be achieved.

For example, the shapes and the like of the inlet valve member 313, the measurement plunger member 323 and the needle 333 are not limited to those of the first to third embodiments but includes any other shapes and the like, as long as the needle 333, the measurement plunger member 323 and the inlet valve member 313 are concentrically arranged in this order from inside toward outside.

Although the state shown in FIGS. 6A and 7A is set as the non-driven state of the liquid discharging device 1 (i.e., the original point state) in the above-described first and second embodiments, the state shown in FIGS. 8A and 9A may be set as the original point state depending on a type of the discharging liquid.

Although the state shown in FIGS. 38 and 39 is set as the non-driven state of the liquid discharging device 500 (i.e., the original point state) in the above-described third embodiments, likewise, the state shown in FIGS. 42 and 43 may be set as the original point state, depending on a type of the discharging liquid.

When the original point state is set as such, the liquid discharging device 1 can discharge the liquid as soon as the liquid discharging device 1 is driven. If the liquid discharging device 1 is arranged so that such a standard state can be controllably selected using the control device, the liquid discharging device 1 is applicable to discharging a variety of liquid.

In addition, the shapes and the like of the pump holder 2, the drive-unit base 3 and the container 4 are not limited to those of the above-described embodiments but includes any other shape and the like.

Although the container 4, 601 is provided in the above embodiments, instead of the container 4, 601, the liquid discharging device 1, 1A, 500 may have, for instance, a pump provided to the inlet valve member 313, 614 for communicating with an outer tank, such that the liquid is directly supplied to the inlet valve.

Although a piezoelectric-element support member is provided by the piezoelectric-element support plate 12 and the driving arm member 15A, 15B formed separately from the piezoelectric-element support plate 12 in the above-described first and second embodiments, the piezoelectric-element support member may be provided by integrally forming both the plate 12 and the member 15A, 15B.

Although the dimension adjuster is provided between the base end 122A, 122B and the displacement expanding portion in the above-described first and second embodiments, the dimension adjuster may be omitted by accurately forming the piezoelectric-element support plate 12. The dimension adjuster is not limited to the arrangement of the above embodiments but includes any other adjuster as long as the length dimension can be adjusted.

Although the voltage of the first preset vale applied to the piezoelectric element 14A, 14B is set at "0" in the above-described first and second embodiments, voltage of a predetermined value may be applied. In other words, the voltage value may be set such that the piezoelectric elements 14A, 14B have a different length dimension depending on the applied voltage (the first preset value and the second preset value).

Although the strain gauges 101A-104B are provided to the second hinge 125 in the second embodiment, the strain gauge may be attached to the other hinges 123, 126, 128, as long as the gauge is provided to a portion deformed in accordance with the expansion and contraction of the piezoelectric elements 14A, 14B. Nevertheless, it is preferable that the gauge is provided to the second hinge 125, which is the most deformed and large enough for the stain gauges 101A-104B to be attached.

Although the strain gauges 101A-10B are mounted to both of the two second hinges 125 in the second embodiment, the strain gauge may be provided to, for example, only one of the second hinges 125, such that the gauge detects only the movement amount of the measurement plunger member 323 or only the operation of the inlet valve member 313 and the needle 333. Nevertheless, it is preferable to provide the strain gauges 101A-194B to both of the second hinges 125 since the liquid discharging device 1A can be controlled to be driven with high accuracy.

Incidentally, the strain gauges 101A-104B may be provided to control the liquid discharging device 1 according to the first embodiment However, the operation (displacement amount) of the piezoelectric element 14A, 14B can be accurately controlled with the driving voltage as long as a force applied to the measurement plunger member 323 and the like during the liquid discharging operation is substantially stable, as in a case where liquid of the same kind is discharged. Therefore, even without the strain gauges 101A-104B as in the first embodiment, a liquid discharging operation with high accuracy can be performed.

Although the position of the measurement plunger member 323 when the measuring process is completed is detected using the strain gauges 101A-104B such that the value of the voltage applied to the piezoelectric elements 14A, 14B is controlled in the next measuring process in the second embodiment, the output from the strain gauges 101A-104B may be processed in real time to control the value of the voltage applied to the piezoelectric elements 14A, 14B. For instance, the bending strain amount of the second hinge 125 is continuously detected from the timing when the measurement plunger member 323 starts moving, such that the drive of the piezoelectric elements 14A, 14B is stopped when the bending strain amount reaches a predetermined amount (i.e., when the measurement plunger member 323 is moved by a predetermined amount). The discharging quantity may be adjusted in this manner.

Although the original point setting of the two motors 521, 522 is performed using only one proximity sensor 536 in the third embodiment, two sensors may be provided to respectively detect the original point positions of the motors 521, 522, i.e., the original point positions of the inlet nut 530 and the measurement nut 540, for setting the original point. When the two sensors are provided, there is no need to adjust the original point position of the second motor 522 by upwardly moving the thread shaft 529 with the measurement-nut retainer 543 abutting on the needle pressing member 561 as shown in FIG. 34. Accordingly, there is no need to set as the original point position the position where the measurement nut retainer 543 abuts on the needle pressing member 561.

The liquid discharging device 1, 1A, 500 according to the present invention may discharge liquid such as solder corresponding to shapes and the like of components by controlling the driving of the piezoelectric element 14A, 14B and the motor 521, 522. Thus, the liquid discharging device 1, 1A, 500 may be used for drawing short lines. Particularly, when the movement amount of the measurement plunger member 323, 624 is detected in real time using the strain gauges 101A-104B, the liquid discharging device 1, 1A, 500 can linearly discharge the liquid reliably and accurately.

In addition, the liquid discharging device 1, 1A, 500 according to the present invention may be installed in a manufacturing apparatus of electronic parts in use. Specifically, the manufacturing apparatus of the electronic parts may include the above-described liquid discharging device 1, 1A, 500, a liquid supplier for supplying liquid into the container 4, 601 of the liquid discharging device 1, and a control device for controlling the driving units of the liquid discharging device 1, 1A, 500. With this arrangement, the liquid supplied by the liquid supplier may be discharged from the nozzle 43, 643 via the liquid discharging device 1, 1A, 500 to manufacture electronic parts The manufacturing apparatus of the electronic parts uses the above-described liquid discharging device 1, 1A, 500 that can accurately convey liquid of infinitesimal amount. Therefore, the liquid can be discharged from the nozzle 43, 643 in infinitesimal quantity with high accuracy.

INDUSTRIAL APPLICABILITY

The present invention is applicable to a liquid discharging device that can: discharge liquid in infinitesimal quantity at high speed; automatically adjust discharging liquid quantity; be simply configured to reduce manufacturing cost; and be easily down-sized. Such a liquid discharging device can be used in, for instance, manufacturing a semiconductor or dispensing medicinal solution.

What is claimed is:

1. A liquid discharging device, comprising:

a body having a liquid containing space and a discharge outlet, the liquid containing space that contains liquid to be discharge therein, the discharge outlet communicating with the liquid containing space;

a discharge-outlet opening/closing member that opens and closes the discharge outlet, the discharge-outlet opening/closing member being provided inside the liquid containing space of the body;

a discharging member that discharges the liquid, the discharging member being provided inside the liquid containing space of the body and concentrically arranged outside the discharge-outlet opening/closing member;

a supplier opening/closing member that opens and closes a liquid supplier communicating with the liquid containing space and the discharge outlet, the supplier opening/closing member being provided inside the liquid containing space of the body and concentrically arranged outside the discharging member; and a driving mechanism that drives the discharge-outlet opening/closing member, the discharging member and the supplier opening/closing member to perform predetermined operations, wherein the driving mechanism includes: a first piezoelectric element and a second piezoelectric element; a piezoelectric-element support mounted with the first and second piezoelectric elements; a biasing unit that biases the piezoelectric-element support toward a discharge outlet relative to the body; and a drive controller adapted to drive each of the piezoelectric elements separately, the piezoelectric-element support includes: a first base end and a second base end to which first ends of the piezoelectric elements are respectively fixed; a first drive unit and a second drive unit to which second ends of the piezoelectric elements are respectively fixed; and a first displacement expanding portion and a second displacement expanding portion expanding and outputting displacement of the drive units when the drive units are displaced in conjunction with expansion and contraction of the piezoelectric elements, the supplier opening/closing member abuts on the body and closes the liquid supplier when moved in a direction to approach the discharge outlet via the first drive unit and the first displacement expanding portion in accordance with the expansion of the first piezoelectric element, while the supplier opening/closing member is moved away from the body to open the liquid supplier when moved in a direction to be away from the discharge outlet via the first drive unit and the first displacement expanding portion in accordance with the contraction of the first piezoelectric element, the discharging member discharges the liquid from the discharge outlet when moved in a direction to approach the discharge outlet via the second drive unit and the second displacement expanding portion in accordance with the expansion of the second piezoelectric element, while the discharging member suctions the liquid from the liquid supplier when moved in a direction to be away from the discharge outlet via the second drive unit and the second displacement expanding portion in accordance with the contraction of the second piezoelectric element, and the discharge-outlet opening/closing member is moved in a direction to approach the discharge outlet via the piezoelectric-element support biased toward the discharge outlet by the biasing unit and abuts on the discharge outlet to close the discharge outlet when the first piezoelectric element is contracted, while the discharge-outlet opening/closing member is moved away from the discharge outlet to open the discharge outlet when the first piezoelectric element is further expanded after being expanded to make the supplier opening/closing member abut on the body such that the piezoelectric-element support is moved against a biasing force of the biasing unit in a direction to be away from the discharge outlet.

2. The liquid discharging device according to claim 1, wherein the piezoelectric-element support comprises: an integrally-formed piezoelectric-element support plate; and a driving arm member mounted on the piezoelectric-element support plate, the piezoelectric-element support plate includes: a base provided between the piezoelectric elements; the first base end and the second base end continuously formed from a first end of the base; the first drive unit and the second drive unit continuously formed from a second end of the base via first hinges; and a first displacement transmitter and a second displacement transmitter continuously formed from second hinges deformable relative to the base ends and third hinges deformable relative to the drive units, when the piezoelectric elements are expanded from an initial state, the first hinges are deformed such that the drive units are inclined with third hinge sides of the drive units being moved in a direction in which the piezoelectric elements are expanded, when the third hinge sides of the driving units are moved in the direction in which the piezoelectric elements are expanded in accordance with the inclination of the drive units, the second hinges are deformed such that the displacement expanding portions are inclined, the driving arm member includes: a fixing portion fixed to each of the displacement transmitters; and a driving arm extending from the fixing portion, the driving arm member being arranged such that, when the displacement transmitters are inclined, a movement amount of a tip end of the driving arm is larger than an expanding amount of the piezoelectric elements, and the displacement expanding portions are provided by the driving arm member and the displacement transmitters.

3. The liquid discharging device according to claim 2, wherein a strain gauge is mounted to at least one of the hinges.

4. The liquid discharging device according to claim 3, wherein the strain gauge is provided by four strain gauges, two of the strain gauges being attached to first surfaces of the second hinges while the other two of the strain gauges being attached to second surfaces of the second hinges, and the four strain gauges are connected to form a bridge.

5. The liquid discharging device according to claim 1, the liquid discharging device further comprising:

a second biasing unit provided between the body and the supplier opening/closing member, the second biasing unit biasing the supplier opening/closing member toward a piezoelectric-element support relative to the body;

a third biasing unit provided between the supplier opening/closing member and the discharging member, the third biasing unit biasing the discharging member toward a piezoelectric-element support relative to the supplier opening/closing member; and a fourth biasing unit provided between the discharging member and the discharge-outlet opening/closing member, the fourth biasing unit biasing the discharge-outlet opening/closing member toward a piezoelectric-element support relative to the discharging member, wherein a biasing force of the respective second to fourth biasing units is set to be gradually reduced in the order of the second to fourth, and the biasing force of the biasing unit biasing the piezoelectric-element support toward the discharge outlet relative to the body is set to be larger than the biasing force of the second biasing unit.

6. The liquid discharging device according to claim 1, wherein the drive controller is adapted to change a value of voltage applied to the first piezoelectric element from a first preset value for the first piezoelectric element to a second preset value for the first piezoelectric element, while the drive controller is adapted to change a value of voltage applied to the second piezoelectric element from a first preset value for the second piezoelectric element to a second preset value for the second piezoelectric element, and the drive controlling unit performs steps of:

providing an initial state in which the voltage of the first preset values is applied to the piezoelectric elements such that the discharge outlet is closed by the discharge-outlet opening/closing member biased toward the discharge outlet by the biasing unit;

measuring the liquid contained in a measurement space defined by the body and the discharging member, the discharging member being moved to a predetermined position at a discharge outlet side by changing the value of the voltage applied to the second piezoelectric element from the first preset value for the second piezoelectric element to a third preset value for the second piezoelectric element so as to expand the second piezoelectric element by a predetermined amount while maintaining the value of the voltage applied to the first piezoelectric element at the first preset value for the first piezoelectric element, the third preset value for the second piezoelectric element being larger than the first preset value for the second piezoelectric element and being smaller than the second preset value for the second piezoelectric element;

switching a valve such that the supplier opening/closing member abuts on the body to close the liquid supplier while the discharge-outlet opening/closing member is moved in a direction to be away from the discharge outlet to open the discharge outlet, the supplier opening/closing member abutting on the body by changing the value of the voltage applied to the first piezoelectric element from the first preset value for the first piezoelectric element to the second preset value for the second piezoelectric element so as to expand the first piezoelectric element by a predetermined amount while maintaining the value of the voltage applied to the second piezoelectric element at the third preset value for the second piezoelectric element, the discharge-outlet opening/closing member being moved in the direction to be away from the discharge outlet by moving the piezoelectric-element support against the biasing force of the biasing unit in a direction to be away from the discharge outlet via the supplier opening/closing member abutting on the body;

discharging the liquid contained in the measurement space from the discharge outlet by reducing the measurement space between the discharge member and the body, the measurement space being reduced by changing the value of the voltage applied to the second piezoelectric element from the third preset value for the second piezoelectric element to the second preset value for the second piezoelectric element such that the second piezoelectric is further expanded by a predetermined amount while maintaining the value of the voltage applied to the first piezoelectric element at the second preset value for the first piezoelectric element to move the discharging member toward the discharge outlet;

opening an inlet valve by opening the liquid supplier, the liquid supplier being opened by changing the value of the voltage applied to the first piezoelectric element from the second preset value for the first piezoelectric element to the first preset value for the first piezoelectric element such that the first piezoelectric element is contracted to the original length while maintaining the value of the voltage applied to the second piezoelectric element at the second preset value for the second piezoelectric element so as to move the supplier opening/closing member away from the body ; and recovering an original point by moving the discharging member away from the body to recover the initial state, the discharging member being moved away from the body by changing the value of the voltage applied to the second piezoelectric element from the second preset value for the second piezoelectric element to the first preset value for the second piezoelectric element to contract the second piezoelectric element to the original length while maintaining the value of the voltage applied to the first piezoelectric element at the first preset value for the first piezoelectric element.

7. The liquid discharging device according to claim 1, wherein the drive controller is adapted to control a driving speed of the discharge-outlet opening/closing member, the discharging member and the supplier opening/closing member by controlling the value of the voltage applied to the piezoelectric elements.

8. The liquid discharging device according to claim 1, wherein the body includes: a driving mechanism housing portion that houses the piezoelectric-element support; and a container detachably attached to the driving mechanism housing portion, and the discharge outlet is provided to the container.

9. A liquid discharging device, comprising:

a body having a liquid containing space and a discharge outlet, the liquid containing space that contains liquid to be discharge therein, the discharge outlet communicating with the liquid containing space;

a discharge-outlet opening/closing member that opens and closes the discharge outlet, the discharge-outlet opening/closing member being provided inside the liquid containing space of the body;

a discharging member that discharges the liquid, the discharging member being provided inside the liquid containing space of the body and concentrically arranged outside the discharge-outlet opening/closing member;

a supplier opening/closing member that opens and closes a liquid supplier communicating with the liquid containing space and the discharge outlet, the supplier opening/closing member being provided inside the liquid containing space of the body and concentrically arranged outside the discharging member; and a driving mechanism that drives the discharge-outlet opening/closing member, the discharging member and the supplier opening/closing member to perform predetermined operations, wherein the driving mechanism includes: a first motor and a second motor; a thread shaft rotated by the first motor; a first nut member and a second nut member screwed to the thread shaft; a transmitting gear rotated by the second motor to transmit a rotation of the second motor to the second nut member; a biasing unit that biases the thread shaft toward a discharge outlet side; and a drive controller adapted to control the motors separately, first end side of the thread shaft is connected to a rotating shaft of the first motor to be integrally rotatable with the rotating shaft of the first motor and slidable in an axis direction, while second end side of the thread shaft is connected to the discharge-outlet opening/closing member, the first nut member is connected to the supplier opening/closing member, the second nut member is connected to the discharging member, the supplier opening/closing member is moved in a direction to approach the discharge outlet to abut on the body to close the liquid supplier when the first nut member is moved in a direction to approach the discharge outlet in accordance with a rotation of the first motor, while the supplier opening/closing member is moved in a direction to be away from the discharge outlet to be away from the body to open the liquid supplier when the first nut member is moved in a direction to be away from the discharge outlet in accordance with a rotation of the first motor, the discharging member is moved in a direction to approach the discharge outlet to discharge the liquid from the discharge outlet when the second nut member is moved in a direction to approach the discharge outlet in accordance with a rotation of the second motor, while the discharging member suctions the liquid from the liquid supplier when the second nut member is moved in a direction to be away from the discharge outlet in accordance with a rotation of the second motor, and the discharge-outlet opening/closing member is biased toward a discharge outlet side via the biasing unit and the thread shaft to abut on and close the discharge outlet when the supplier opening/closing member is away from the body such that the liquid supplier is opened, while the discharge-outlet opening/closing member is moved away from the discharge outlet to open the discharge outlet when the first motor is further rotated after the supplier opening/closing member abuts on the body in accordance with the rotation of the first motor such that the thread shaft is moved against a biasing force of the biasing unit in a direction to be away from the discharge outlet.

10. The liquid discharging device according to claim 9, wherein a spline shaft is connected with a rotating shaft of the second motor, the spline shaft being coaxially rotated integrally with the rotating shaft, and the transmitting gear includes: a motor gear adapted to slide along the spline shaft and to be integrally rotated with the spline shaft; and a middle gear screwed to the motor gear and a gear provided on an outer circumference of the second nut member.

11. The liquid discharging device according to claim 9, wherein the drive controller performs steps of:

providing an initial state in which the supplier opening/closing member is arranged away from the body to open the liquid supplier, the discharging member being arranged at a stroke end position in a direction to approach a discharge outlet, the discharge-outlet opening/closing member being biased toward a discharge outlet by the biasing unit and arranged at a position where the discharge outlet is closed;

suctioning the liquid into a space provided by a movement of the discharging member inside the supplier opening/closing member by driving the second motor to be rotated by a predetermined amount from the initial state to move the discharging member connected to the second nut member in a direction to be away from the discharge outlet by a predetermined distance;

first-time switching a valve such that the supplier opening/closing member connected to the first nut member abuts the body to close the liquid supplier while moving the discharge-outlet opening/closing member in a direction to be away from the discharge outlet to open the discharge outlet, the supplier opening/closing member abutting on the body by driving the first motor to be rotated by a predetermined amount, the discharge-outlet opening/closing member being moved in the direction to be away from the discharge outlet by moving the thread shaft against the biasing force of the biasing unit in a direction to be away from the discharge outlet via the supplier opening/closing member abutting on the body;

discharging the liquid contained in the space from the discharge outlet by driving the second motor to be driven by a predetermined amount to move the discharging member connected to the second nut member toward a discharge outlet such that the space inside the supplier opening/closing member is reduced; and second-time switching the valve such that the supplier opening/closing member connected to the first nut member is moved away from the body to open the liquid supplier while the discharging member closes the discharge outlet, the supplier opening/closing member being moved away from the body and the discharging member closing the discharge outlet by driving the first motor to be rotated by a predetermined amount.

12. The liquid discharging device according to claim 11, wherein in the initial state, the discharge-outlet opening/closing member is pressed by the second nut member to be arranged at a position where the discharge outlet is closed, and when the discharging process is completed, the discharge-outlet opening/closing member is pressed by the second nut member to be arranged at the position where the discharge outlet is closed.

13. The liquid discharging device according to claim 9, wherein the drive controller is adapted to control a driving speed of the discharge-outlet opening/closing member, the discharging member and the supplier opening/closing member by controlling a rotation speed of the motors.

* * * * *